US005743661A

United States Patent [19]

Tamura

[11] Patent Number: 5,743,661

[45] Date of Patent: Apr. 28, 1998

[54] IMAGING DEVICE

[75] Inventor: Toshiharu Tamura, Saitama-ken, Japan

[73] Assignee: Asahi Kogaku Kogyo Kabushiki Kaisha, Tokyo, Japan

[21] Appl. No.: 588,873

[22] Filed: Jan. 19, 1996

Related U.S. Application Data

[62] Division of Ser. No. 937,280, Aug. 31, 1992, Pat. No. 5,547,183.

[30] Foreign Application Priority Data

| | | | |
|---|---|---|---|
| Aug. 30, 1991 | [JP] | Japan | 3-244744 |
| Oct. 28, 1991 | [JP] | Japan | 3-308420 |
| Oct. 28, 1991 | [JP] | Japan | 3-308421 |
| Oct. 28, 1991 | [JP] | Japan | 3-308422 |
| Oct. 28, 1991 | [JP] | Japan | 3-308423 |
| Nov. 20, 1991 | [JP] | Japan | 3-331239 |
| Nov. 20, 1991 | [JP] | Japan | 3-331242 |
| Dec. 11, 1991 | [JP] | Japan | 3-351006 |
| Dec. 11, 1991 | [JP] | Japan | 3-351007 |
| Dec. 13, 1991 | [JP] | Japan | 3-352004 |
| Dec. 18, 1991 | [JP] | Japan | 3-353808 |
| Dec. 18, 1991 | [JP] | Japan | 3-353809 |
| Dec. 18, 1991 | [JP] | Japan | 3-353810 |
| Dec. 18, 1991 | [JP] | Japan | 3-353811 |

[51] Int. Cl.[6] ..... B41J 11/20

[52] U.S. Cl. ..... 400/55; 400/120.02; 400/240.4; 400/225; 400/636; 400/625

[58] Field of Search ..... 400/240, 240.1, 400/240.2, 240.3, 240.4, 208, 55, 225, 231, 120.02, 120.16, 636, 645, 645.3, 624, 625, 634, 642, 647, 185, 622, 628

[56] References Cited

U.S. PATENT DOCUMENTS

| | | | |
|---|---|---|---|
| 3,635,466 | 1/1972 | Townsend . | |
| 4,365,795 | 12/1982 | Fukushima et al. . | |
| 4,436,416 | 3/1984 | Negoro et al. . | |
| 4,552,470 | 11/1985 | Yana et al. | 400/120.02 |
| 4,580,774 | 4/1986 | Yamaguchi et al. . | |
| 4,703,346 | 10/1987 | Bierhoff | 400/120.02 |
| 4,817,933 | 4/1989 | Honjo et al. . | |
| 4,890,140 | 12/1989 | Negoro et al. . | |
| 4,897,675 | 1/1990 | Negishi . | |
| 4,963,941 | 10/1990 | Negishi et al. . | |
| 4,975,716 | 12/1990 | Hara et al. . | |
| 4,987,448 | 1/1991 | Chikama . | |
| 5,023,667 | 6/1991 | Negoro et al. . | |
| 5,028,156 | 7/1991 | Takano . | |
| 5,045,892 | 9/1991 | Morisawa et al. . | |
| 5,078,519 | 1/1992 | Takita et al. | 400/120.16 |
| 5,080,512 | 1/1992 | Schofield et al. | 400/240 |
| 5,087,926 | 2/1992 | Wakui | 400/120.16 |
| 5,110,104 | 5/1992 | Wakeo et al. . | |
| 5,148,228 | 9/1992 | Takano . | |
| 5,248,207 | 9/1993 | Yamamoto et al. | 400/120.16 |

FOREIGN PATENT DOCUMENTS

| | | | |
|---|---|---|---|
| 0101376 | 6/1984 | Japan | 400/240.4 |
| 0013574 | 1/1985 | Japan | 400/240.4 |
| 0164869 | 7/1986 | Japan | 400/240.4 |

*Primary Examiner*—Eugene H. Eickholt
*Attorney, Agent, or Firm*—Greenblum & Bernstein P.L.C.

[57] ABSTRACT

An imaging device which reciprocatively transports a recording sheet to form a color image thereon. A front extreme end of the recording sheet is clamped between a pair of rollers, and the pair of rollers are reciprocatively moved along a recording sheet feed path, while clamping the recording sheet therebetween, to repeatedly execute an image forming process. After completion of the repeated image forming processes, at least one of the pair of rollers is driven to rotate, to thereby transport the recording sheet forwardly on the feed path.

20 Claims, 48 Drawing Sheets

IMAGING DEVICE

This application is a division of application Ser. No. 07/937,280, filed Aug. 31, 1992, now U.S. Pat. No. 5,547,183.

BACKGROUND OF THE INVENTION

The present invention relates to an imaging device for printing characters or drawing figures on the surface of a recording paper being fed, and discharging the same.

A recording (image information) system for an imaging device such as a copying machine, printer, facsimile and the like is provided with a recording head movable in the width direction of a recording paper, or a recording head having recording elements disposed over the entire width direction of the recording paper. In this system, an image is formed while moving the recording paper in a direction perpendicular to which the recording head is moved or a direction perpendicular to the direction in which the elements are disposed. That is, in this system, a main scanning is carried out by the recording head and an auxiliary-scanning is carried out by the movement of the recording paper.

In the imaging device in which the auxiliary-scanning is carried out by the movement of the recording paper as described above, there is provided a holding member (clamper) capable of holding the extreme end of a recording paper. The clamper can be moved in the direction in which the recording paper is scanned and thus the recording paper is moved by moving the clamper which holds recording paper. This arrangement is often applied to a color imaging device which must carry out an image formation on the same recording paper a plurality of times because the movement of the recording paper can be precisely controlled by this arrangement.

Nevertheless, in the above arrangement for holding the extreme end of the recording paper by the clamper, a problem arises in that a paper discharge means must be provided in addition to the clamper. Further, the recording paper on which an image has been formed must be released from the clamper, and discharged by the paper discharge means, and thus the structure of the imaging device is made complex.

Further, to form an image with a pinpoint accuracy, the clamper must accurately hold the extreme end of the recording paper at the predetermined position thereof. For this purpose, a recording paper feed means must feed the recording paper while ensuring the extreme end thereof is parallel with the clamper. Thus, the feed of the recording paper from a recording paper accommodation unit to the clamper must be managed with a pinpoint accuracy, and the recording paper being fed must be stopped at a position having a proper positional relationship with the clamper at all times. However, it is difficult to feed all the recording papers to the pressed together contact portion of rollers in the state the recording papers (their attitudes) are in parallel with the pair of rollers, because respective recording papers have a different rigidity specific to them and may be sometimes curled. To cope with this problem, the structure of the imaging device is made more complex.

Further, in the arrangement wherein the recording paper is scanned/moved by being held by the clamper, since the clamper holds and pulls the extreme end of the recording paper to scan the recording paper for the formation of an image, a force is applied to the recording paper and relatively pulls the recording paper backward. When an image is formed on the same recording paper a plurality of times as in the formation of a color image, the clamper must be moved in a direction opposite to that of scanning operation to return the recording paper to a scanning start position. At this time, the recording paper is pulled backward when the rear end (the end opposite to the end held by the clamper) of the recording paper is pulled to feed the same in the reverse direction. Therefor, the position of the recording paper held by the clamper is dislocated by the force applied to the recording paper for pulling the same. As a result, there is a possibility that an image may be badly formed.

Further, in the arrangement wherein an image is formed by relatively moving the recording paper with respect to the recording head, the recording paper becomes charged with an electrostatic potential caused by the friction between the recording paper and the recording head. In this case, there is a possibility that the recording paper on which an image has been formed may be electrostatically attracted to a paper discharge path and cannot be discharged well or an electrostatic charge may be discharged from the recording paper discharged from the discharge path when a user touches the paper.

The aforesaid clamper is moved by an endless drive belt rotatably stretched about pulleys and relatively immovably fixed to the clamper at a predetermined position of the belt, serving as a rotating track in parallel with the scanning/movement direction of the clamper. In this case, the drive belt is usually composed of a timing belt which can be moved with a pinpoint accuracy without slipping. Nevertheless, fixing the clamper to the drive belt stretched about the pulleys is difficult and time consuming. Further, the dismounting and mounting of the clamper, necessary for maintenance, is also time consuming. Note, the arrangement for moving the moving member by the endless drive belt rotatably stretched about the pulleys is applied not only to the imaging device but also to an image reading device referred to as an image scanner to read an image by moving a reading head.

The aforesaid imaging device forms an image on a recording paper cut to a predetermined size. In this imaging device, a plurality of recording papers are accumulated and accommodated in a recording paper cassette and introduced into the device by an introduction means such as paper feed rollers, or the like, provided with a paper feed unit to which the recording paper cassette can be detachably mounted and fed to the position of the clamper along a predetermined path. Incidentally, in a color imaging device for forming a color image by carrying out an image formation on the same recording paper a plurality of times by using different colors, on the completion of an image formation by a color, the recording paper must be returned to an image formation start position for the repetition of the image formation using different colors.

The length of a recording paper feed path is inevitably increased to prevent the disadvantage that the rear end of the recording paper arriving at the paper feed unit interferes with the paper introduction means such as the paper feed rollers or the like when the recording paper is returned to the image formation start position. If, however, the length of the paper feed path is increased, a problem arises in that a paper feed drive system is made complex, a possibility of a paper jam is increased, and the size of the imaging device as a whole is also increased.

The recording head of the imaging device is disposed in confrontation with a platen roller. The platen roller has a surface composed of a material with a predetermined elasticity (such as rubber or the like); so that the platen roller is pressed against the recording head with a pressing force that is maintained as uniformly as possible. The recording paper, held and moved (sub-scanned) by the clamper, is pressed against and caused to intimately contact with the recording head, by the platen roller. When the recording paper is fed by being held by the clamper, the recording paper must be fed between the recording head and the platen roller. For this purpose, the recording head is arranged to be spaced apart from the platen roller. It is logical to arrange the imaging device in such a manner that the platen roller and recording head are disposed on one side of the imaging device, the recording paper feed unit is disposed on the other side of the device on the lower portion thereof, and the upper portion of the recording paper feed unit is used as the region where the clamper is moved. With this arrangement, however, when the recording paper is to be fed by being held by the clamper, it is fed through a path starting from the recording paper feed unit, and arriving at the clamper by reversing the direction thereof by turning around the platen roller. As a result, there is a possibility that the recording paper is not fed well, because the paper is not smoothly moved around the platen roller due to the rigidity (stiffness) thereof. To cope with this problem, a guide must be provided to regulate the feed direction of the recording paper moving around the platen roller. Since, however, this guide means cannot be provided at a position interfering with the recording head when an image is formed, a problem arises when the recording paper is fed.

The platen roller is rotatably arranged and a pinch roller is pressed thereagainst. The recording paper is pressed against the platen roller by the pinch roller and can be fed to the position where the recording paper is held by the clamper, by the rotation of the platen roller. When, however, the platen roller is in a resting state, the pinch roller is continuously pressed against the same position of the outer periphery of the platen roller. As a result, a pressed recess may be defined in the elastic member forming the surface of the platen roller, by the pinch roller. When the pinch roller is removed from the platen roller, this recess gradually recovers and the surface of the platen roller returns to its original state. However, the recording paper is pressed against the recording head with an irregular press force in the peripheral direction of the platen roller (in the auxiliary-scanning direction) from the time when an image formation is started to the time when the recess disappears (when the recessed portion confronts the recording head, the press force is reduced). Thus, a problem arises in that a bad image formation is caused by the above recess.

Further, when an image formation is carried out a plurality of times in the color imaging device as described above, the recording paper must be returned to the image formation start position each time the image formation is carried out. At this time, the retracting speed of the clamper must be synchronized with the circumferential speed, in a reverse direction, of the platen roller with a pinpoint accuracy, so that the recording paper is not loosened, or a clamped position of the recording paper is not dislocated by an excessive tension applied thereto. Thus, a problem arises in that the arrangement and control of the imaging device are made complex. Note, when the recording paper is loosened, wrinkles are developed in the recording paper, and when the clamped position is dislocated, a bad image is formed on the recording paper due to the relative dislocation of colors.

A heat sensitive recording system is employed to form an image by using the recording head on a recording paper moved as described above. In this system, solid-melted inks or sublimated-pigment inks are supplied by being coated on a base film. When color materials are supplied by an ink ribbon, the recording paper being scanned and the ink ribbon placed thereon are moved together between the platen roller and the recording head disposed in close proximity to the platen roller. The image is formed by transferring the color materials onto the recording paper. In the imaging device arranged as described above, if the ink ribbon is not moved in perfect synchronism with the scanning/movement of the recording paper, a problem arises in that a resolution is lowered or colors are dislocated in the color imaging device. When, however, the ink ribbon is moved by being wound around a reel, the ink ribbon is moved at a different speed depending upon an amount of the ink ribbon wound (because the diameter of the winding side reel is changed as an amount of the ink ribbon wound therearound is changed). Thus, the movement of the ink ribbon cannot be perfectly synchronized with the movement of the recording paper, and thus the speed of the ink ribbon is very difficult to constantly control.

Further, the ink ribbon is consumable and a new ink ribbon must be supplied when it is consumed. Usually, the ink ribbon is supplied as an ink ribbon cassette accommodating a reel around which a predetermined amount of an ink ribbon is wound and a reel for winding the ink ribbon. Thus, when the ink ribbon is totally consumed, the entire ink ribbon cassette is replaced. In an imaging device provided with a recording head having recording elements disposed over the entire width of a recording paper and using the aforesaid ink ribbon, however, an ink ribbon as wide as the width of the recording paper to which an image can be formed must be moved between a platen roller and the recording head, together with the recording paper. Further, a new ink ribbon cassette must be easily installable.

An imaging device using usual papers cut to a predetermined size is arranged such that a recording paper cassette accommodating the recording papers (usual papers) is detachably mounted to the paper feed unit. The recording papers are fed from the recording paper cassette to the imaging device one by one so that an image can be formed thereon. With this arrangement, a size of the recording paper can be easily changed by replacing (switching) the recording paper cassette.

In the imaging device supplying the recording papers from the detachably mounted recording paper cassette, a feed device such as a feed roller, or the like, for introducing the recording papers accommodated in the recording paper cassette to the imaging device (i.e., supplying the recording papers from the recording paper cassette) is disposed on the imaging device side. Therefore, the recording papers accommodated in the recording paper cassette must be able to be fed while keeping a predetermined relative positional relationship with the feed means disposed on the imaging device side in the state that the recording paper cassette is mounted to a predetermined position of the imaging device. Thus, in an imaging device having the feed roller provided therewith, the recording papers must be pressed against the feed roller.

When, however, this arrangement is provided with the recording paper cassette, the recording paper cassette is made complex and a cost is increased.

SUMMARY OF THE INVENTION

It is therefore a first object of the present invention to provide a clamper structure for an imaging device wherein a clamper for holding a recording paper performs a paper discharge function.

A second object of the present invention is to provide a recording paper feed structure for an imaging device capable of correcting the attitude (i.e., orientation) of the recording paper by feeding the recording paper by a simple arrangement, so that the extreme end of the recording paper is parallel with a pair of positioning and feed rollers by which the recording paper is fed, as well as managing the position of the recording paper with respect to the pair of positioning and feed rollers and an amount of the recording paper fed by the pair of positioning and feed rollers.

A third object of the present invention is to provide a clamper structure, for an imaging device, by which a recording paper is prevented from being dislocated from the position of a clamper where the recording paper is held, by an external force applied to the recording paper.

A fourth object of the present invention is to provide a recording paper feed structure for an imaging device capable of causing a recording paper to be supplied to the portion of the pair of feed rollers which contact each other under pressure, for feeding the recording paper, even if the recording paper is not supplied with a pinpoint accuracy.

A fifth object of the present invention is to provide a recording paper feed structure comprising a clamper for an imaging device by which a recording paper is moved and scanned by being held by the clamper, so that an electrostatic potential charged to the recording paper by friction is removed, the recording paper onto which an image has been formed being prevented from being badly fed because the recording paper is attracted to a paper discharge path by the electrostatic potential, and the electrostatic potential is previously prevented from being discharged to a user.

A sixth object of the present invention is to provide a recording paper feed structure for an imaging device, by which a recording paper can be held by the clamper at a holding position, and removed from the clamper at a removing position and discharged, by a simple arrangement.

A seventh object of the present invention is to provide a coupling structure for an imaging device by which a drive belt can be simply fixed to and released from a scanning/movement unit to thereby improve assembly and maintenance workability.

An eighth object of the present invention is to provide a recording paper feed path for an imaging device by which a recording paper located at an image formation finish position can be returned to an image formation start position without increasing the length of the recording paper feed path, to thereby reduce the size of the device as a whole.

A ninth object of the present invention is to provide a recording paper feed structure for an imaging device capable of reversing the feeding of a recording paper along a platen roller, without the provision of a guide means interfering with a recording head.

A tenth object of the present invention is to provide a pinch roller pressedly contact structure for an imaging device capable of preventing a pressed recess from being formed in the elastic member on the surface of the platen roller by a pinch roller pressed thereagainst, thus preventing a bad image from being formed by the recess, to thereby form an image of high quality.

An eleventh object of the present invention is to provide a platen roller rotation structure for an imaging device so that a complex arrangement and control become unnecessary to cause the speed of a recording paper moved by being held by the clamper to coincide with the circumferential speed of the platen roller with a pinpoint accuracy, and the position where the recording paper is held by the clamper is not dislocated because the recording paper is loosened or an excessive force is applied to the recording paper.

A twelfth object of the present invention is to provide an ink ribbon winding structure for an imaging device capable of winding an ink ribbon around a reel in perfect synchronism with the scanning/movement of a recording paper without the need for a troublesome speed control.

A thirteenth object of the present invention is to provide an ink ribbon cassette for an imaging device which can be easily replaced, and enables that a length of ink ribbon equal to the width of a recording paper to which an image can be formed, can be moved while held between the platen roller and the recording head, together with the recording paper.

A fourteenth object of the present invention is to provide a pressure contact structure for contacting recording papers, accommodated in a recording paper cassette against a paper feed roller for an imaging device and arranged such that the recording papers accommodated in the cassette are pressed against the paper feed roller provided with the imaging device in association with the mounting of the recording paper cassette so that the recording paper cassette can be simply arranged.

According to the first aspect of the present invention, the pair of rollers are disposed vertically, and pressed against each other, and the extreme end of the recording paper is held by the pair of rollers. The recording paper is scanned/moved by the movement of the rollers. Thus, the recording paper can be held and then discharged after the completion of an image formation by the rotation of one of the rollers, whereby the imaging device can be simply arranged.

According to the second aspect of the present invention, the recording paper is fed by rotating the pair of positioning and feed rollers in the state that the recording paper is pressed against the pressure contact portion of the rollers. Thus, the attitude of the recording paper can be corrected, whereby the extreme end thereof is in parallel with the pair of positioning and feed rollers as well as the position of the recording paper with respect to the pair of positioning and feed rollers, and an amount of the recording paper fed by the pair of positioning and feed rollers can be managed.

According to the third aspect of the present invention, one of the pair of rollers for holding the recording paper is supported by the support member of a holding means through a rotating direction regulation means for permitting the roller to be rotated in the direction for dragging the recording paper in the same direction as a scanning direction and prohibiting the roller to be rotated in a reverse direction. Thus, the roller is not rotated by a tension applied to the recording paper, thereby preventing a bad image formation caused by the dislocation of the position where the recording paper is held.

According to the fourth aspect of the present invention, one of the pair of rollers has a smoothly finished surface, and a recording paper feed path is directed to the smooth surface roller side with respect to the pressure contact portion of the pair of rollers. Thus, the smooth surface roller serves as a guide member for guiding the recording paper to the pair of rollers, so that the recording paper can be introduced between the pair of rollers without the needs for a complex guide structure.

According to the fifth aspect of the present invention, the surface of at least one of the pair of rollers for holding the recording paper comprises an electric conductive material and is grounded. Thus, an electrostatic potential produced by friction can be grounded, thereby preventing the situation where the recording paper cannot be discharged well because the recording paper onto which an image has been formed is attracted to the paper discharge path by the electrostatic potential, and also preventing electrostatic potential discharge to a user trying to hold the recording paper.

According to the sixth aspect of the present invention, operation means for operating the holding member are provided, respectively, at the paper feed position and the paper discharge position of the holding member and function as the clamper moved by holding the recording paper. Thus, the device can be simply arranged without the need for providing both a clamp member and a recording paper feed drive member, and without changing the recording paper from the clamp member to the recording paper feed drive means.

According to the seventh aspect of the present invention, the drive belt can be very easily coupled with the scanning/movement unit by causing a locking member to be engaged with the scanning/movement unit, whereby an assembly and maintenance workability can be improved.

According to the eighth aspect of the present invention, a recording paper, fed through a recording paper feed path, from a recording paper feed unit, is supplied to a recording paper holding means by elastically deforming a divergence member and the recording paper returning from the recording paper holding means is supplied to a recording paper retraction unit by the divergence member. Thus, the length of the recording paper feed path is minimized, a recording paper feed drive system can be simplified, the occurrence of a paper jam can be prevented and the size of the device can be reduced as a whole.

According to the ninth aspect of the present invention, when a recording paper is fed by being held by the recording paper holding means, the recording head is lightly spaced apart from the platen roller and located at the paper feed position, and the recording paper is fed between the platen roller and the recording head. Thus, the direction in which the recording paper is fed is regulated by the recording head, and the recording paper is guided in a reverse direction along the platen roller without a guide means interfering with the recording head, whereby the recording paper can be securely fed along a predetermined feed path.

According to the tenth aspect of the present invention, a force by which the pinch roller is pressed against the platen roller is reduced except during the time when a recording paper is fed to the recording paper holding means, in association with the recording head moving in accordance with operating states. Thus, a pressed recess in the surface of the platen roller, caused by pressure contact with the pinch roller during non-operating times, can be prevented. Accordingly, the formation of a bad image caused by a pressed recess is also provided.

According to the eleventh aspect of the present invention, the platen roller is rotated at a circumferential speed which is synchronous with the movement of a recording paper, by the action of a friction clutch and the recording paper is moved at the moving speed of the recording paper holding means in the state that a suitable tension is applied to the recording paper. Thus, the loosening of the recording paper and the dislocation of the position where the recording paper is clamped can be prevented by a simple arrangement.

According to the twelfth aspect of the present invention, the reel for winding the ink ribbon is driven to rotate through a friction clutch which runs in an idle state when a torque having a predetermined value or higher is applied thereto. Thus, the ink ribbon is wound at a speed regulated by the recording paper, by the action of the friction clutch, whereby the winding of the ink ribbon can be in perfect synchronism with the scanning/movement of the recording paper.

According to the thirteenth aspect of the present invention, the ink ribbon cassette of the imaging device according to the present invention causes the ink ribbon to be pressed against the platen roller through a central opening by the recording head. Thus, a length of ink ribbon equal to the width of the recording paper to which the image is to be transferred, can be moved by being held between the platen roller and the recording head, together with the recording paper. Also, ink ribbon cassette can be easily replaced.

According to the fourteenth aspect of the present invention, an arrangement for pressing the recording papers, accommodated in the recording paper cassette, against the feed roller, provided with the imaging device, can be disposed on the imaging device side and the recording papers, accommodated in the recording paper cassette, can be pressed against the feed roller in association with the mounting of the recording paper cassette to the imaging device. Thus, the arrangement of the recording paper cassette can be simplified.

The above, and other objects, features and advantages of the present invention will become apparent from the following detailed description which is to be read in conjunction with the accompanying drawings.

DETAILED DESCRIPTION OF THE ACCOMPANYING DRAWINGS

DESCRIPTION OF THE EMBODIMENTS

An embodiment of the present invention will be described below with reference to the drawings.

Figure 1:
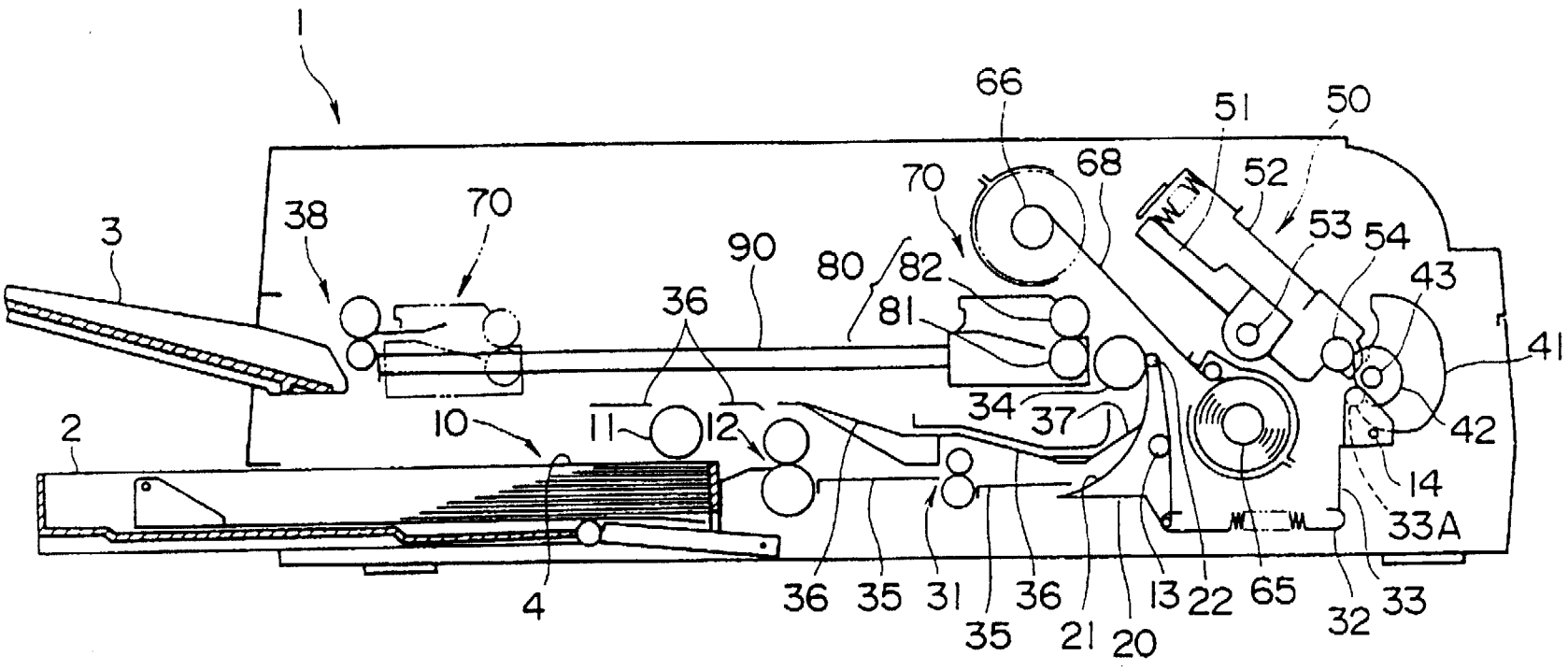
FIG. 1 is a longitudinal cross sectional view showing a schematic arrangement of an embodiment of an imaging device according to the present invention.
Figure 2:
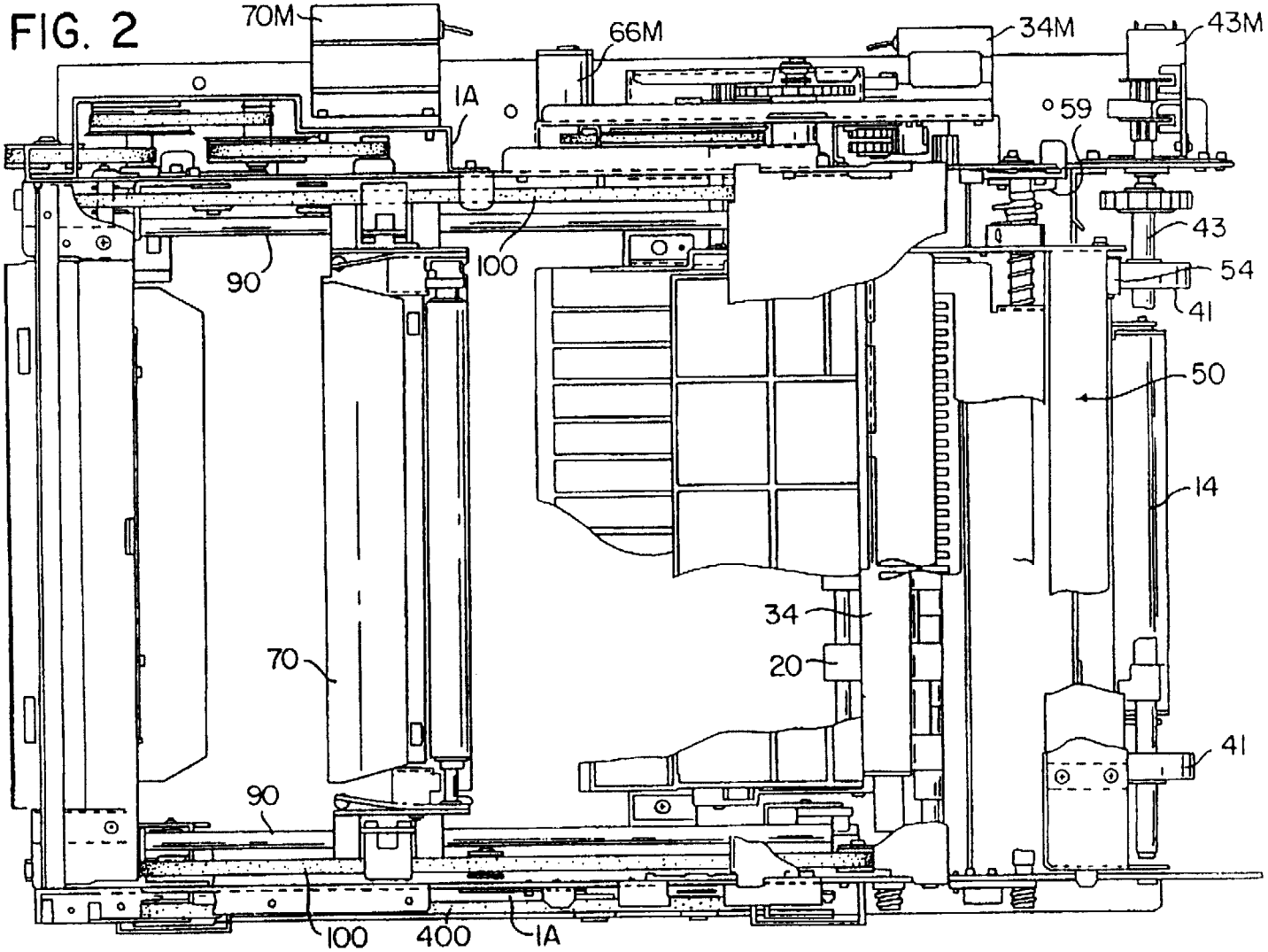
FIG. 2 is a plan view showing a schematic arrangement of an imaging device according to the present invention.
Figure 3:
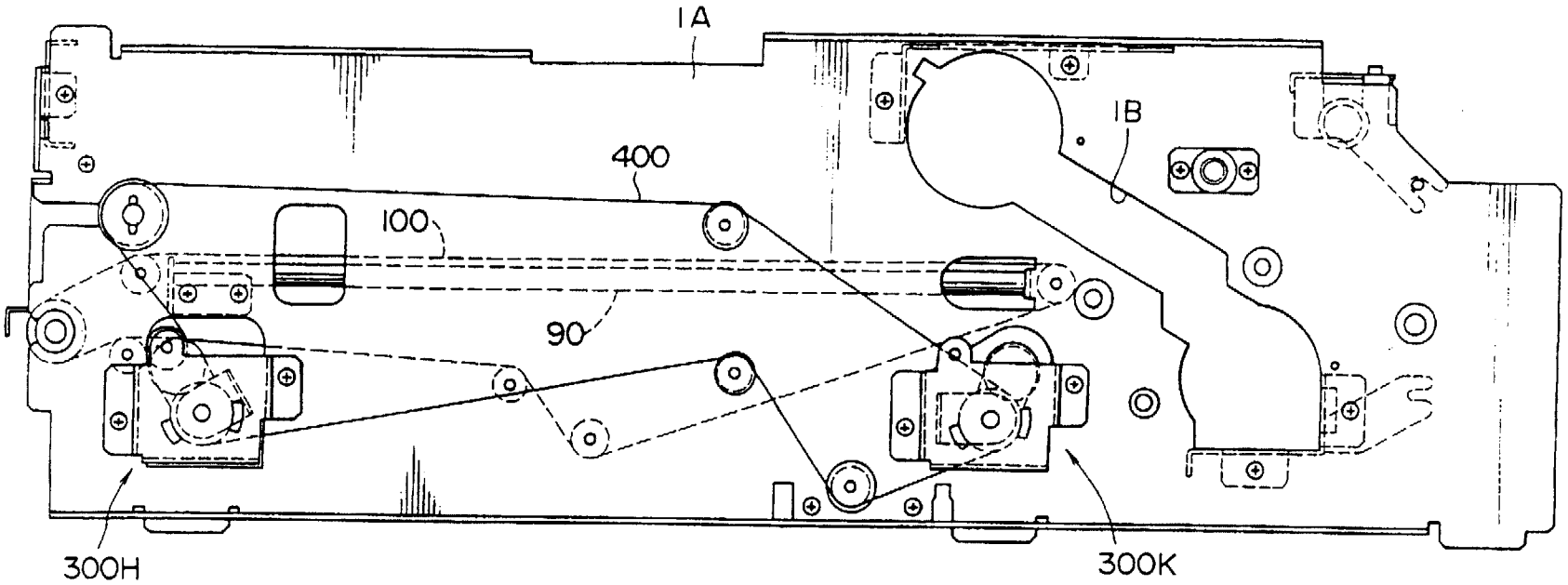
FIG. 3 is a diagram showing a chassis side plate on the front side in FIG. 1.
Figure 4:
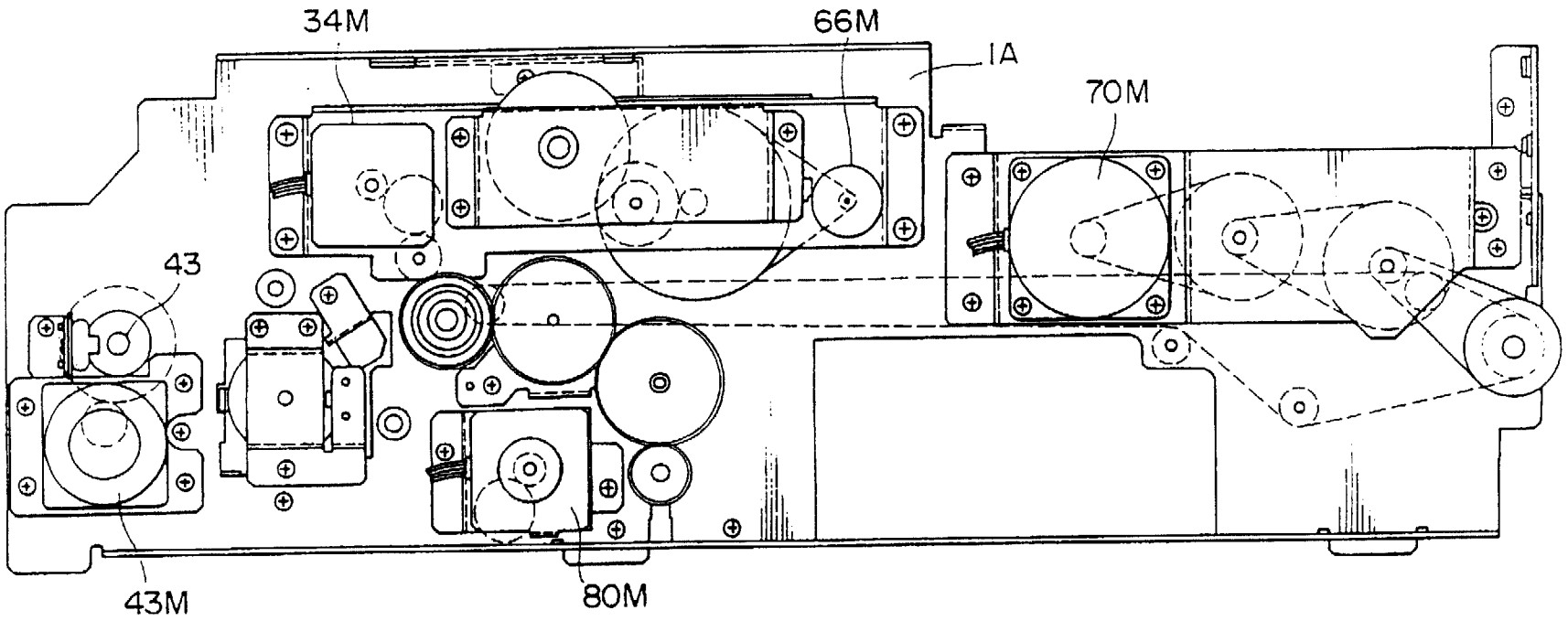
FIG. 4 is a diagram showing a chassis side plate on the backside in FIG. 1.

FIG. 1 is a longitudinal cross sectional view showing the schematic arrangement of an embodiment of an imaging device according to the present invention; FIG. 2 is a plan view showing the schematic arrangement of the imaging device; FIG. 3 is a diagram showing a chassis side plate on the front side of FIG. 1; and FIG. 4 is a diagram showing a chassis side plate on the backside of FIG. 1.

The illustrated imaging device 1 is so-called color imaging device, and forms a color image by forming images a plurality of times (e.g., 4 times for magenta, cyan, yellow, and black) on the same recording paper based on image data decomposed to three colors of red, blue and green.

The imaging device 1 is arranged such that a paper feed unit 10 is provided on the lower portion at one end (the left end in FIG. 1) of the imaging device 1. A recording paper cassette 2 accommodating recording papers 4 . . . 4 can be detachably mounted to the paper feed unit 10. A paper discharge tray 3 is provided above the paper feed unit 10. The recording paper 4, accommodated in the recording paper cassette 2, is introduced from the paper feed unit 10, fed to the end of the device opposite to the paper feed unit 10, and then reversed upwardly. Thereafter, an image is formed on the recording paper 4 by transferring a sublimation dye of an ink ribbon 68, by using a thermal transfer head 50 (to be described later) and then the recording paper 4 is discharged onto the paper discharge tray 3.

The paper feed unit 10 has an opening into which the recording paper cassette 2 can be inserted, and a recording paper introduction roller 11 is disposed at the upper front end of the paper feed unit 10, in the state that the recording paper cassette 2 is inserted into the opening.

A pair of introduction rollers 12, located in a vertical direction and pressed against each other, are disposed at a position adjacent to the front end of the recording paper cassette 2.

Although not shown in FIG. 1, each of the recording paper introduction roller 11 and the pair of introduction rollers 12, is rotatably supported at the opposite ends thereof, by the chassis side plates 1A (not shown in FIG. 1) of the imaging device 1.

Figure 5:
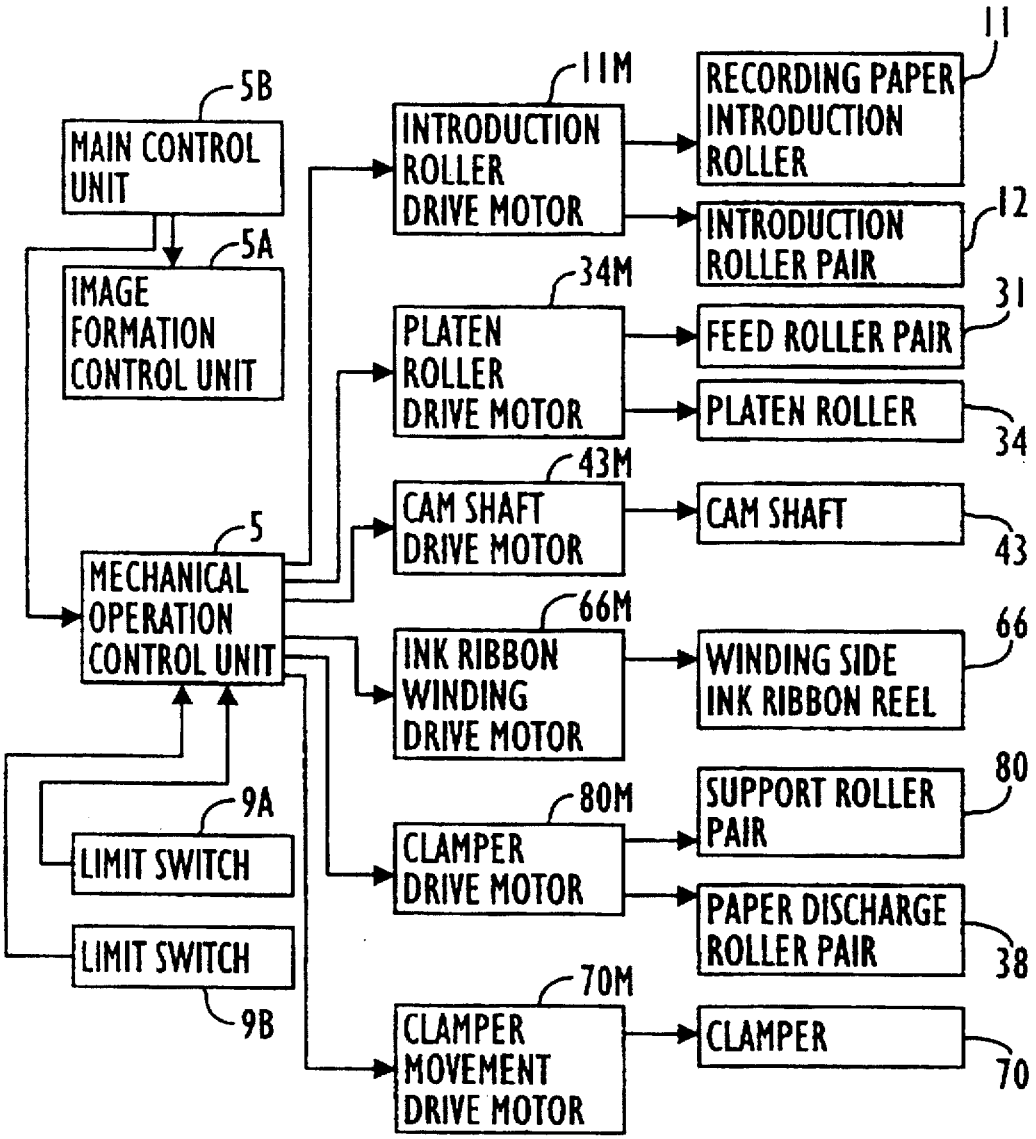
FIG. 5 is a control block diagram of the imaging device.

Further, the recording paper introduction roller 11 and the pair of introduction rollers 12, are coupled to an introduction roller drive motor 11M (shown in the control block diagram of the imaging device 1 of FIG. 5; not shown in FIG. 1) to be rotated by the introduction roller drive motor 11M. The introduction roller drive motor 11M is controlled by a mechanical operation control unit 5. An image formation control unit 5A is provided for regulating image data transmission to a transfer head thermal array 51 of a head 50. A main control unit 5B is provided for regulating all other operations of the imaging device.

A pair of feed rollers 31, located in a vertical direction and pressed against each other, are disposed at a position toward which the recording paper is fed from the pair of introduction rollers 12 (on the right side in FIG. 1).

Although not shown in FIG. 1, the upper and lower rollers of the pair of feed rollers 31 are rotatably supported at the opposite ends thereof by the chassis side plates 1A of the imaging device 1.

The pair of feed rollers 31 are coupled to a platen roller drive motor 34M (shown in the control block diagram of FIGS. 5 and 4; not shown in FIG. 1) to be rotated by the motor 34M. The platen roller drive motor 34M is controlled by the control unit 5 and can be rotated forward and backward.

Recording paper guide plates 35 are disposed between the pair of introduction rollers 12 and the pair of feed rollers 31, and between the pair of feed rollers 31 and a guide arm 20 (to be described below), respectively, to support the recording paper being fed.

The guide arm 20 is swingably disposed at a position toward which the recording paper is further fed from the pair of the feed rollers 31 (on the right side in FIG. 1).

The guide arm 20 includes arc-shaped guide portions 21 and pinch rollers 22, rotatably disposed at the upper end of the guide portions 21, and mounted on a support shaft 13 supported by the right and left chassis side plates 1A (not shown in FIG. 1).

A platen roller 34 is disposed substantially above the guide arm 20.

The platen roller 34 has an outer periphery comprising an elastic member having a predetermined elasticity (e.g., rubber or the like) and rotatably supported at the opposite ends thereof by the chassis side plates 1A (not shown in FIG. 1). Further, the platen roller 34 is coupled with the platen roller drive motor 34M, by which the above pair of feed rollers 31 are driven, through a rotational drive force transmission line having a friction clutch disposed midway thereof. The platen roller 34 can be driven forward and backward in rotation by the platen roller drive motor 34M. The friction clutch is arranged such that when a torque greater than a predetermined value is imposed thereon, it runs in an idle state.

An operation lever 33 is swingably supported by the chassis side plates 1A through a shaft 14 on the right side of the guide arm 20 in FIG. 1.

The operation arm 33 has a predetermined width in the width direction of the imaging device 1 and a roller-shaped cam follower 33A is rotatably disposed at the upper end of each of the opposite ends in the width direction of the operation arm 33.

A roller press cam 42, fixed to a cam shaft 43, is disposed substantially above the operation arm 33 at the position corresponding to each of the cam followers 33A.

The cam shaft 43 is supported by the chassis side plates 1A (not shown in FIG. 1) at the opposite ends thereof. Further, the cam shaft 43, is coupled with a cam shaft drive motor 43M (shown in the control block diagram of FIGS. 5 and 4; not shown in FIG. 1) and driven in rotation by the motor 43M. The cam shaft drive motor 43M is controlled by the control unit 5. Note that a head operation cam 41 also is provided with the cam shaft 43.

The lower end of the guide arm 20 is connected to the lower end of the operation arm 33 through a spring 32. With this arrangement, the guide arm 20 is swingingly urged counterclockwise, and the operation arm 33 is urged clockwise, respectively in FIG. 1, by the elastic return force of the spring 32.

The swing action of the operation arm 33 is regulated by the cam follower 33A thereof, abutted against the outer peripheral cam surface of the roller press cam 42. On the other hand, the swing action of the guide arm 20 is regulated by the pinch rollers 22, at the upper end thereof, abutted against the horizontal side portion of the platen roller 34. The guide arm 20 is substantially in a vertical state when the pinch rollers 22 are abutted against the platen roller 34, and the lower end of each of the guide portions 21 is located within a feed path of the recording paper fed by the pair of feed rollers 31.

Then, as the outer peripheral cam surface of the cam 42, against which the cam follower 33A is abutted, is dislocated by the rotation of the cam shaft 43 (the rotation of the roller press cam 42), the operation arm 33 is swung and a deformation amount of the spring 32 is changed by the swing action of the operation arm 33, whereby a force for pressing the pinch rollers 22 against the platen roller 34 is changed.

Recording paper support plates 36 are disposed above the recording paper guide plates 35, recording paper introduction roller 11 and pair of feed rollers 31, substantially in parallel therewith, at a predetermined distance from them. A recording paper retraction path regulation member 37 comprising an elastic member, is attached to the end of the recording paper support plate 36, confronting the guide portions 21 of the guide arm 20. The recording paper retraction path regulation member 37 obliquely upwardly faces the guide portions 21, with the extreme end thereof abutted against the guide portions 21.

The thermal transfer head 50 is disposed above the platen roller 34 and includes a thermal head array 51 extending over the width direction of the recording paper and supported by a head frame 52.

The thermal transfer head 50 is swingably supported by the chassis side plates 1A through a support shaft 53 substantially at the center in the right and left directions of the head frame 52 in FIG. 1. Further, the thermal transfer head 50 is swingingly urged counterclockwise in FIG. 1, by a helix spring wound around the support shaft 53.

A cam follower 54 is mounted to each of the opposite ends in the width direction of the head frame 52 on the side opposite to the thermal head array 51 with respect to the support shaft 53.

The swing action of the thermal transfer head 50 is regulated by the cam follower 54, abutted against the outer peripheral cam surface of the head operation cam 41, fixed to the position corresponding to the above cam shaft 43. With this arrangement, the thermal transfer head 50 is swung following the dislocation of the outer peripheral cam surface of the head operation cam 41, due to the rotation thereof (i.e., the rotation of the cam shaft 43).

The outer peripheral cam surface of the head operation cam 41 is formed in three stages each having a different radius in a predetermined angular range. Thus, the thermal transfer head 50 is swung at three stages of different angles by cam follower 54 which abuts against and follows the cam surfaces having the different outside diameters.

More specifically, when the cam follower 54 abuts against the cam surface having the largest diameter, the thermal transfer head 50 is located at an image transfer position, wherein the thermal head array 51 is pressed against the upper portion of the platen roller 34 by a predetermined press force. When the cam follower 54 abuts against the cam surface having the intermediate diameter, the thermal head array 51 is located slightly above the platen roller 34, and the thermal transfer head 50 is at a paper feed location, wherein a gap is defined between the outer periphery of the platen roller 34 and the thermal head array 51. When the cam follower 54 abuts against the cam surface having the smallest diameter, the thermal transfer head 50 is greatly swung, and located at a retracting position where the thermal head array 51 is greatly spaced apart from the platen roller 34.

A supply side ink ribbon reel 65 is disposed below the thermal transfer head 50 and a winding side ink ribbon reel 66 is disposed substantially symmetrically to the supply side ink ribbon 65 with respect to the platen roller 34.

Although described later in detail, these supply side and winding side ink ribbons 65 and 66 are integrally formed as an ink ribbon cassette, and can be mounted to and dismounted from the chassis of the imaging device 1, although not shown in the figure.

The ink ribbon 68 includes a plurality of sets of different color ribbons connected sequentially, and is wound around the supply side ink ribbon reel 65. Each set of the ribbons is used for transferring colors to a single paper (one page).

The winding side ink ribbon reel 66 is coupled with an ink ribbon winding drive motor 66M (shown in the control block diagram of FIGS. 5 and 4; not shown in FIG. 1) and driven in rotation by the motor 66M. The ink ribbon winding drive motor 66M is controlled by the control unit 5.

When the winding side ink ribbon reel 66 is rotated by the ink ribbon winding drive motor 66M, the ink ribbon reel 66 winds up the ink ribbon 68 wound around the supply side ink ribbon reel 65.

When the thermal transfer head 50 is at the image transfer position for the formation of an image, the ink ribbon 68 is placed on the recording paper and held between the platen roller 34 and the thermal head array 51 (the recording paper is located on the platen roller 34 side and the ink ribbon 68 is located on the thermal head array 51 side). The ink ribbon 68 is wound from the supply side ink ribbon 65 to the winding side ink ribbon 66 in synchronously with the movement of the recording paper.

Guiding shafts 90 are horizontally disposed in the forward and backward directions (right and left directions in FIG. 1) on the left side (in FIG. 1) of the platen roller 34 and thermal transfer head 50 and supported by chassis side plates 1A. The guide shafts 90 are disposed on the right and left sides in the width direction of the imaging device 1.

A clamper 70 is supported by the guide shafts 90, so that it can be slidingly moved along the guide shafts 90.

Although described later in detail, the clamper 70 is provided with a pair of support rollers 80 including of a lower roller 81 and upper metal roller 82. The lower roller 81 has a surface on which a rubber layer of a predetermined thickness is formed and the upper roller 82 has a smooth surface and is disposed on the lower roller 81 and pressed thereagainst.

The clamper 70 is coupled with a predetermined position of a movement drive belt (to be described later in detail) having a track parallel with the guide shafts 90 and stretched between pulleys (not shown in FIG. 1). The movement drive belt is driven in rotation by a clamper movement drive motor 70M (shown in the control block diagram of FIGS. 5 and 4; not shown in FIG. 1). The rotation of the movement drive belt causes the clamper 70 to be moved (in the right and left directions in FIG. 1) along the guide shafts 90. With this arrangement, the clamper 70 can be located at a paper feed position located at a right end in FIG. 1 adjacent to the platen roller 34 and thermal transfer head 50, as well as a paper discharge position shown by an imaginary line in FIG. 1 (located at a left side in FIG. 1). The clamper movement drive motor 70M is controlled by the control unit 5.

In FIG. 1, when the clamper 70 is located at the paper feed position and paper discharge position, a gear connected to the lower roller 81 (not shown) is meshed with drive gears (not shown) each provided with the chassis of the imaging device 1. As a result, the lower roller 81 is driven in rotation counterclockwise by a rotation drive force transmitted through the drive gear. That is, when the clamper 70 is located at the paper feed position and paper discharge position, the lower roller 81 can be rotated. The drive gear is driven by a clamper drive motor 80M (shown in the control block diagram of FIGS. 5 and 4; not shown in FIG. 1). The clamper drive motor 80M is controlled by the control unit 5.

A pair of paper discharge rollers 38 includes rollers located in a vertical direction and pressed against each other, is disposed on the left side (in FIG. 1) of the clamper 70, located at the paper discharge position. The pair of paper discharge rollers 38 are rotatably supported, at the opposite ends thereof, by the chassis side plates 1A (not shown in FIG. 1) of the imaging device 1. The pair of paper discharge rollers 38 are driven in rotation by the aforesaid clamper drive motor 80M.

The imaging device 1 arranged as described above is controlled by the control unit 5 and forms an image by the following operation.

Figure 6:
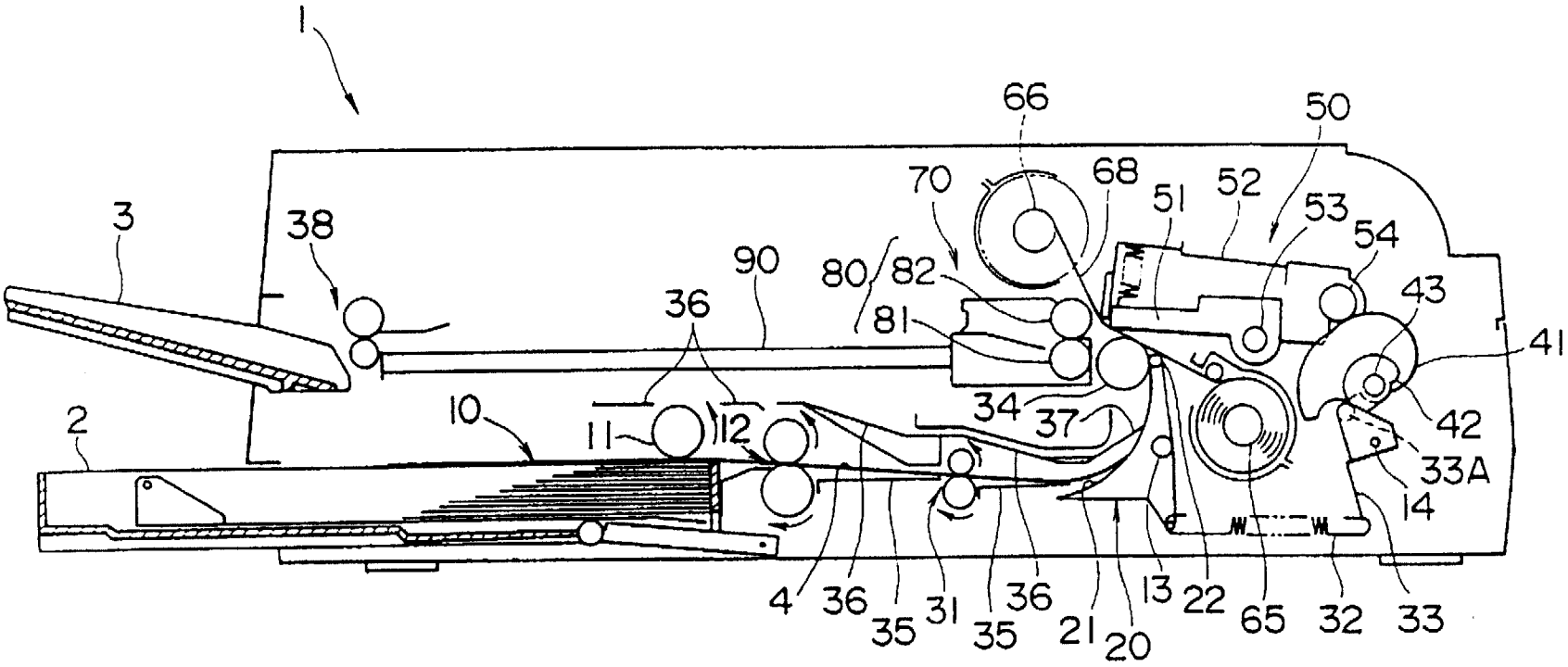
FIG. 6 is a diagram of a schematic arrangement of the imaging device when a recording paper is introduced.

First, when the cam shaft 43 is rotated, the head operation cam 41 and roller press cam 42 are rotated. As a result, the thermal head array 51, of the thermal transfer head 50 shown in FIG. 1, is moved from the wait state, in which the thermal head array 51 is greatly spaced apart from the platen roller 34, to the paper feed position in which the thermal head array 51 is located slightly above the image transfer position. The recording paper 4, accommodated in the recording paper cassette 2, is introduced into the imaging device 1 by driving the recording paper introduction roller 11, and fed by driving the pair of introduction rollers 12 and pair of feed rollers 31. Note, at this time, the clamper 70 is located at the paper feed position as shown in FIG. 6.

Figure 7:
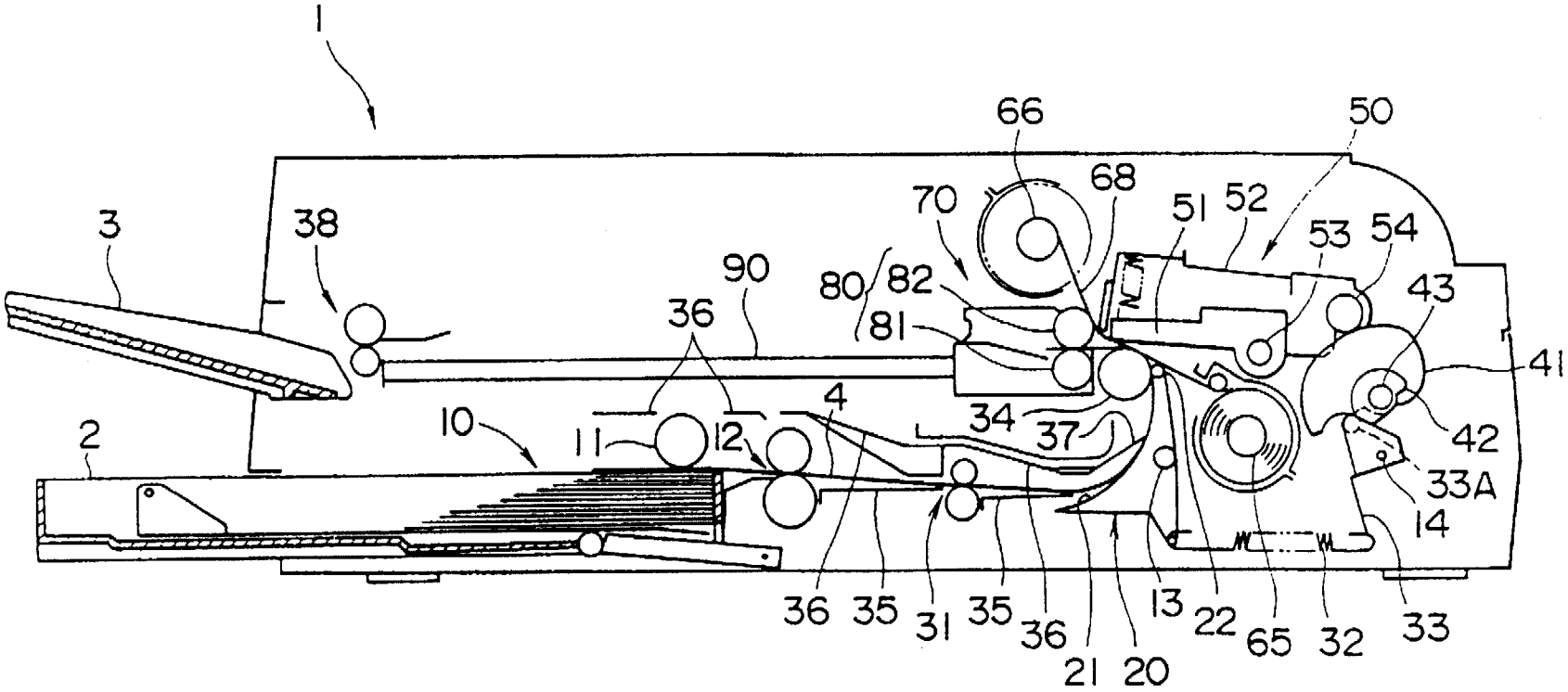
FIG. 7 is a diagram of a schematic arrangement of the imaging device in the state that a recording paper is held by a clamper.

The recording paper 4 is pushed between the platen roller 34 and the pinch rollers 22 by being bent upward while deforming the recording paper retraction path regulation member 37, in such a manner that the extreme end of the recording paper 4 is guided by the arcshaped guide portions 21 of the guide arm 20. Then, the recording paper 4 is transported to the thermal transfer head 50, by the rotation of the platen roller 34 (rotating counterclockwise in FIG. 7) and directed to the pressure contact portion of the upper and lower rollers 82 and 81 of the pair of support rollers 80 of the clamper 70, located at the paper feed position. When the extreme end of the recording paper 4 reaches the pressure contact portion of the upper and lower rollers 82 and 81, the lower roller 81 is rotated (counterclockwise in FIG. 7) to pull the recording paper 4 between the pair of support rollers 80. When a predetermined amount of the recording paper 4 is pulled, the rotation of the lower roller 81 is stopped and thus the extreme end of the recording paper 4 is held by the pair of support rollers 80 of the clamper 70 as shown in FIG. 7.

Figure 8:
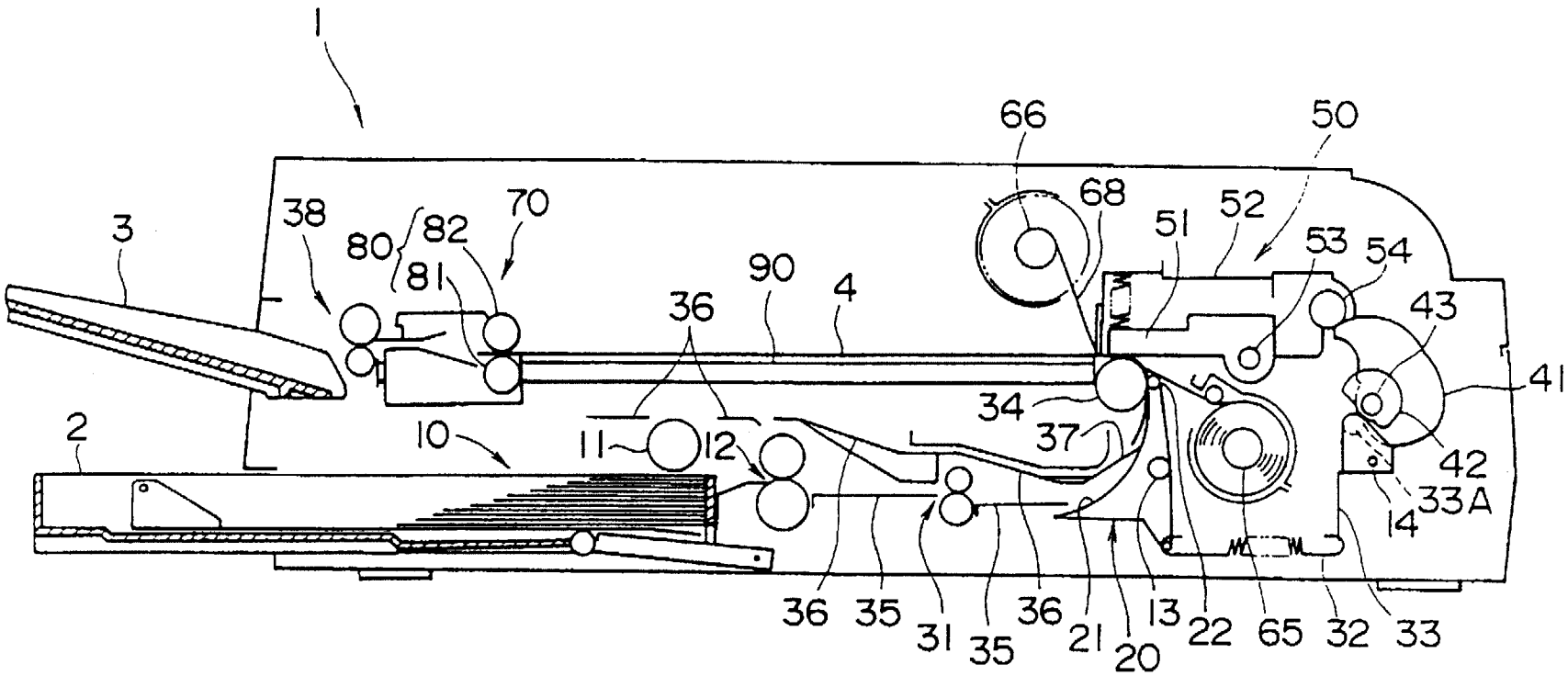
FIG. 8 is a diagram of a schematic arrangement of the imaging device after the completion of an image transfer process.

Thereafter, the thermal transfer head 50 is moved to the image transfer position by the rotation of the head operation cam 41, the recording paper 4 is moved by the movement of the clamper 70 to the left side as shown in FIG. 8, and the ink ribbon 68 is wound synchronously with the movement of the recording paper 4. Then, an image is formed (transferred) on the recording paper 4 by the thermal head array 51.

Since the present embodiment is a color imaging device, the image transfer process is executed four times for magneta, cyan, yellow and black, as described above. More specifically, upon completion of the first transfer process, the clamper 70 (and the recording paper 4) is returned from the paper discharge position, shown in FIG. 8, to the paper feed position shown in FIG. 9. Then, the clamper 70 is moved to the left side in FIG. 9 (thereby moving the recording paper 4) and then the next transfer process is executed, and thereafter this process is repeated a predetermined number of times.

Figure 9:
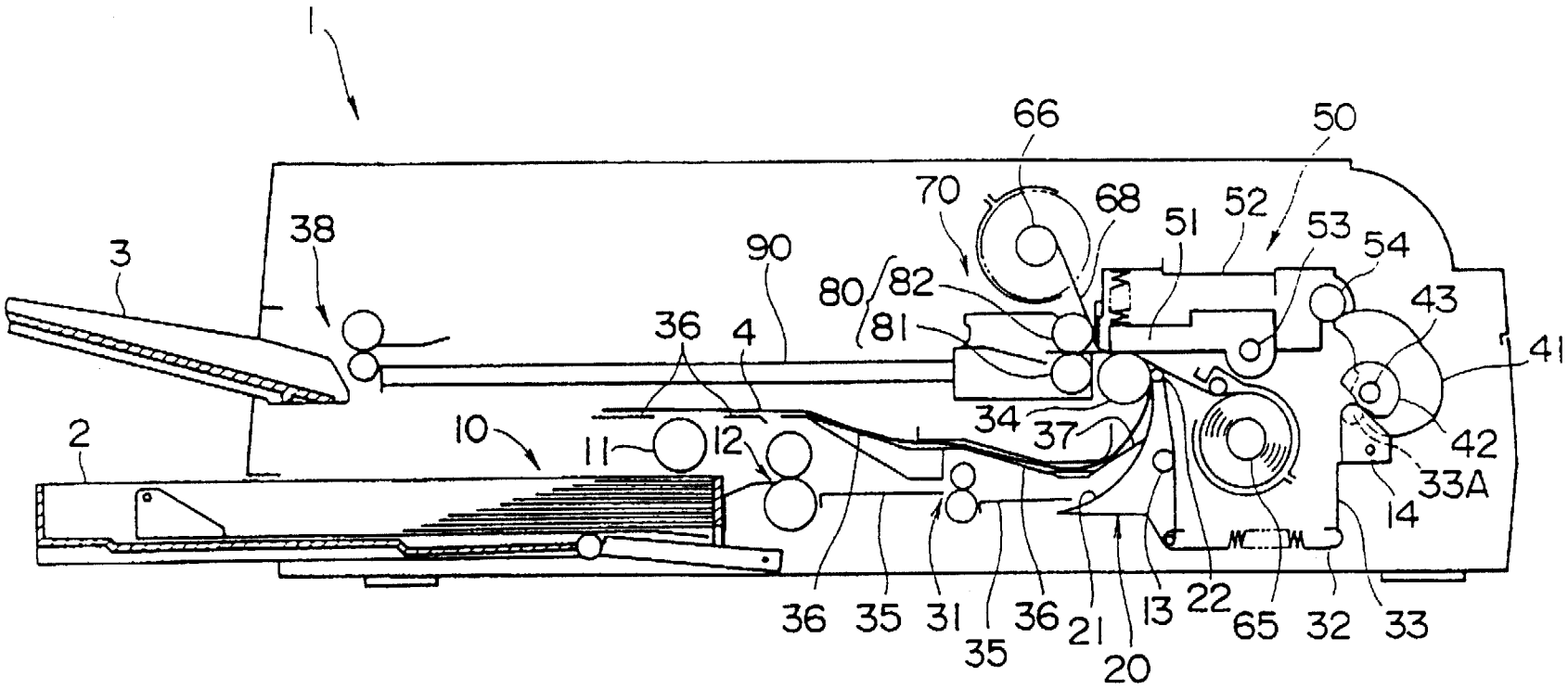
FIG. 9 is a diagram showing a schematic arrangement of the imaging device in the state that a recording paper is returned to a recording paper feed position to repeat an image transfer process.

When the recording paper 4 is returned to the paper feed position, the platen roller 34 is rotated in a direction opposite to that when the recording paper 4 is held by the clamper 70 (when the recording paper 4 is fed), i.e., clockwise in FIG. 8. When the clamper 70 is returned to the paper feed position, the retraction path of the rear end of the recording paper 4 is changed by the recording paper retraction path regulation member 37, thus the recording paper 4 is supplied onto the recording paper support plate 36 as shown in FIG. 9, instead of being returned to the paper feed unit 10.

Figure 10:
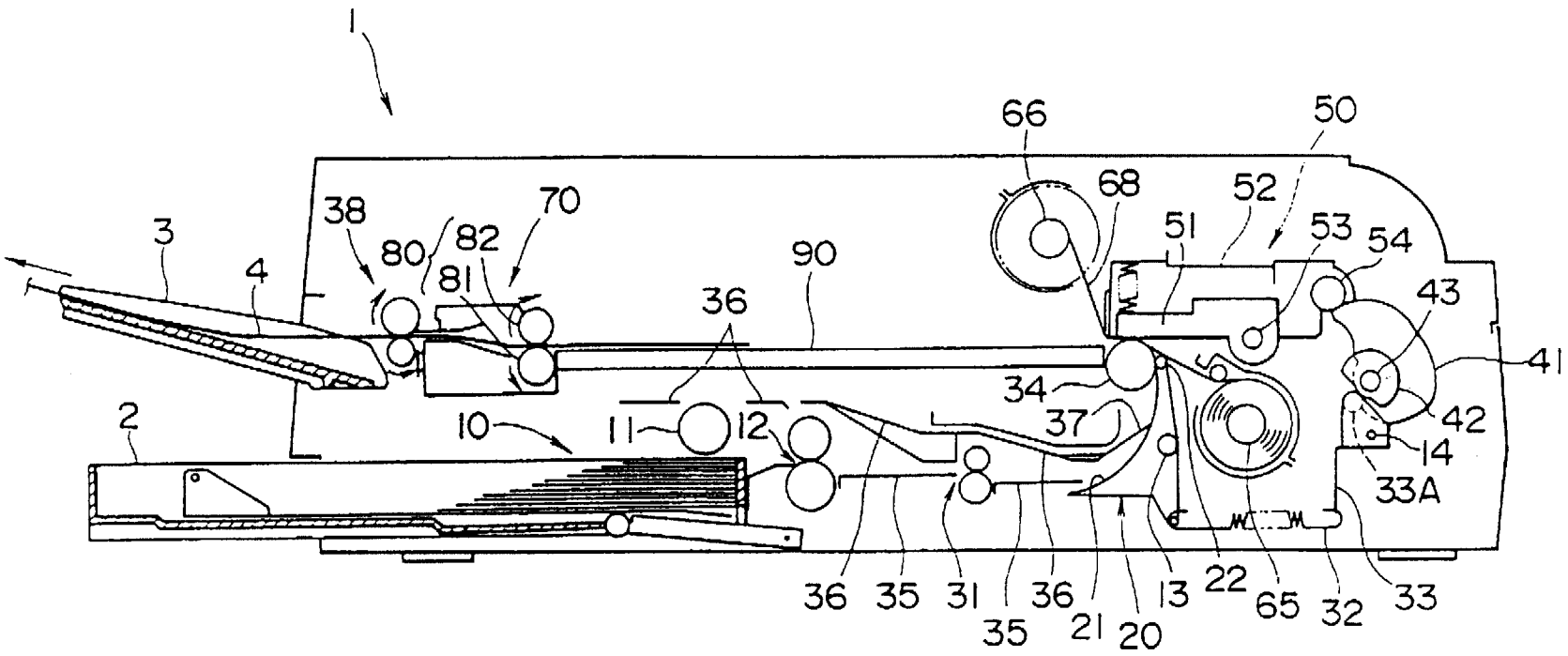
FIG. 10 is a diagram of a schematic arrangement of the imaging device in a paper discharge state after a plurality of times of repeats of an image transfer process.

When the image transfer process is repeated the predetermined number of times (i.e., when all the colors are transferred), the clamper 70 is located at the paper discharge position. At this time, the lower roller 81 of the clamper 70 is rotated counterclockwise (as shown in FIG. 10), so that the recording paper 4 held by the pair of support rollers 80, is fed to the paper discharge side (to the left side in FIG. 10).

The recording paper 4, supplied from the clamper 70, is transported by the pair of paper discharge rollers 38 and discharged onto the paper discharge tray 3.

Next, the arrangement of the respective units will be described in detail below.

Figure 11:
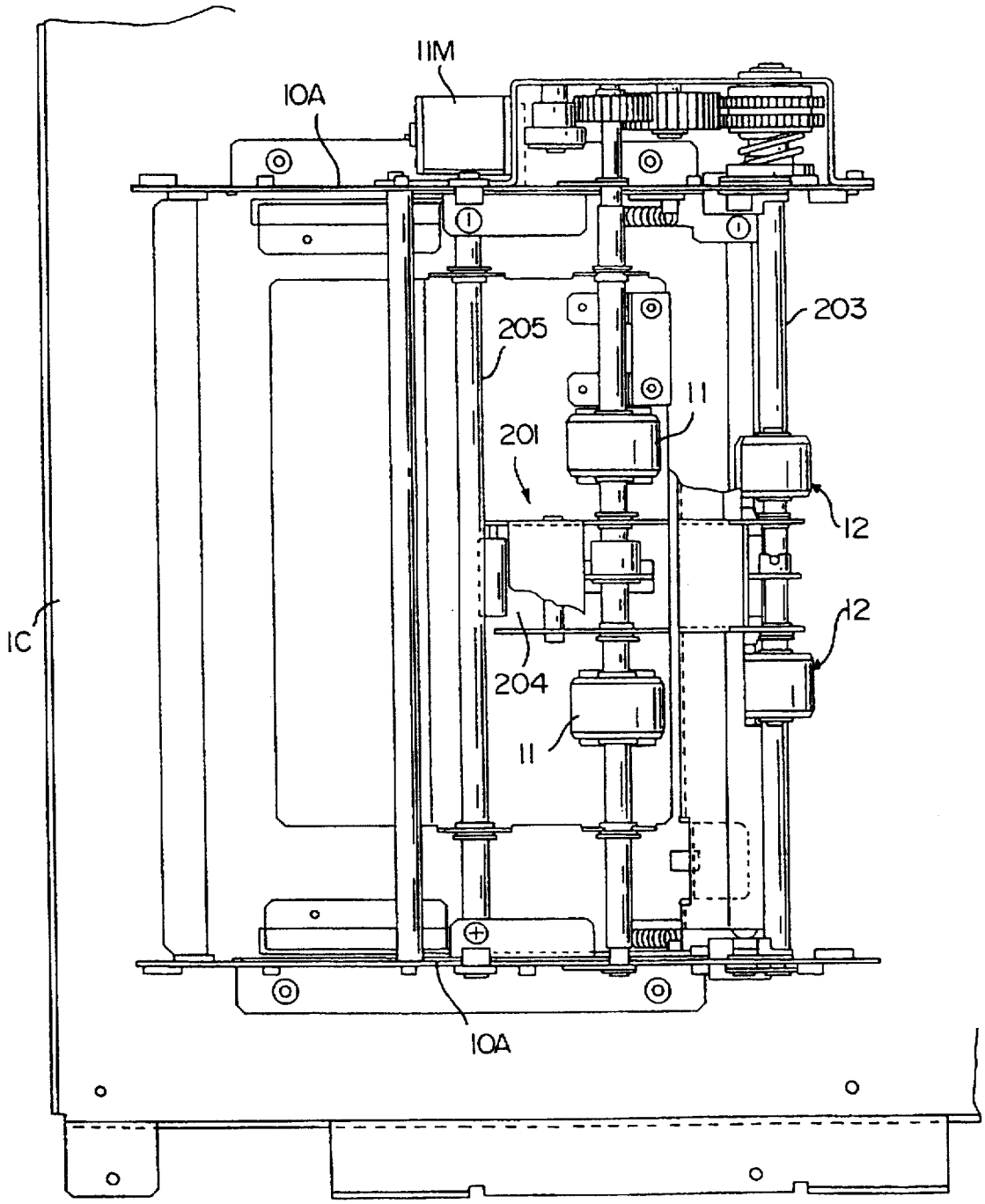
FIG. 11 is a plan view of a paper feed unit.

As shown in the plan view of FIG. 11, the paper feed unit 10 is arranged such that a pair of paper feed unit side plates 10A extend parallel to each other on the upper surface of a base chassis 1C in the forward and backward directions of the imaging device 1. The pair of paper feed unit side plates 10A are spaced apart from each other by a distance which allows the recording paper cassette 2 to be inserted therebetween. The recording paper introduction roller 11, and the pair of introduction rollers 12, are supported by the paper feed unit side plates 10A.

When the recording paper cassette 2 is inserted into a predetermined position between the side plates 10A, the recording paper introduction roller 11 is disposed above the front end of the recording paper cassette 2 and the pair of introduction rollers 12 is disposed in front of the recording paper cassette 2, in the vicinity thereof.

The recording paper introduction roller 11 and the upper roller of the pair of introduction rollers 12, are coupled with the introduction roller drive motor 11M, through a gear train, and driven in rotation by the motor 11M.

Figure 12:
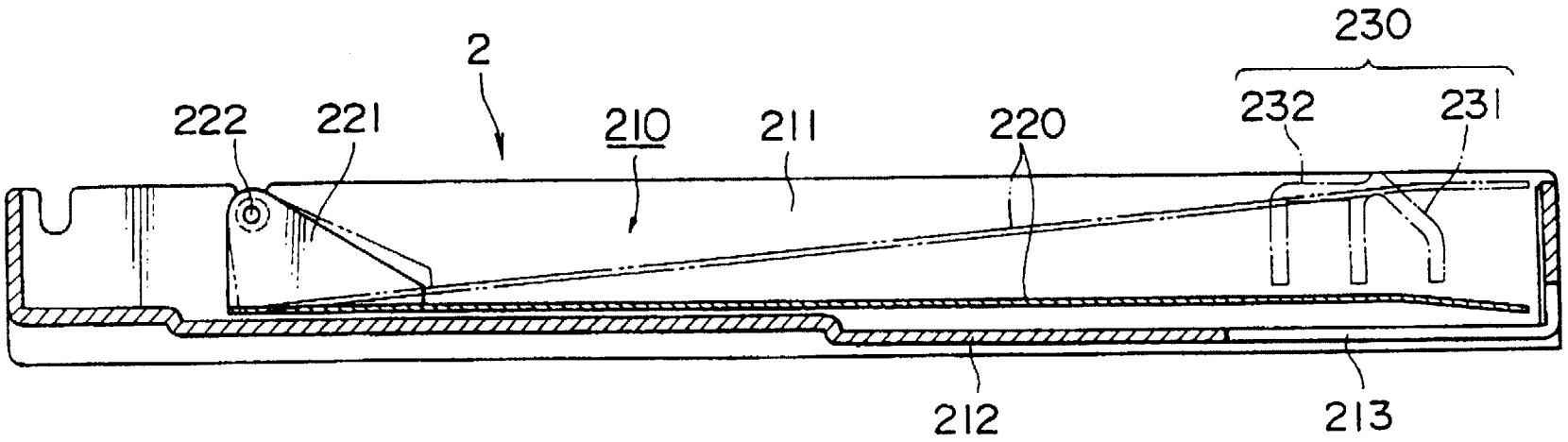
FIG. 12 is a longitudinal cross sectional view of a recording paper cassette.
Figure 13:
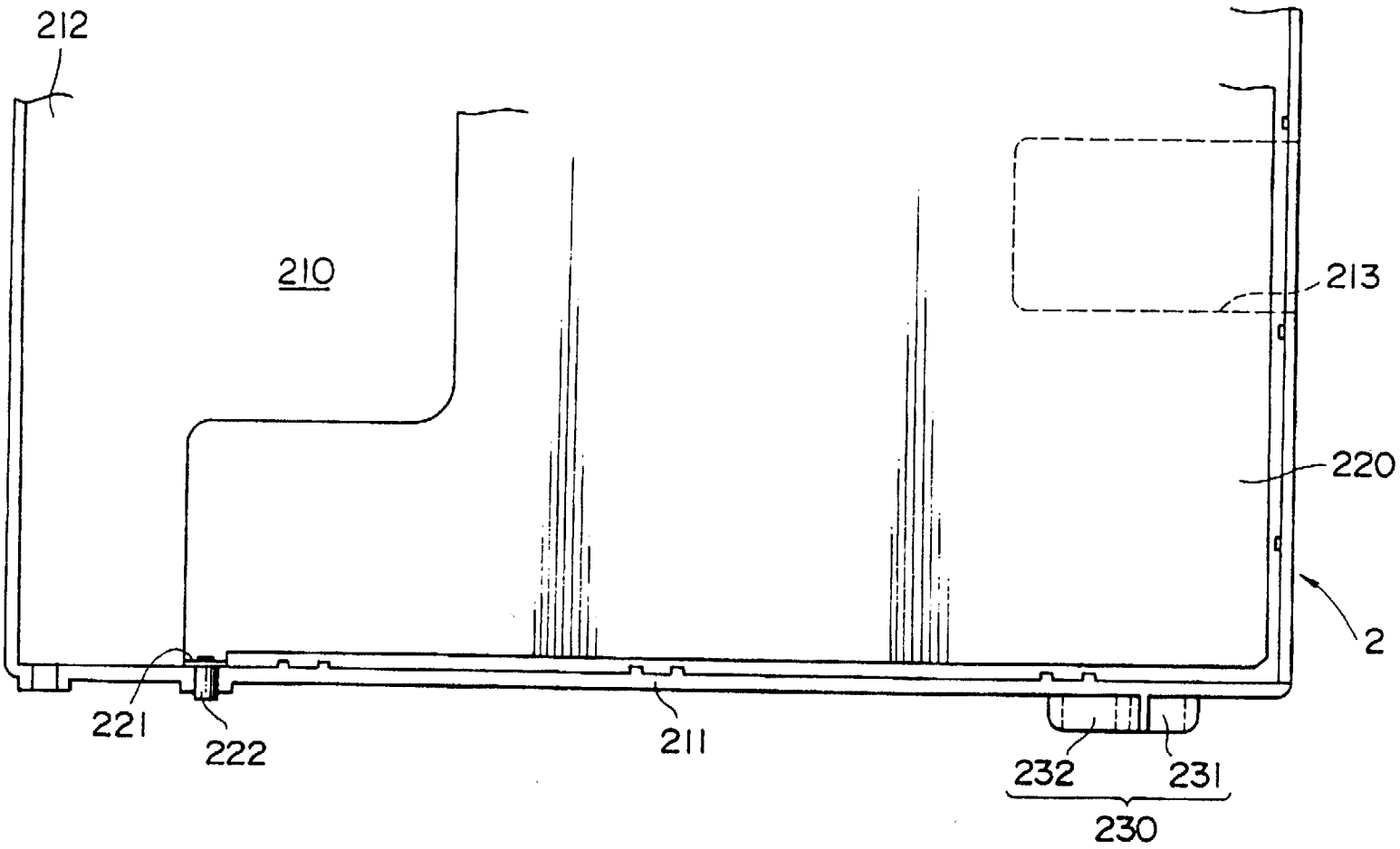
FIG. 13 is a partially cross sectional view of the recording paper cassette.

As shown in the longitudinal cross sectional view of FIG. 12 and the partial plan view of FIG. 13, the recording paper cassette 2 includes a thin cubeshaped vessel 210 having a rectangular flat shape opened upward and capable of accommodating recording papers and a recording paper holding plate 220 provided in the vessel 210.

The recording paper holding plate 220 has a configuration substantially corresponding to the inner surface of the recording paper cassette 2. Vertically standing members 221, with bent portions disposed on the right and left sides at the rear end of the recording paper holding plate 220, are supported by the side plates 211 of the vessel 210 through pins 222 so that the front ends of the members can be swung upward and downward, although only one of the members 221 is shown in FIG. 13.

Further, an operation hole 213 is defined in the center of the front end of the bottom plate 212 of the vessel 210. Furthermore, operation cams 230 are projected from the outer surfaces of the front ends of the right and left side plates 211, although only one of them is shown in FIG. 13.

The operation cam 230 is formed as a cam surface 231 with the upper front end thereof declining toward a front end. The portion of the operation cam 230 located behind the point where the cam surface 231 intersects the upper surface of the side plate 211 is formed as a horizontal portion 232 which is slightly lower than the upper surface of the side plate 211.

Figure 14:
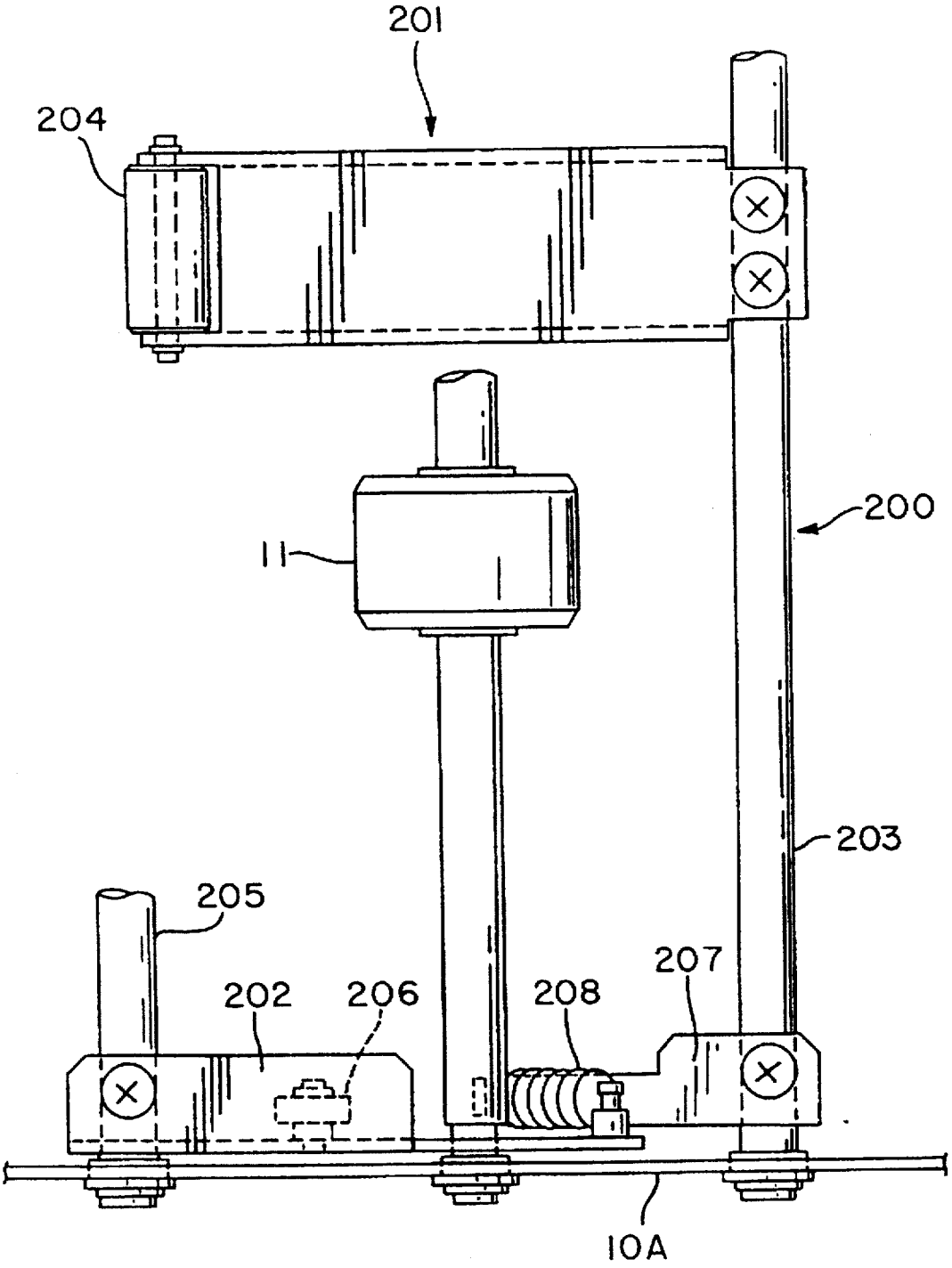
FIG. 14 is a plan view of a recording paper press mechanism provided with the paper feed unit.
Figure 15:
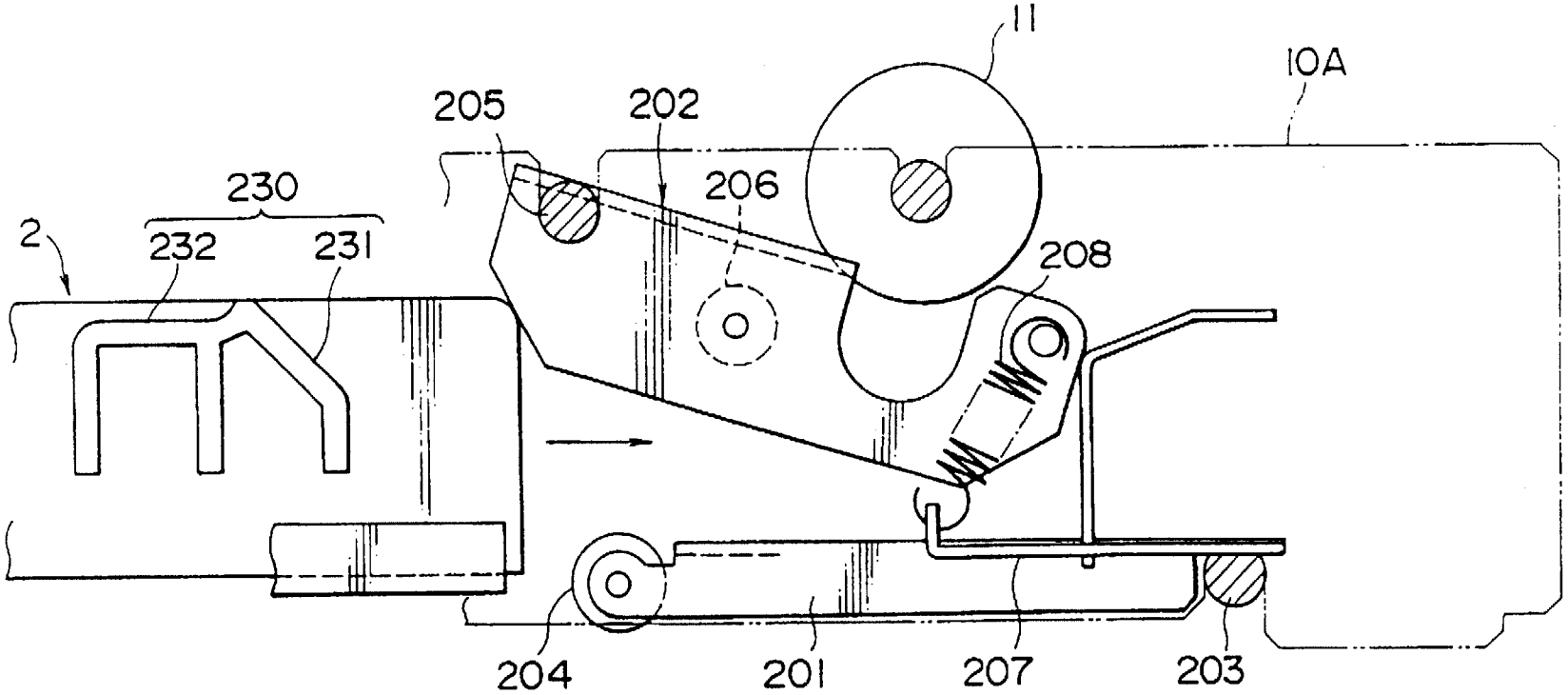
FIG. 15 is a side view of the recording paper press mechanism.

The paper feed unit 10 is provided with a recording paper press mechanism 200 as shown in the plan view of FIG. 14 and side view of FIG. 15.

The recording paper press mechanism 200 includes a holding plate operation arm 201 and operation levers 202. The holding plate operation arm 201 is located at a position corresponding to the center of the extreme end of the recording paper cassette 2 when it is inserted into the paper feed unit 10. The operation levers 202 are mounted to the inner surfaces of the paper feed unit side plates 10A, although only one of them is shown in FIG. 14.

The holding plate operation arm 201 is fixed at the front end thereof to a shaft 203, rotatably supported by the paper feed unit side plates 10A and extending in the width direction of the imaging device 1, and can be swung by the rotation of the shaft 203. A press roller 204 is rotatably mounted to the rear end (on the swing side) of the holding plate operation arm 201 in parallel with the shaft 203.

The rear end of the operation lever 202 is fixed to a swing shaft 205 rotatably supported by the paper feed unit side plates 10A at a position behind the shaft 203 (on the left side in FIG. 15), and the front end side of the operation lever 202 can be swung by the rotation of the swing shaft 205. A cam follower 206 is rotatably mounted to the inside of the operation lever 202 substantially at the center in the longitudinal direction thereof. The can follower 206 is located at a position interfering with the operation cam 230 of the inserted recording paper cassette 2.

The front end of the operation lever 202 is coupled with the rear end of an arm 207 through a spring 208. The front end of the arm 207 is fixed to the shaft 203.

As shown in FIG. 15, in the free state (i.e., when the recording paper cassette 2 is not inserted), the front end of the operation lever 202 is swung downward and the cam follower 206 is located at a position toward which the cam surface 231 of the operation cam 230 of the recording paper cassette 2 to be inserted faces horizontally. The holding plate operation arm 201 is substantially horizontally set.

Figure 16:
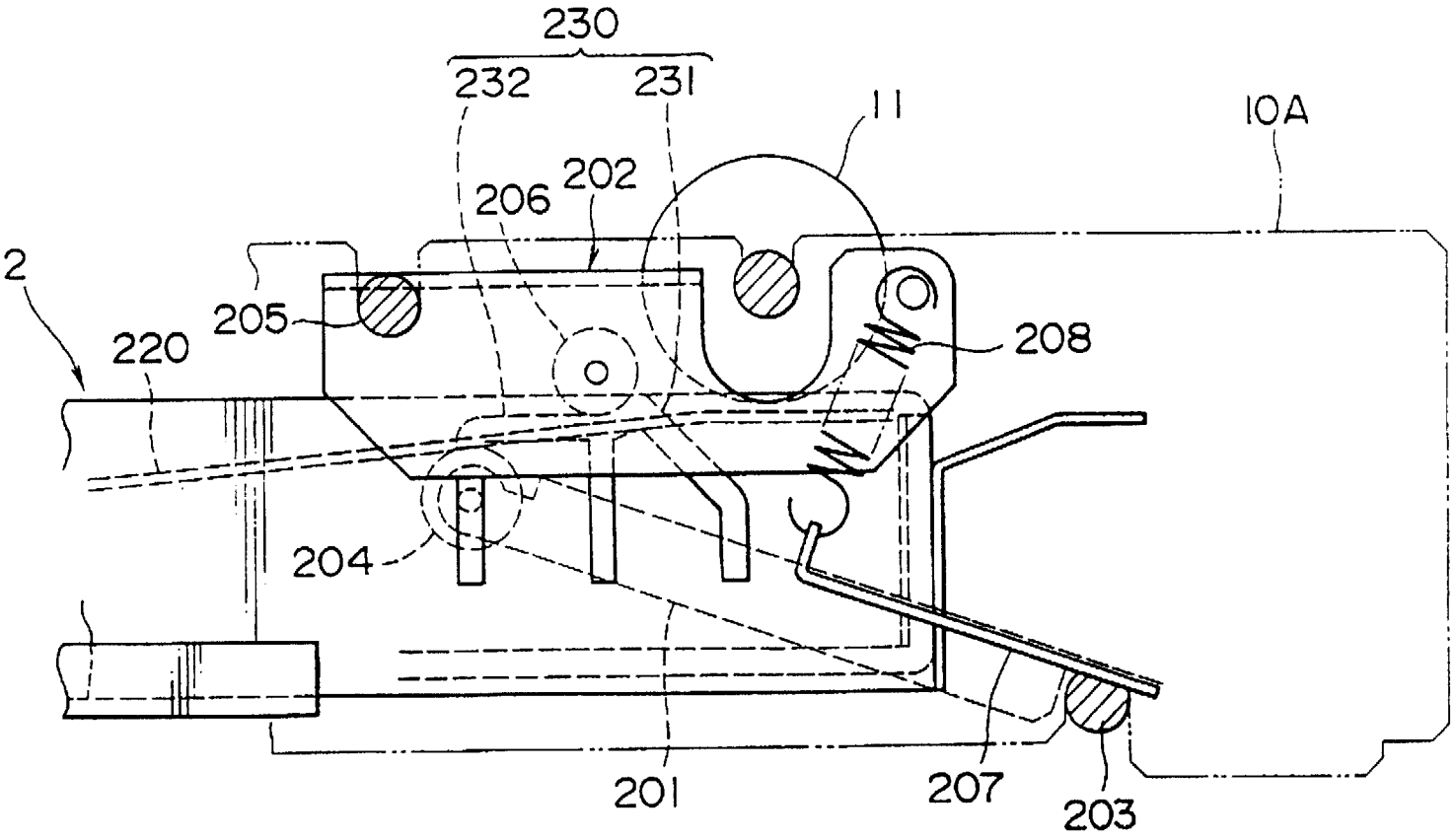
FIG. 16 is a diagram showing the state that the recording paper cassette is mounted in FIG. 15.

Upon insertion of the recording paper cassette 2, the operation cam 230 of the recording paper cassette 2 abuts against the cam follower 206 to thereby push the cam follower 206 upward along the cam surface 231. As a result, the operation lever 202 is swung, so that the front end thereof moves upward, whereby the shaft 203 is rotated through the spring 208 and arm 207 to swing the holding plate operation arm 201 so that the rear end thereof moves upward. Consequently, as shown in FIG. 16, the press roller 204 pushes the extreme end lower surface of the recording paper holding plate 220 upward through the operation hole 213 defined in the bottom plate 212 of the vessel 210 of the recording paper cassette 2. The swing action of the holding plate operation arm 201 is regulated in such a manner that the front upper surface of the recording papers (not shown in FIG. 16) accumulated on the recording paper holding plate 220 is abutted against the recording paper introduction roller 11. With this arrangement, the front upper surface of the recording papers is pressed and urged against the recording paper introduction roller 11 by the elastic return force of the spring 208.

When the recording paper cassette 2 is inserted into a predetermined position, the cam follower 206 reaches the horizontal portion 232 of the operation cam 230 and the cam follower 206 is stable in this state (the state shown in FIG. 16).

Note that the spring 208 is set such that when no recording paper is accommodated in the recording paper cassette 2, the front end of the recording paper holding plate 220 can be pressed and urged against the recording paper introduction roller 11 with a predetermined press force, as shown in FIG. 16. When recording papers are accommodated in the recording paper cassette 2, a swing amount of the holding plate operation arm 201 is absorbed by the elastic deformation of the spring 208, although this amount is different depending upon the amount (thickness) of the recording papers.

As described above, when the recording paper cassette 2 is inserted into the predetermined position of the paper feed unit 10, the front upper surface of the recording papers accommodated in the recording paper cassette 2 is pressed and urged against the recording paper introduction roller 11. In this state, the recording paper introduction roller 11 is rotated counterclockwise in FIG. 16, and thus the recording paper 4, accommodated in the recording paper cassette 2, is fed into the imaging device therefrom.

With the above arrangement, the recording papers, accommodated in the recording paper cassette 2, can be pressed against the recording paper introduction roller 11 by the recording paper press mechanism 200, provided with the imaging device in association with the insertion of the recording paper cassette 2, into the paper feed unit 10. Therefore, an additional means for pressing recording papers accommodated in the recording paper cassette 2 against the recording paper introduction roller 11 is not necessary and thus the recording paper cassette 2 can be simply arranged.

Next, an arrangement of the guide arm 20, structure for pressing the pinch rollers 22 against the platen roller 34, structure for swinging the thermal transfer head 50 and control of the press and swing action of these units when an image is formed will be described.

Figure 17:
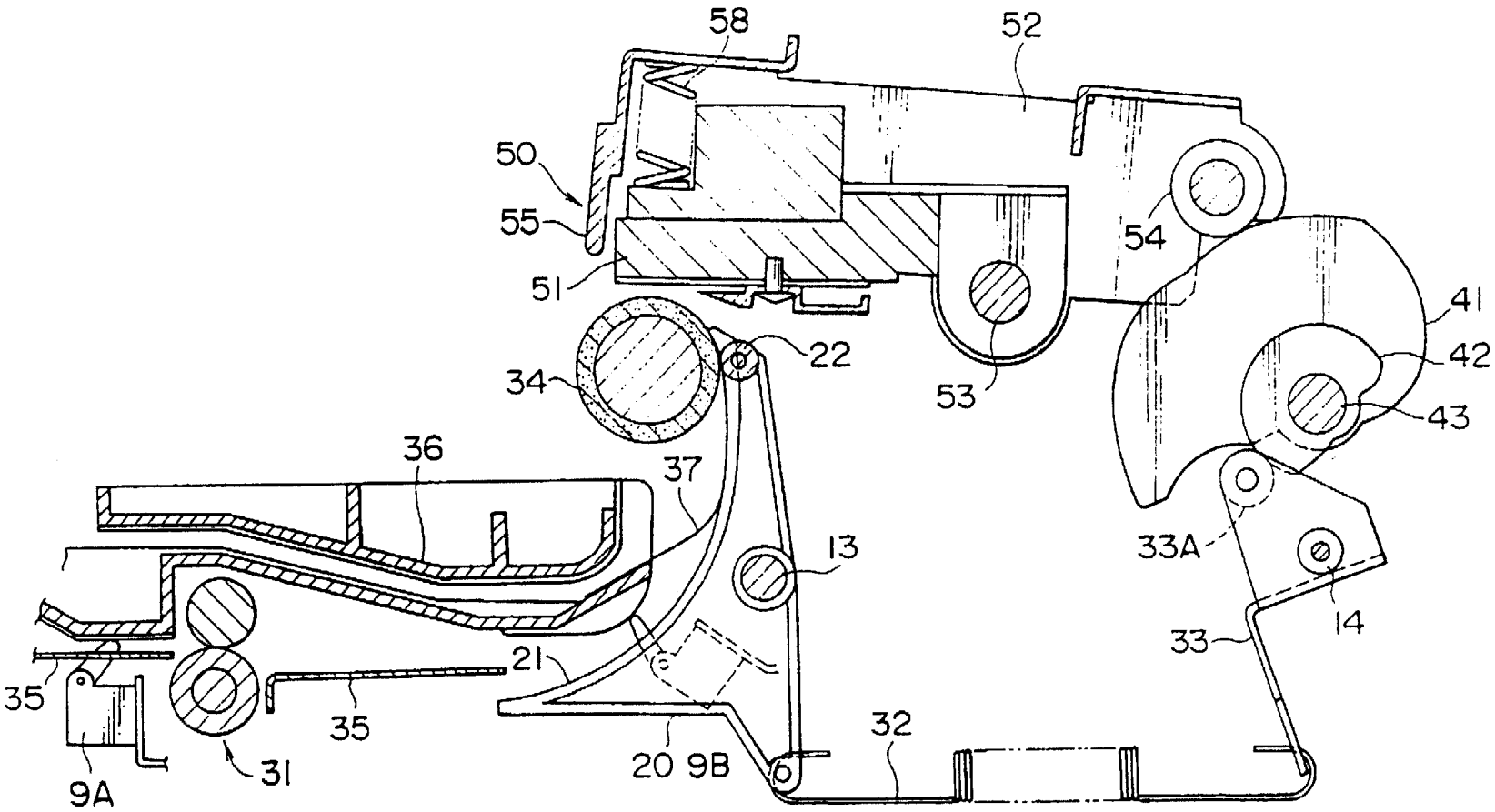
FIG. 17 is a partially enlarged side view of a guide arm portion showing a thermal transfer head located at a paper feed position.
Figure 18:
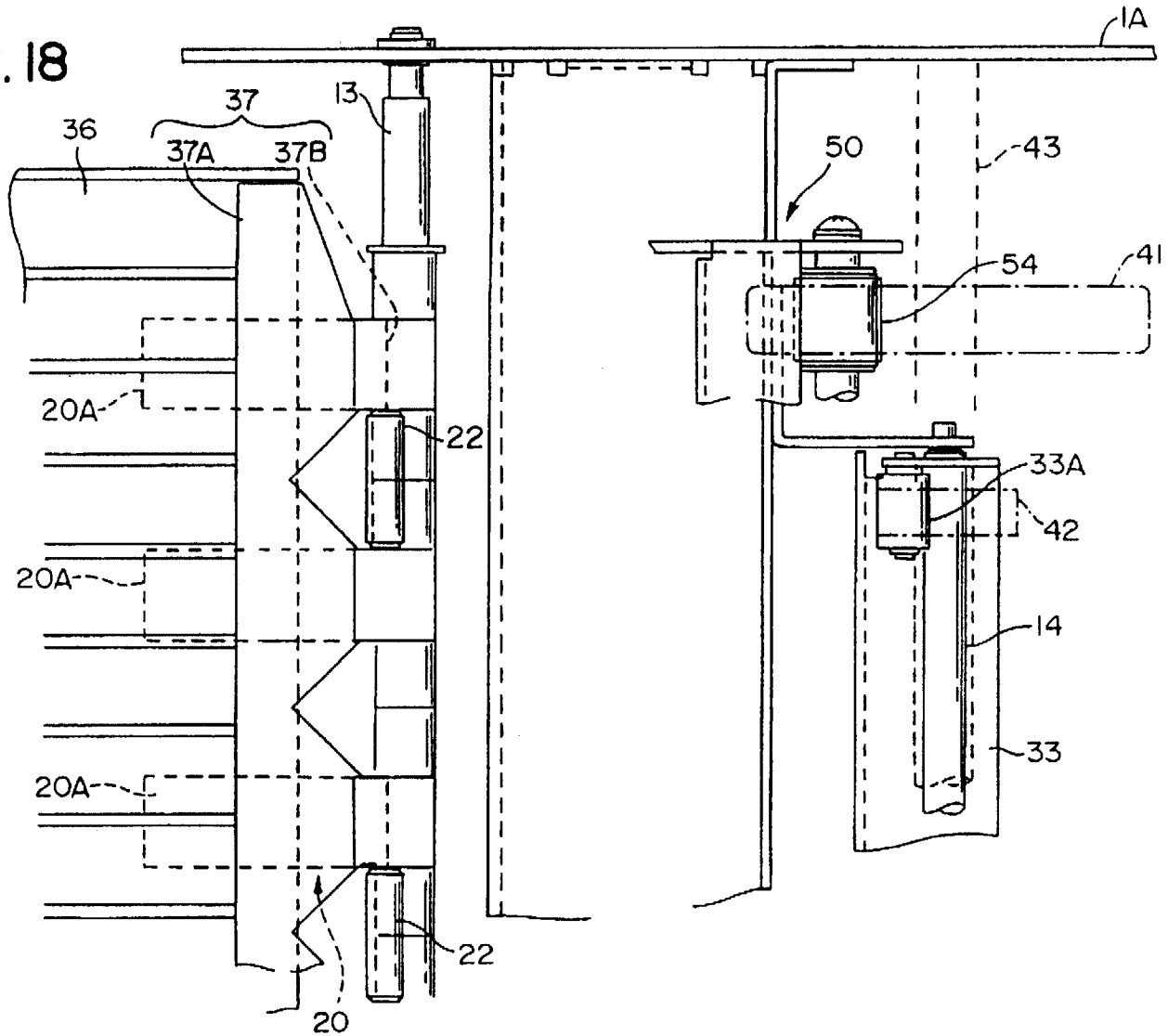
FIG. 18 is a plan view of FIG. 17 from which the thermal transfer head and a platen roller are removed.

As shown in the partially enlarged view of the guide arm 20 in FIG. 17, and the plan view of FIG. 18 showing the state where the thermal transfer head 50 is removed from FIG. 17, the guide arm 20 includes a plurality of unit blocks 20A, of a predetermined thickness, each provided with an arc-shaped guide portion 21. The plurality of unit blocks 20A are connected along the width direction of the imaging device 1, in parallel therewith, at predetermined intervals, by the support shaft 13. Each of the pinch rollers 22 is rotatably disposed in an arbitrary space between the extreme ends of the guide portions 21 of the unit blocks 20A. More specifically, a plurality of the guide portions 21, each having a predetermined width, are disposed with a gap defined therebetween, and pinch rollers 22 are disposed between the predetermined guide portions 21.

The lower end of the guide arm 20 is coupled with the lower end of the operation arm 33, swingably mounted to the right side, in FIG. 17, of the guide arm 20 through a pin 14.

The guide arm 20 and operation arm 33 are swung and urged by the elastic return force of the spring 32, respectively.

The guide arm 20 is swung and urged counterclockwise in FIG. 17. The swing action of the guide arm 20 is regulated in such a manner that the pinch rollers 22, disposed at the upper end thereof, are abutted against the side portion of the platen roller 34 in the horizontal direction thereof. On the other hand, the operation arm 33 is swung and urged clockwise in FIG. 17. The swing action of the operation arm 33 is regulated in such a manner that the cam follower 33A, rotatably mounted to the upper end of the operation arm 33, is abutted against the outer peripheral cam surface of the roller press cam 42, fixed to the cam shaft.

More specifically, the pinch rollers 22 mounted to the upper end of the guide arm 20 are pressed and urged against the platen roller 34 the cam follower 33A of the operation arm 33 is pressed and urged against the roller press cam 42, by the elastic return force of the spring 32. When the roller press cam 42 is rotated and the cam follower 33A follows to the dislocation of the cam surface of the roller press cam 42, the operation arm 33 is swung and thus an amount of deformation of the spring 32 is changed. As a result, a force by which the pinch rollers 22 are pressed against the platen roller 34 is changed.

The roller press cam 42 has a large diameter portion and small diameter portion each formed in a predetermined angular range. When the cam follower 33A is abutted against the large diameter portion of the roller press cam 42, the operation arm 33 is swung counterclockwise to thereby increase an amount of deformation of the spring 32. Thus, the pinch rollers 22 are pressed against the platen roller 34 with a strong press force. On the other hand, when the cam follower 33A is abutted against the small diameter portion, the pinch rollers 22 are pressed against the platen roller 34 with a weak press force. More specifically, the press force for pressing the pinch rollers 22 against the platen roller 34 can be changed between relatively strong and weak forces.

Further, the extreme end of the recording paper retraction path regulation member 37 is abutted against the guide portions 21 of the guide arm 20.

As shown in FIG. 18, the recording paper retraction path regulation member 37 comprised an easily elastically deformable synthetic resin thin plate and has contact portions 37B extending from a base portion 37A. Each of the contact portions 37B is formed to a substantially conical frustum shape, with a flat summit portion having a width corresponding to the guide portion 21 of the guide arm 20, and projecting to a portion corresponding to the guide portion 21. The end of the base portion 37A, of the recording paper retraction path regulation member 37, is bonded to the upper surface of the upwardly inclined end of the recording paper support plate 36, at the side thereof, confronting the guide arm 20. Thus, the contact portions 37B, of the recording paper retraction path regulation member 37, are in contact with the guide portions 21 and are slightly elastically deformed.

The thermal transfer head 50 includes the head frame 52, supported by the support shaft 53, at substantially the center thereof, and the thermal head array 51, disposed on the inner side of the head frame 52 and supported by the same support shaft 53. The support shaft 53 is supported by the right and left chassis side plates 1A of the imaging device 1 and disposed in the width direction of the imaging device 1.

The head frame 52 and thermal head array 51 can be relatively swung within the range of a predetermined angle. The thermal head array 51 is swung counterclockwise in FIG. 17, and urged against the head frame 52 by the urging force of a coil spring 58 on the left end in FIG. 17, interposed between the inner surface of the head frame 52 and the upper surface of the thermal head array 51. As shown in FIG. 17, when the thermal head array 51 is spaced apart from the platen roller 34 (when the thermal transfer head 50 is located at the paper feed position and retracting position), a maximum space is provided between the head frame 52 and the thermal head array 51 (between the extreme ends thereof) within the swingable range permitted therebetween.

The roller-shaped cam follower 54 is rotatably mounted to the end of the head frame 52, opposite to the thermal head array 51, with respect to the support shaft 53.

Further, an ink ribbon press member 55 is mounted to the outer surface at the left end of the head frame 52 in FIG. 17.

The head frame 52 is rotated and urged clockwise, in FIG. 17, by helix springs 59 wound around the support shaft 53 at the opposite ends thereof. The swing action of the head frame 52, caused by the helix springs 59, is regulated by the cam follower 54 abutted against the outer peripheral cam surface of the head operation cam 41 fixed to the cam shaft 43. With this arrangement, when the head operation cam 41 is rotated (i.e., when the cam shaft 43 is rotated), the thermal transfer head 50 is swung following to the dislocation of the outer peripheral cam surface of the head operation cam 41, against which the cam follower 54 is abuts.

The head operation cam 41, has an outside diameter (outer peripheral cam surface) formed in three stages, each having a different radius in a predetermined angular range.

Figure 20:
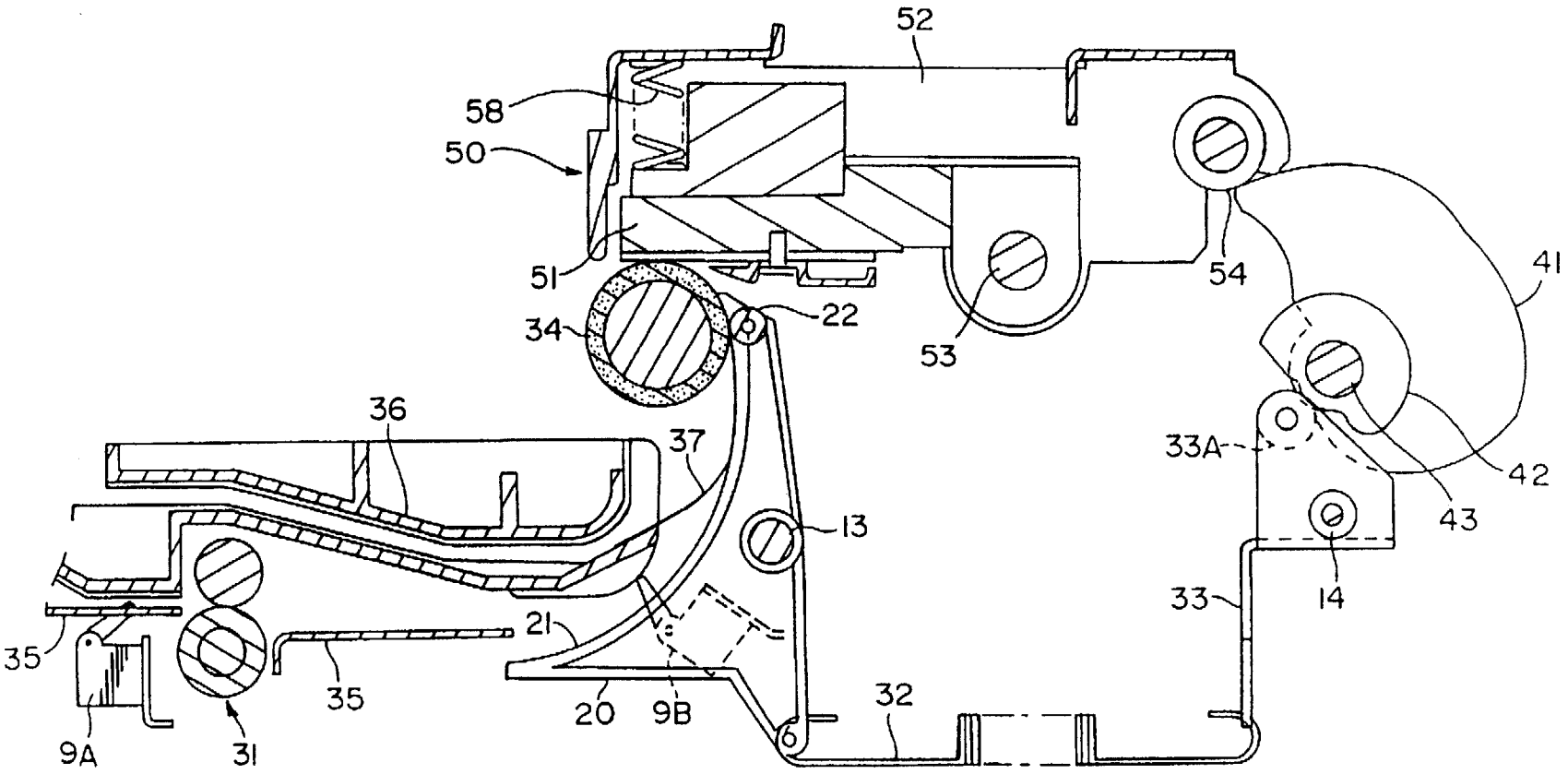
FIG. 20 is a diagram showing the thermal transfer head located at an image transfer position.

As shown in FIG. 20, when the cam follower 54 is abutted against the cam surface with the maximum diameter, the head frame 52 is further swung counterclockwise (in FIG. 20) by a predetermined amount after the thermal head array 51 has been abutted against the upper side of the platen roller 34. Then, the coil spring 58 is elastically deformed to allow the thermal head array 51 to be relatively swung clockwise (in FIG. 20) with respect to the head frame 52. As a result, the thermal head array 51 is located at the image transfer position by being pressed against the platen roller 34 by the urging force of the coil spring 58.

As shown in FIG. 17, when the cam follower 54 is abutted against the cam surface with the intermediate diameter, the thermal head array 51 is located at the paper feed position slightly above the platen roller 34. At this position, there is a clearance of 1–1.5 mm between the thermal head array 51 and the outer periphery of the platen roller 34. The attitude of the thermal transfer head 50, at the paper feed position, is set such that the recording paper 4 advances from the portion where the pinch roller 22 is pressed against the platen roller 34, to the tangential direction of the platen roller 34, because of the rigidity of the recording paper 4; the extreme end of the recording paper 4 comes into contact with the lower surface of the thermal head array 51, and is advanced upwardly of the horizontal tangential line of the platen roller 34, being guided by the thermal head array 51; and then the extreme end of the recording paper 4 is directed to a position between the portion where the lower roller 81 of the clamper 70 is pressed against the upper roller 82 thereof (i.e., the center of rotation of the upper roller 82). Note the clamper 70 is not shown in FIG. 17 but shown in FIG. 26, to be described later.

Figure 19:
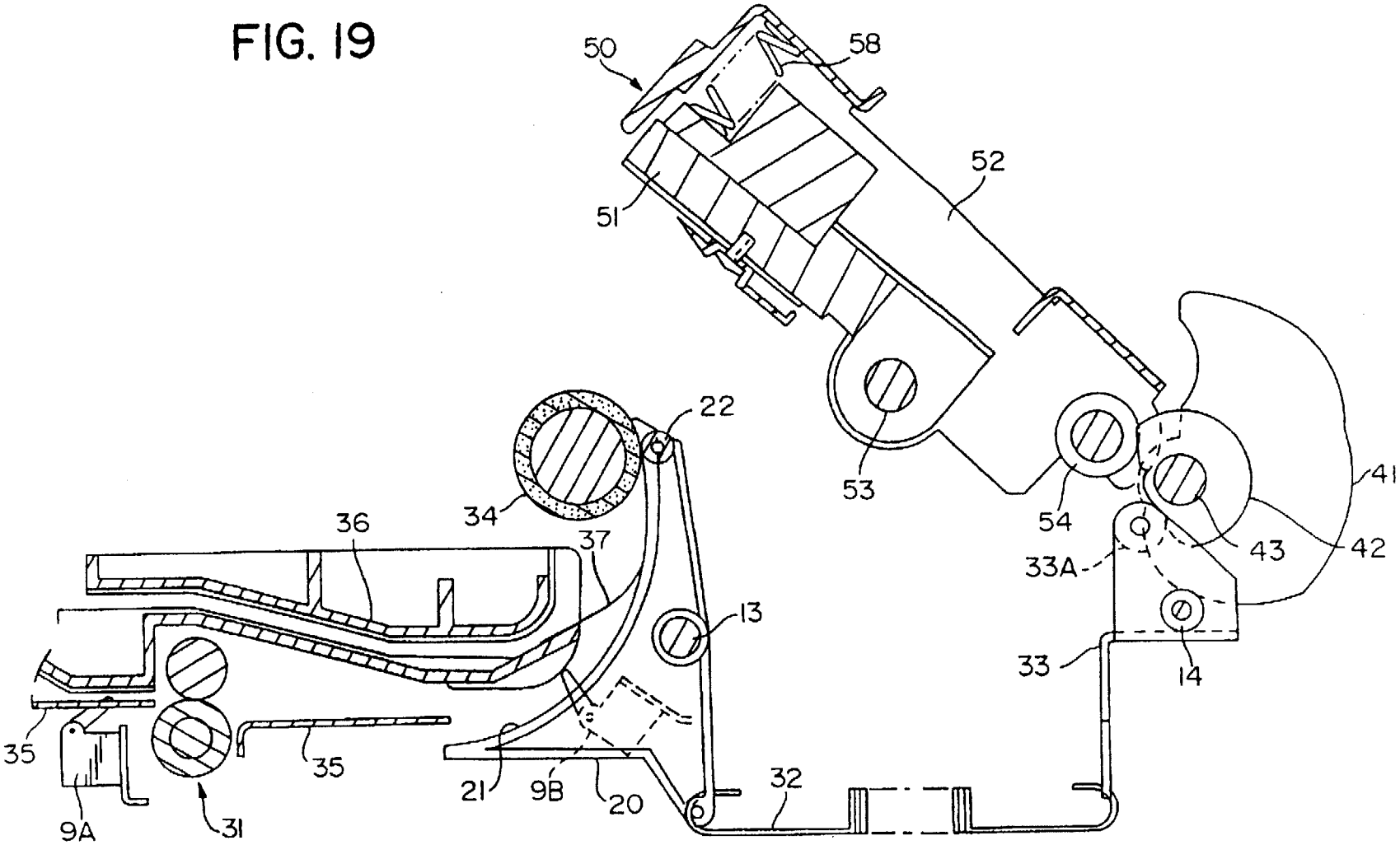
FIG. 19 is a diagram showing the thermal transfer head located at a retracting position.

As shown in FIG. 19, when the cam follower 54 confronts the cam surface with the smallest diameter (in this state, the cam follower 54 is not abutted against the cam surface), the thermal transfer head 50 is greatly swung clockwise from the paper feed position shown in FIG. 19. As a result, the thermal head array 51 is located at the retracting position, greatly spaced apart the platen roller 34.

The relationship between the displacement of the cam surface of the head operation cam 41 and that of the cam surface of the roller press cam 42, against which the cam follower 33A of the aforesaid operation arm 33 is abutted (i.e., the relationship between the position of the thermal transfer head 50 and the change of the force by which the pinch rollers 22 are pressed against the platen roller 34) is substantially set as follows. That is, when the thermal transfer head 50 is located at the image transfer position and retracting position (in the states shown in FIGS. 20 and 19, respectively), the pinch rollers 22 are pressed against the platen roller 34 with the weak force. Further, when the thermal transfer head 50 is located at the paper feed position (in the state shown in FIG. 17), the pinch rollers 22 are pressed against the platen roller 34 with the strong force.

The swing action, of the guide arm 20 and thermal transfer head 50, arranged as described above is controlled as described below in an image formation process.

The guide arm 20 and thermal transfer head 50 are in the wait state, shown in FIG. 19, before an image is formed. That is, the cam follower 54 of the thermal transfer head 50 confronts the cam surface with the smallest diameter of the head operation cam 41, and thus the thermal head array 51 of the thermal transfer head 50 is at the retracting position by being greatly spaced apart from the platen roller 34. The cam follower 33A, of the operation arm 33 is abutted against the small diameter portion of the roller press cam 42, and the pinch rollers 22 are pressed against the platen roller 34 with the weak force.

When the recording paper 4 is started to be fed, prior to the formation of an image, the guide arm 20 and thermal transfer head 50 are in the paper feed state shown in FIG. 17, until the recording paper 4, introduced from the recording paper cassette 2 into the imaging device 1 by the recording paper introduction roller 11, reaches the portion where the pinch rollers 22 are pressed against the platen roller 34. More specifically, the cam follower 54 is abutted against the intermediate cam surface of the operation cam 41, and thus the thermal transfer head 50 is located at the paper feed position; the thermal head array 51 is located slightly above the platen roller 34 with a clearance of 1–1.5 mm between the thermal head array 51 and the outer periphery of the platen roller 34; the cam follower 33A of the operation arm 33 is abutted against the large diameter portion of the roller press cam 42; and the pinch roller 22 is pressed against the platen roller 34 with a strong force.

Next, the extreme end of the recording paper is held by the clamper 70, and then the guide arm 20 and thermal transfer head 50 are in the image transfer state shown in FIG. 20, before the start of the formation of the image. More specifically, the cam follower 54 of the thermal transfer head 50 is abutted against the cam surface with the largest diameter of the operation cam 41; the thermal transfer head 50 is in the image transfer state in which the thermal head array 51 is pressed against the upper side of the platen roller 34 with a predetermined force; the cam follower 33A of the operation arm 33 is abutted against the small diameter portion of the roller press cam 42; and the pinch rollers 22 are pressed against the platen roller 34 with a weak force.

With the above arrangement of the swing action, the pinch rollers 22 are pressed against the platen roller 34 with the large force from the time when the extreme end of the recording paper reaches the portion where the pinch rollers 22 are pressed against the platen roller 34, to the time when the extreme end of the recording paper is held by the clamper 70, during which the recording paper must be fed by the rotation of the platen roller 34. Therefore, the recording paper can be securely fed. On the other hand, when the recording paper need not be fed by the rotation of the platen roller 34, in a case other than the above, the pinch rollers 22 are pressed against the platen roller 34 with the weak force. In particular, in the wait state shown in FIG. 19, no press mark is formed on the platen roller 34 by the pinch rollers 22 pressed thereagainst, and thus the formation of a bad image caused by a press mark made by the pressure of pinch rollers 22 can be prevented. More specifically, there is a possibility in the wait state, that a pressed recess may be defined in the surface of the elastic member of the platen roller 34 by the pinch rollers 22 continuously pressing against the same portion of the platen roller 34 with the strong force. Thus, a bad image is formed because the recording paper is irregularly pressed against the thermal head array 51, due to the pressed recess. However, the formation of the bad image can be prevented by the above arrangement.

Further, in the paper feed state, the extreme end of the recording paper fed by the platen roller 34 is advanced substantially in the tangential direction of the platen roller 34 at the portion where the pinch rollers 22 are pressed against the platen roller 34. At this time, however, the extreme end of the recording paper is abutted at an angle against the lower surface of the thermal head array 51 located in the vicinity of the upper side of the platen roller 34 (at the paper feed position). Consequently, the direction in which the recording paper is moved is regulated by the thermal head array 51 and changed to a horizontal direction, and thus the recording paper is fed toward the clamper 70 located at the paper feed position. That is, the thermal head array 51 (thermal transfer head 50) acts as a guide for regulating the feed direction of the recording paper 4, so that it is fed along the horizontal tangential line of the pinch roller 22.

As described above, in the paper feed state, in which the recording paper is held by the clamper 70, the thermal transfer head 50 is located at the paper feed position, where it is slightly spaced apart from the platen roller 34, and thus the recording paper is fed between the platen roller 34 and the thermal transfer head 50. Therefore, the direction in which the recording paper is fed is regulated by the thermal transfer head 50, and thus the recording paper can be guided along the platen roller 34 without the provision of a guide means interfering with the thermal transfer head 50. As a result, the recording paper can be securely fed along a preset feed path.

Next a mechanism for driving the platen roller 34 will be described.

As described above, the outer periphery of the platen roller 34 is formed of an elastic member, comprising rubber or the like, having a predetermined elasticity and supported at the opposite ends thereof by the frame side plates 1A of the imaging device 1.

Figure 21:
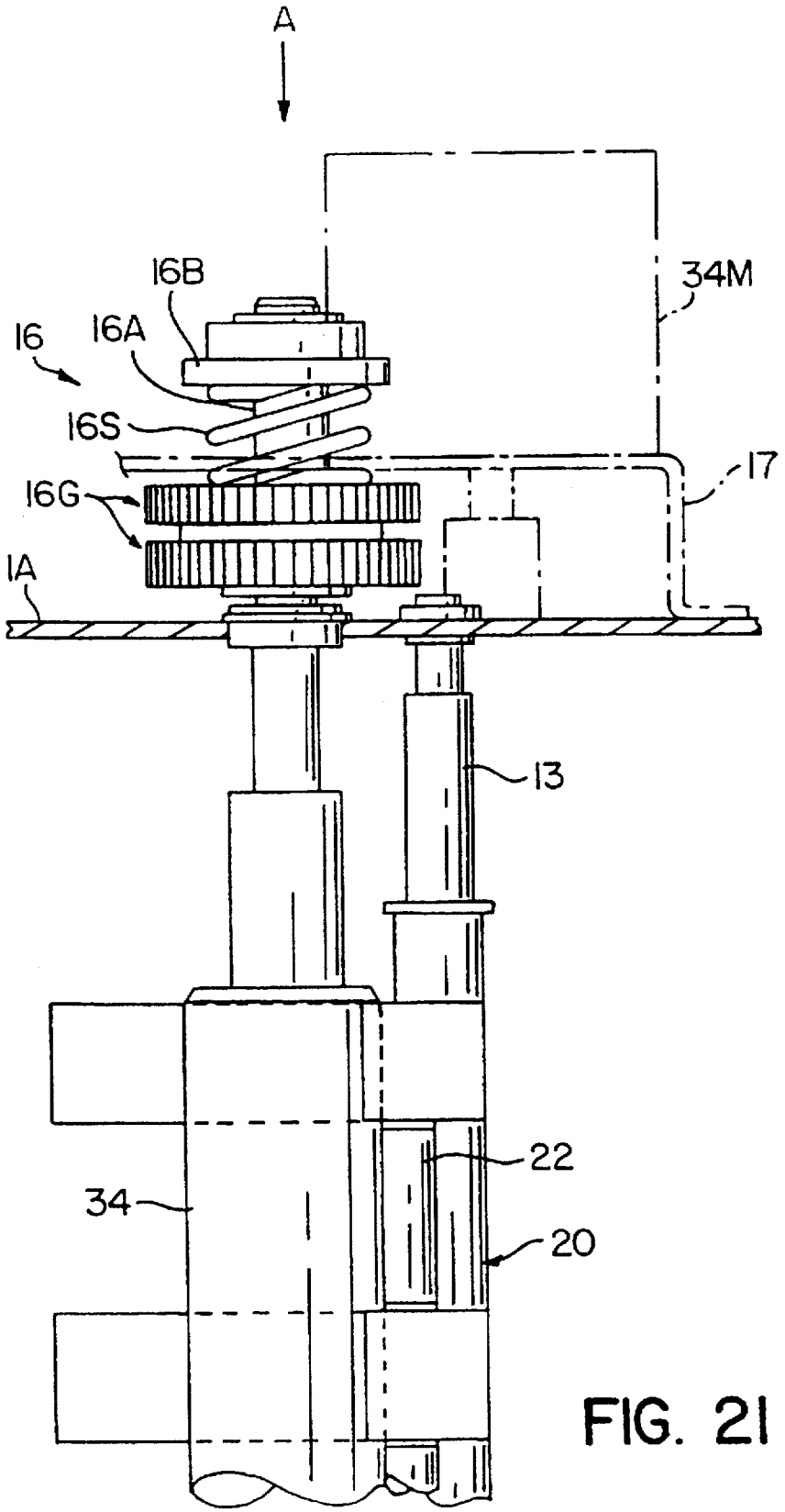
FIG. 21 is a plan view of a platen roller drive mechanism.
Figure 22:
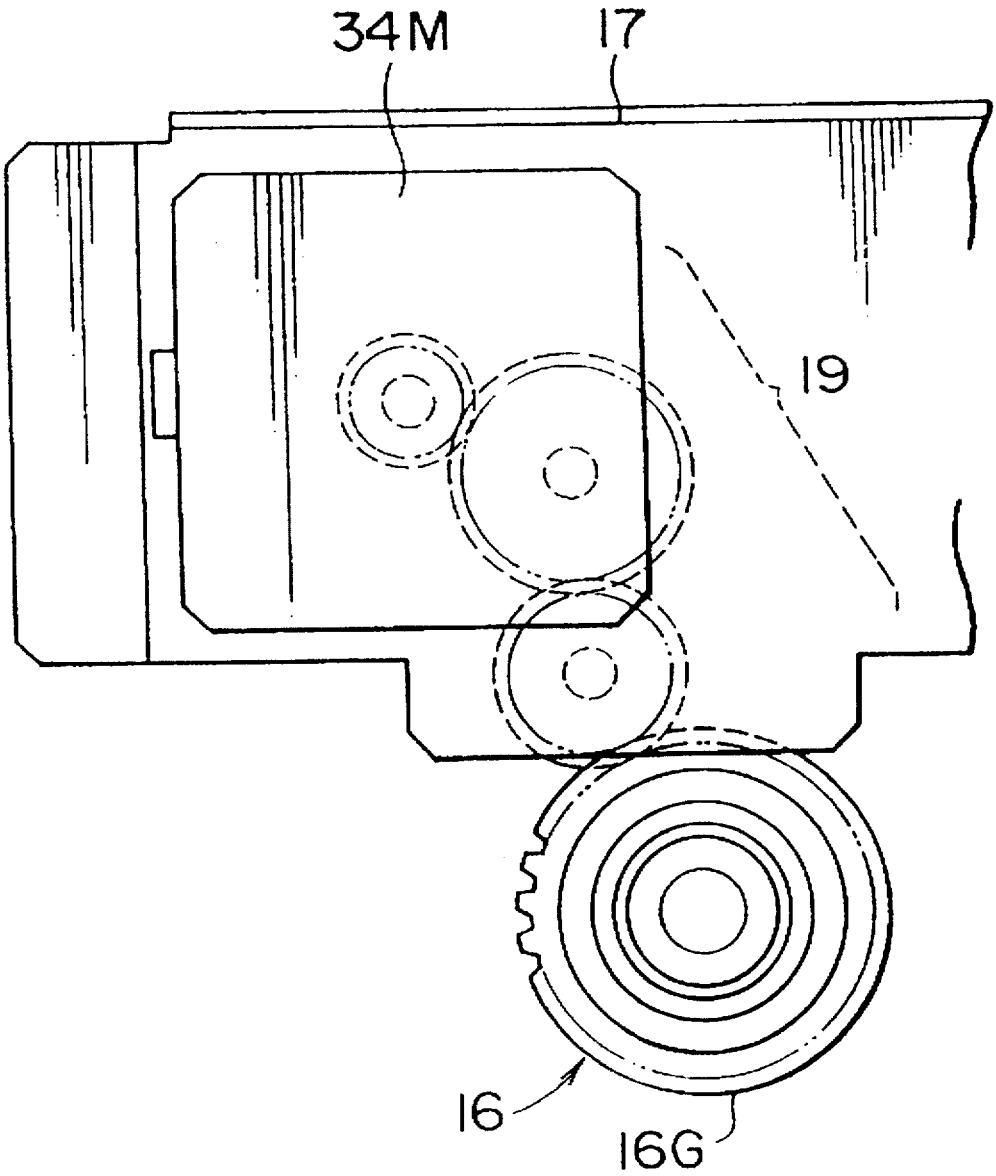
FIG. 22 is a diagram taken along the line A—A in FIG. 21.

As shown in the plan view of the platen roller 34, in FIG. 21 and in FIG. 22 as the cross sectional view of FIG. 21 taken along the line A—A thereof, an end of the platen roller 34 is coupled with the platen roller drive motor 34M through a friction clutch 16. More specifically, the friction clutch 16, having an outer periphery around which a gear 16G is formed, is mounted to the end of the platen roller 34 projecting from the frame side plate 1A. The outer peripheral gear 16G of the friction clutch 16 is coupled, through a gear train 19, with the platen roller drive motor 34M fixed to the frame side plate 1A through a bracket 17.

Figure 47:
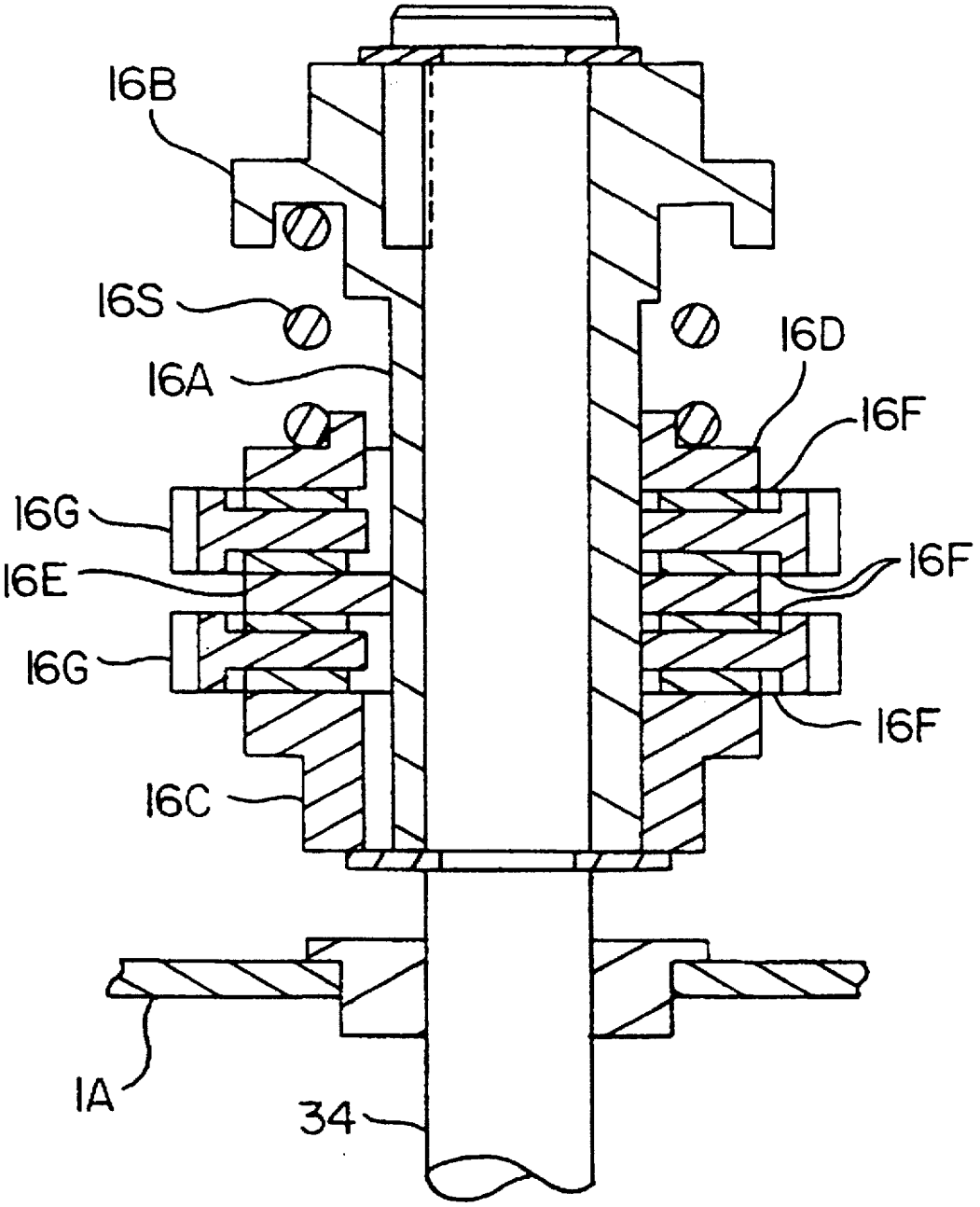
FIG. 47 is a cross-sectional plan view of the platen friction clutch mechanism.

The friction clutch 16 is illustrated in detail in FIG. 47. Accordingly, with particular reference to FIG. 47, the friction clutch 16 includes a sleeve 16A secured to the shaft of the platen for rotation therewith. The sleeve 16A is provided with a flange 16B at one axial end thereof and a fixed ring 16C is secured to the other axial end of the sleeve 16A. Between the flange 16B and the ring 16C an array, comprising a plurality of friction discs 16D and 16E, and gears 16G, is arranged. The friction discs and gears are alternately stacked, with a plurality of frictional members 16F interposed between adjacent ones of the discs 16E and 16F, and the gears 16G. A spring 16S is positioned between the flange 16B and the stacked array of friction discs 16D, 16E, gears 16G and friction members 16F. The spring 16S biases the stacked array to be pressed into contact with each other in the axial direction (i.e. in the direction in which the array is stacked).

Accordingly, when the torque exerted on the stacked array exceeds a predetermined level, slippage occurs between the frictional members and the gears 16G and the gears 16G do not transmit drive force to the shaft of the platen 34. On the other hand, when the torque is below the predetermined level, the gears 16G transmit drive to the platen from the gear train 19.

With the above arrangement, the platen roller 34 can be rotated by the platen roller drive motor 34M, through the friction clutch 16, in the forward and backward directions (clockwise and counterclockwise in the FIG. 21). When a resistance against rotation that is larger than a preset value is imposed on the platen roller 34, the platen roller 34 is stopped by the action of the friction clutch 16. Whereas, when a rotational torque larger than a preset value is imposed on the platen roller 34, the platen roller 34 can be rotated even if the platen roller drive motor 34M is stopped.

Next, a recording paper feed control structure, from the introduction of the recording paper to the arrival thereof at the clamper 70, drive control of the platen roller 34, and swing control of the guide arm 20 and thermal transfer head 50, in synchronism with the above controls, will be described below.

Figure 23:
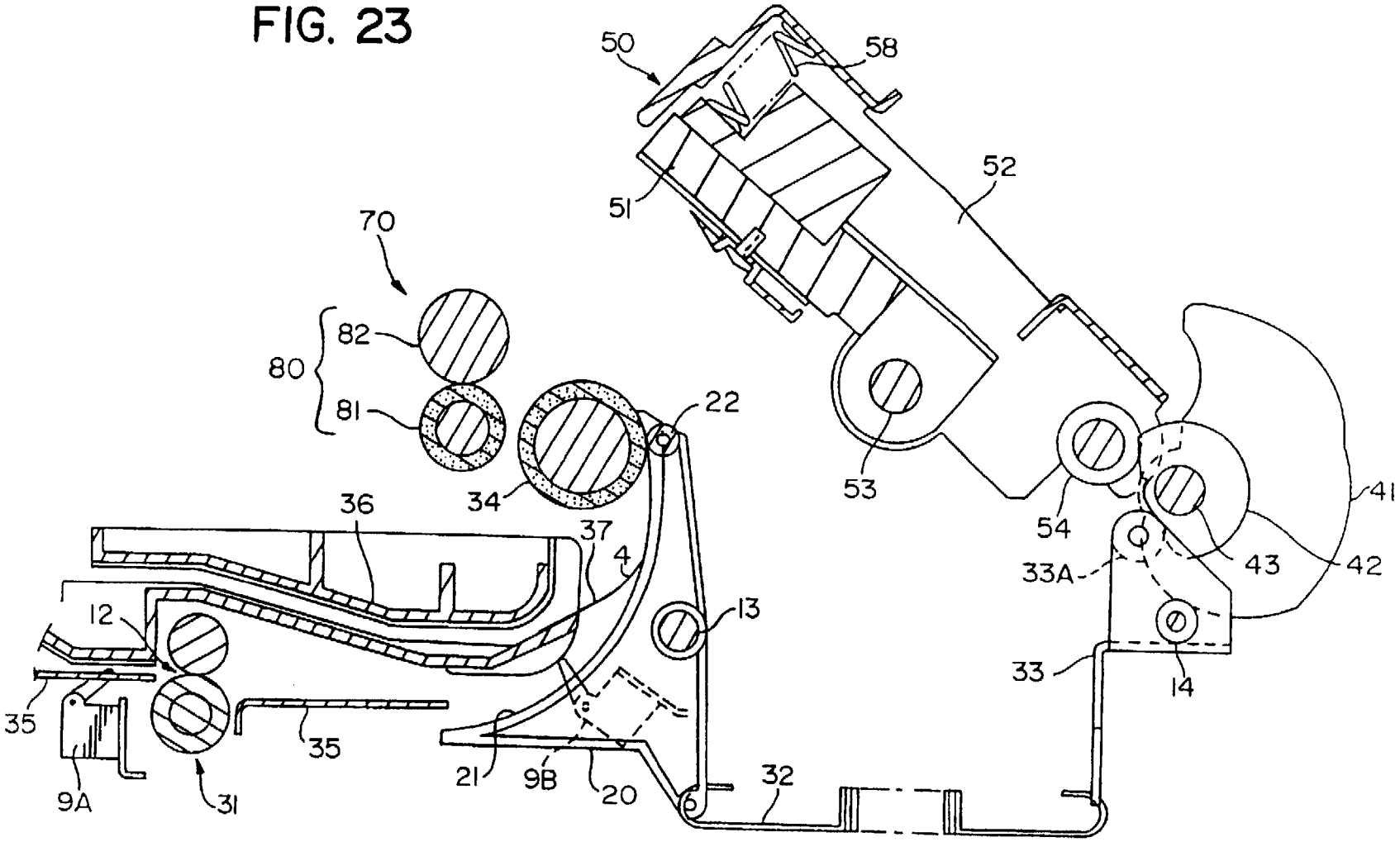
FIG. 23 is a partially enlarged side view of a recording paper feed path from the paper feed unit to the clamper.

As shown in the enlarged diagram of the recording paper feed path in FIG. 23, limit switches 9A and 9B are disposed midway of the recording paper feed path from the paper feed unit 10 to the clamper 70 to detect the presence of the recording paper in the path.

The limit switch 9A is disposed at a position from which the recording paper is fed toward the pair of feed rollers 31, and the sensor arm of the limit switch 9A projects upward from the upper surface of the recording paper guide plate 35.

The limit switch 9B is disposed on the guide arm 20 and the sensor arm of the limit switch 9B projects from the upper surface of the guide portion 21.

As shown in the control block diagram of FIG. 5, sensing signals from these limit switches 9A and 9B are inputted to the control unit 5. With this arrangement, when the sensor arms of the limit switches 9A and 9B are actuated by the recording paper being fed, the control unit 5 can sense the extreme end of the recording paper.

As shown in the control block diagram of FIG. 5, the recording paper introduction roller 11 and pair of introduction rollers 12 are driven in rotation by the introduction roller drive motor 11M, which is controlled by the control unit 5.

Figure 50:
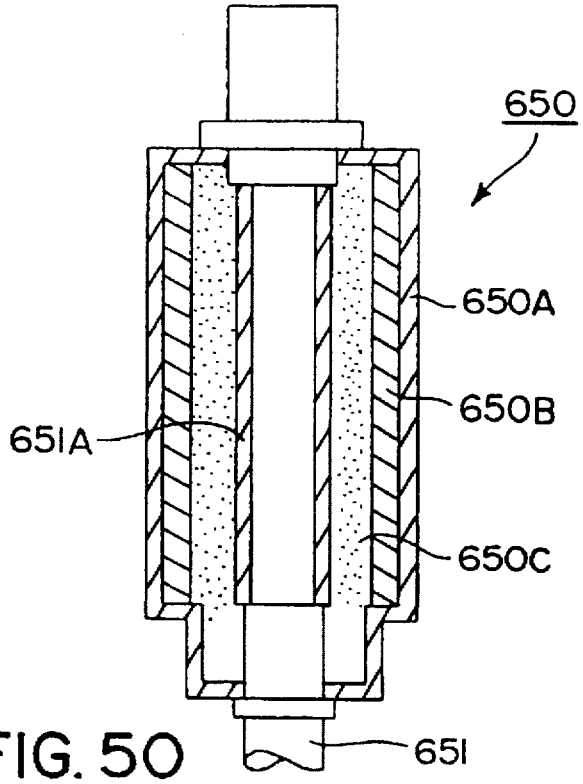
FIG. 50 is a cross-sectional view of the ink ribbon friction clutch.

As shown in FIG. 50, the pair of feed rollers 31 and platen roller 34 are coupled with the platen roller drive motor 34M and driven in rotation thereby in the forward and backward directions. The platen roller drive motor 34M is also controlled by the control unit 5.

As shown in FIG. 5, the cam shaft 43 to which the head operation cam 41 and roller press cam 42 are fixed is driven in rotation by the cam shaft drive motor 43M, which is controlled by the control unit 5. With this arrangement, the position (attitude) of the thermal transfer head 50, and the force by which the pinch rollers 22 are pressed against the platen roller 34 are controlled.

Further, as shown in FIG. 5, the lower roller 81, of the clamper 70 (to be described later in detail) is driven in rotation by the clamper drive motor 80M. The clamper 70 itself is moved along the guide shafts 90 by the clamper movement drive motor 70M. The clamper drive motor 80M and clamper movement drive motor 70M are controlled and coordinate by the control unit 5.

The control unit 5 controls the recording paper introduction roller 11, pair of introduction rollers 12, pair of feed rollers 31 and platen roller 34, as described below, in response to signals supplied from the limit switches 9A and 9B, to thereby feed the recording paper. Further, the control unit 5 controls the cam shaft 43 as described below, synchronously with the feeding of the recording paper, to thereby control the position (attitude) of the thermal transfer head 50 and the force with which the pinch rollers 22 are pressed against the platen roller 34. Further, the control unit 5 controls the clamper drive motor 80M to cause the clamper 70, to grip the recording paper, and controls the clamper movement drive motor 70M, to move the clamper 70, to scan the gripped recording paper.

First, the recording paper introduction roller 11 is driven to introduce the recording paper 4, accommodated in the recording paper cassette 2, into the imaging device 1. At this time, the pair of feed rollers 31 and platen roller 34 are in a rest state without being rotated. Further, as shown in FIG. 23, the thermal transfer head 50 is located at the retracting position. The cam follower 33A, of the operation arm 33, is abutted against the small diameter portion of the roller press cam 42, and thus the pinch rollers 22 are pressed against the platen roller 34 with the weak force.

The recording paper 4 is fed on the recording paper guide plates 35, toward the pair of feed rollers 31 by the pair of introduction rollers 12, thus actuating the limit switch 9A at a predetermined position in front of the pair of feed rollers 31.

Figure 24:
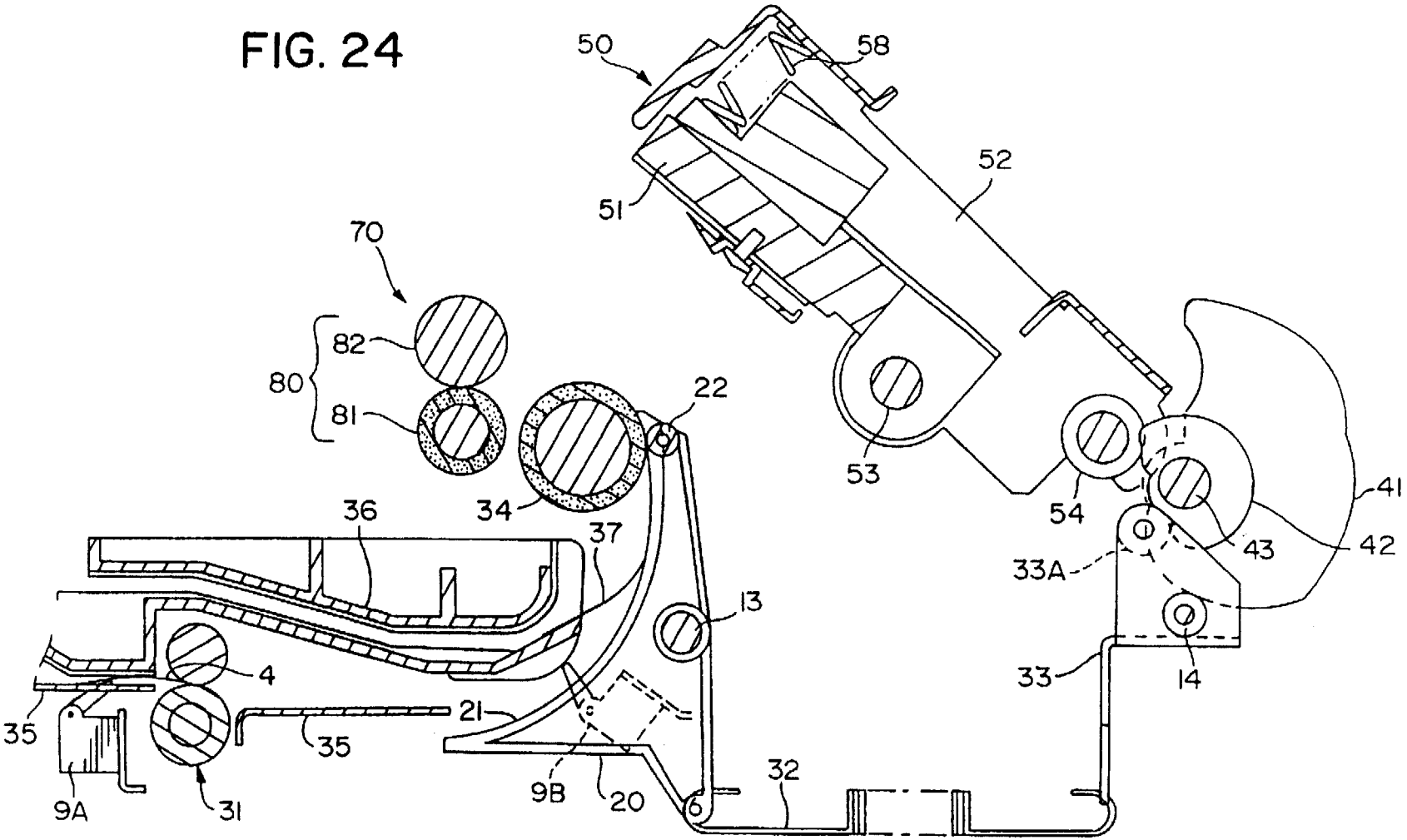
FIG. 24 is a diagram showing that the extreme end of a recording paper comes into contact with the pressure contact portion of a pair of feed rollers so that the attitude and position of the recording paper is corrected.

When the recording paper 4 is fed by a predetermined distance after it has actuated the limit switch 9A, the pair of introduction rollers 12 are stopped. As shown in FIG. 24, a period of time from the time when the recording paper 4 actuates the limit switch 9A to the time when the pair of introduction rollers 12 are stopped, is set such that the extreme end of the recording paper 4 is abutted against the pressure contact portion of the pair of feed rollers 31 and stopped in a loose state. With this arrangement, the extreme end of the recording paper 4 is parallel with the pair of feed rollers 31 and thus the orientation of the recording paper 4 being fed, is corrected even if the recording paper 4 is obliquely fed from the paper feed unit 10. More specifically, the attitude of the recording paper 4 is corrected and the extreme end thereof, is positioned by the way as described below. That is, the recording paper 4 is fed to a position just before the position where the recording paper 4 is abutted against the pair of feed rollers 31 after the recording paper 4 has actuated the limit switch 9A through the extreme end thereof and then the recording paper 4 is intentionally loosened (i.e. allowed to remain slack).

Thereafter, the recording paper 4, abutted against the pressedly pressure contact portion of the pair of feed rollers 31 at the extreme end thereof, is easily dragged between the rollers 31 by the rotation thereof and fed.

The feed path of the recording paper 4 is changed to an upward direction, as the extreme end of the recording paper 4 is guided by the arc-shaped guide portions 21. Then, the recording paper 4 actuates the limit switch 9B, while it is being fed and elastically deforms the recording paper retraction path regulation member 37 as it continues to be fed, as shown in FIG. 25.

Figure 25:
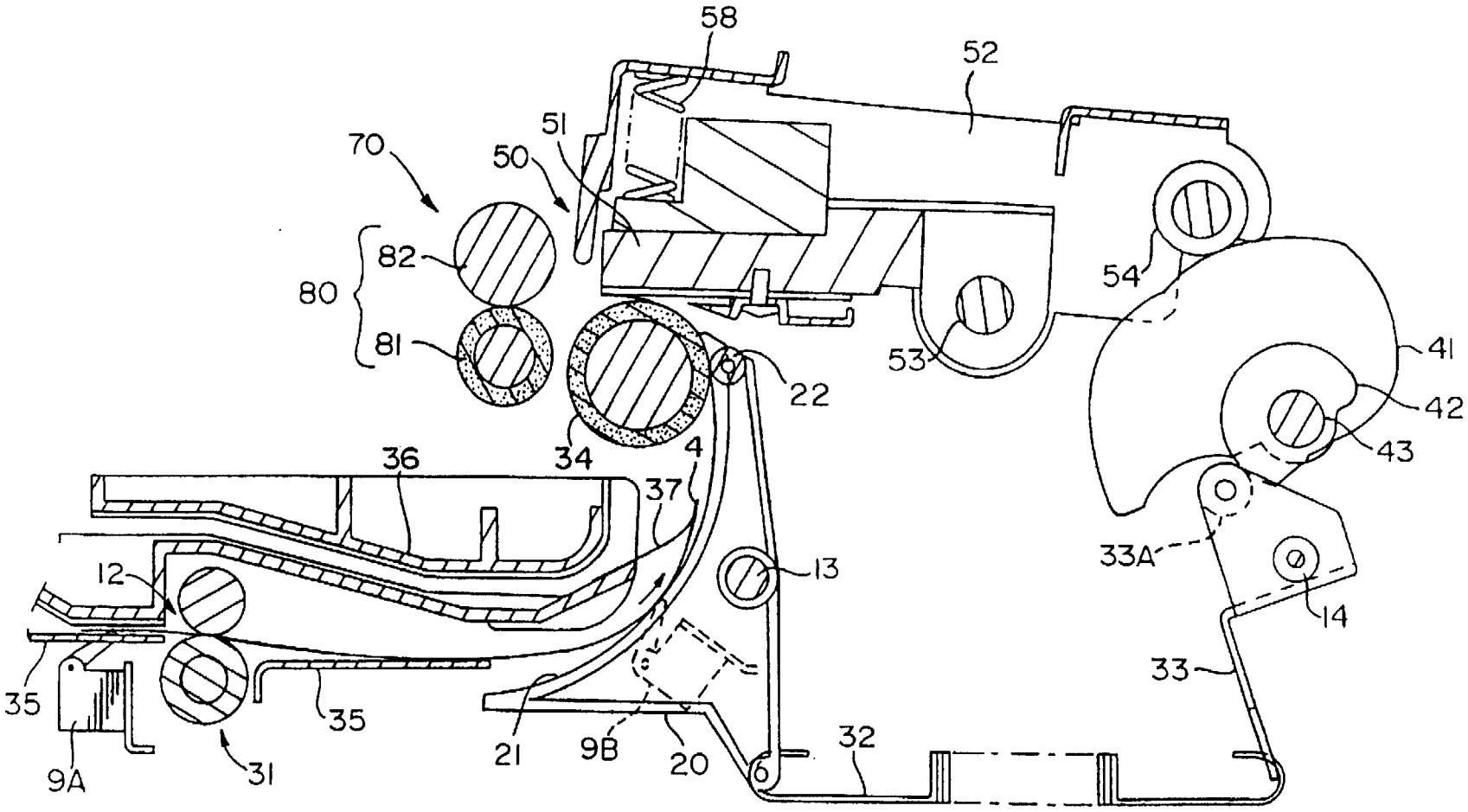
FIG. 25 is a diagram showing the state where a recording paper is fed while elastically deforming a recording paper retraction path regulation member.

When a predetermined period of time has elapsed after the recording paper 4 has actuated the limit switch 9B, the platen roller 34 is rotated counterclockwise in FIG. 25. A period of time from the time when the recording paper 4 actuates the limit switch 9B to the time when the rotation of the platen roller 34 is started is set, such that the rotation of the platen roller 34 is started before the extreme end of the recording paper 4 reaches the portion where the pinch rollers 22 are pressed against the platen roller 34.

Substantially at the same time as the start of rotation of the platen roller 34, the thermal transfer head 50 is moved to be located at the paper feed position. At this time, the thermal head array 51 is located slightly above the platen roller 34 with a clearance of 1–1.5 mm provided between the thermal head array 51 and the outer periphery of the platen roller 34. The pinch rollers 22 are pressed against the platen rollers 34, with the large force. Note that the thermal transfer head 50 is already located at the paper feed position in FIG. 25.

When the extreme end of the recording paper 4 reaches the portion where the pinch rollers 22 are pressed against the platen roller 34, the recording paper 4 is dragged between these rollers and fed by the platen roller 34. At this time, since the pinch rollers are pressed against the platen roller 34 with the large force, the recording paper 4 can be securely fed.

Figure 26:
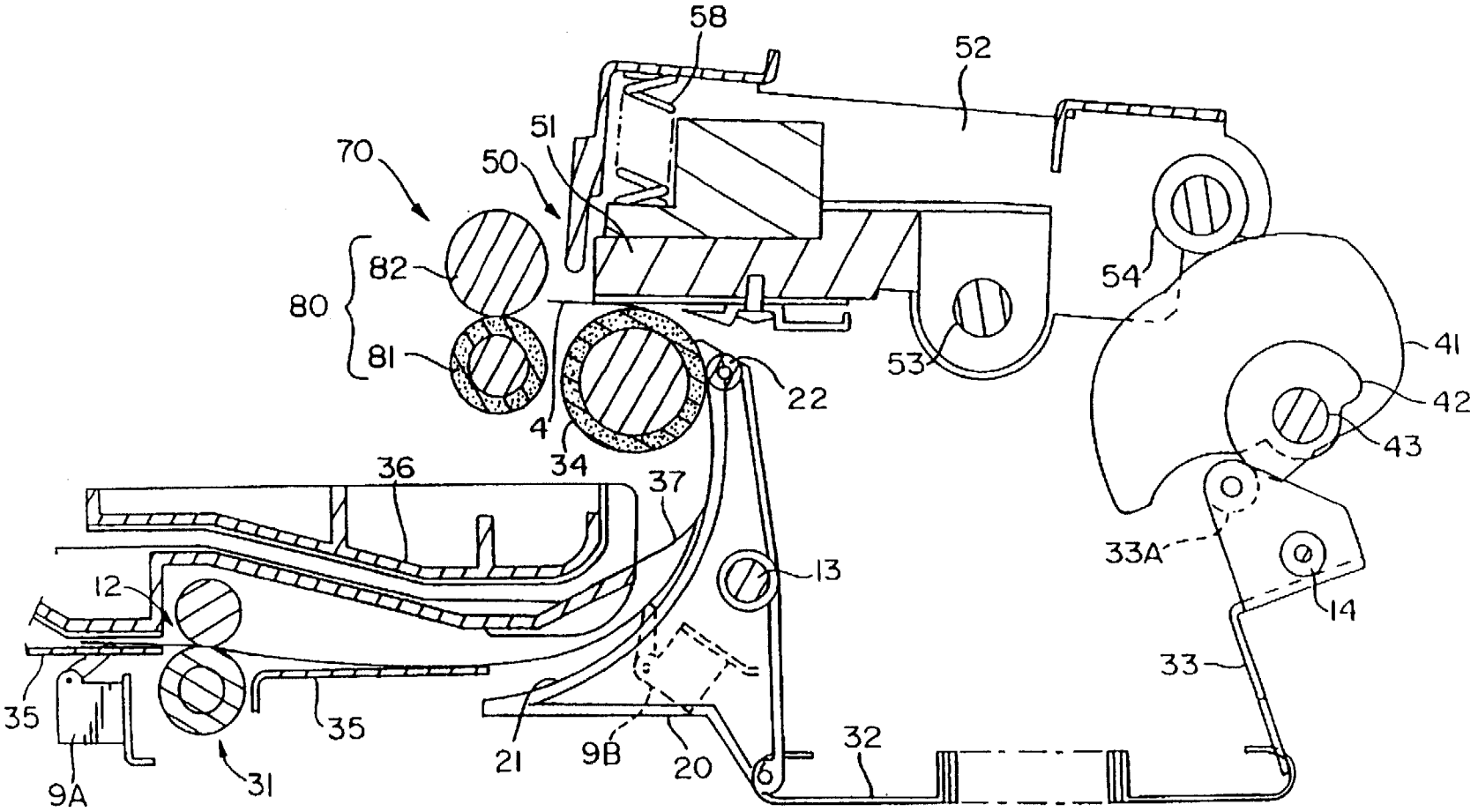
FIG. 26 is a diagram showing the state where the extreme end of a recording paper is guided onto the lower surface of the thermal transfer head located at the paper feed position and fed toward the clamper at the paper feed position.

Then, as shown in FIG. 26, the extreme end of the recording paper 4 comes into contact with the lower surface of the thermal transfer head 50, located at the paper feed position, and is fed toward the clamper 70, located at the paper feed position, by being regulated by the thermal transfer head 50.

As described above, the recording paper 4 is fed upwardly of the horizontal tangential line of the platen roller 34. Thus, the extreme end of the recording paper 4 is directed to a position between the portion where the lower roller 81 of the clamper 70 is pressed against the upper roller 82 thereof and the center of rotation of the upper roller 82.

The extreme end of the recording paper 4 comes into contact with the outer peripheral surface of the upper roller 82 at the position between the portion where the lower roller 81 is pressed against the upper roller 82 and the center of rotation of the upper roller 82. Therefore, the recording paper 4 slides along the outer peripheral surface of the upper roller 82, toward the portion where the upper roller 82 is in contact with the lower roller 81. That is, the recording paper 4 is guided by the peripheral surface of the upper roller 82 so that the extreme end of the recording paper 4 is properly introduced to the pressedly contact portion of the upper and lower rollers 82 and 81.

Figure 27:
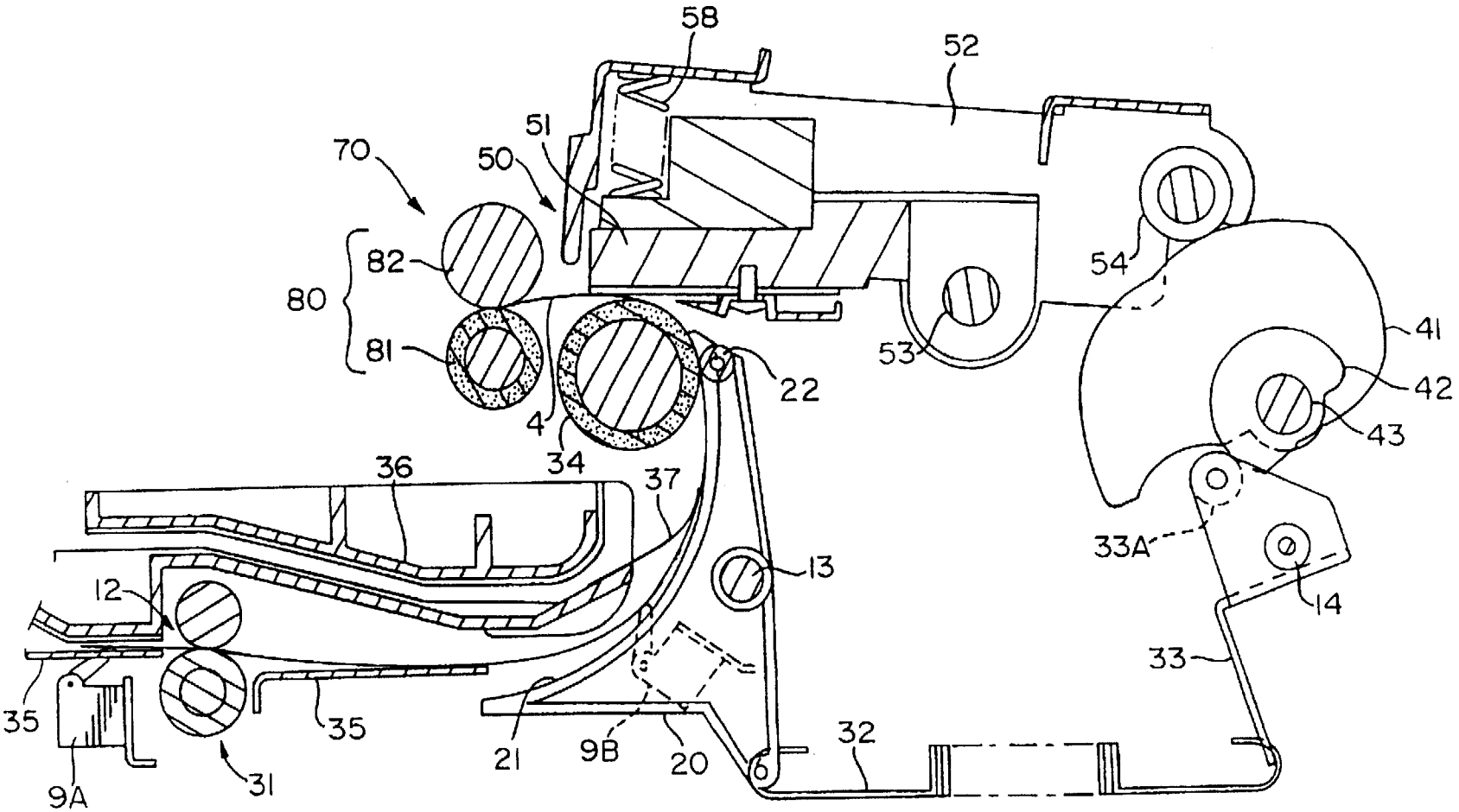
FIG. 27 is a diagram showing the state where the extreme end of a recording paper reaches the pressure contact portion of a pair of support rollers of the clamper, and the recording paper, being fed by the platen roller is stopped.

When the extreme end of the recording paper 4 reaches the pressure contact portion of the upper and lower rollers 82 and 81 and the recording paper 4 is loosened or slackly held between the clamper 70 and the platen roller 34 as shown in FIG. 27, the platen roller 34 stops the feed of the recording paper 4. An amount of feed of the recording paper 4, effected by the platen roller 34 until it stops the feed of the recording paper 4 is controlled based on the position sensed when the recording paper 4 actuates the limit switch 9B. In this case, a highly accurate control is not needed so long as the recording paper 4 is loosened or slackly held. Further, even if the platen roller 34 is continuously rotated, the feed of the recording paper 4 is interrupted by the action of the friction clutch disposed in the drive system. With this arrangement, the extreme end of the recording paper 4 is made parallel with the pair of support rollers 80 and thus the attitude of the recording paper 4 is corrected in the same way as the case performed by the aforesaid pair of feed rollers 31.

Figure 28:
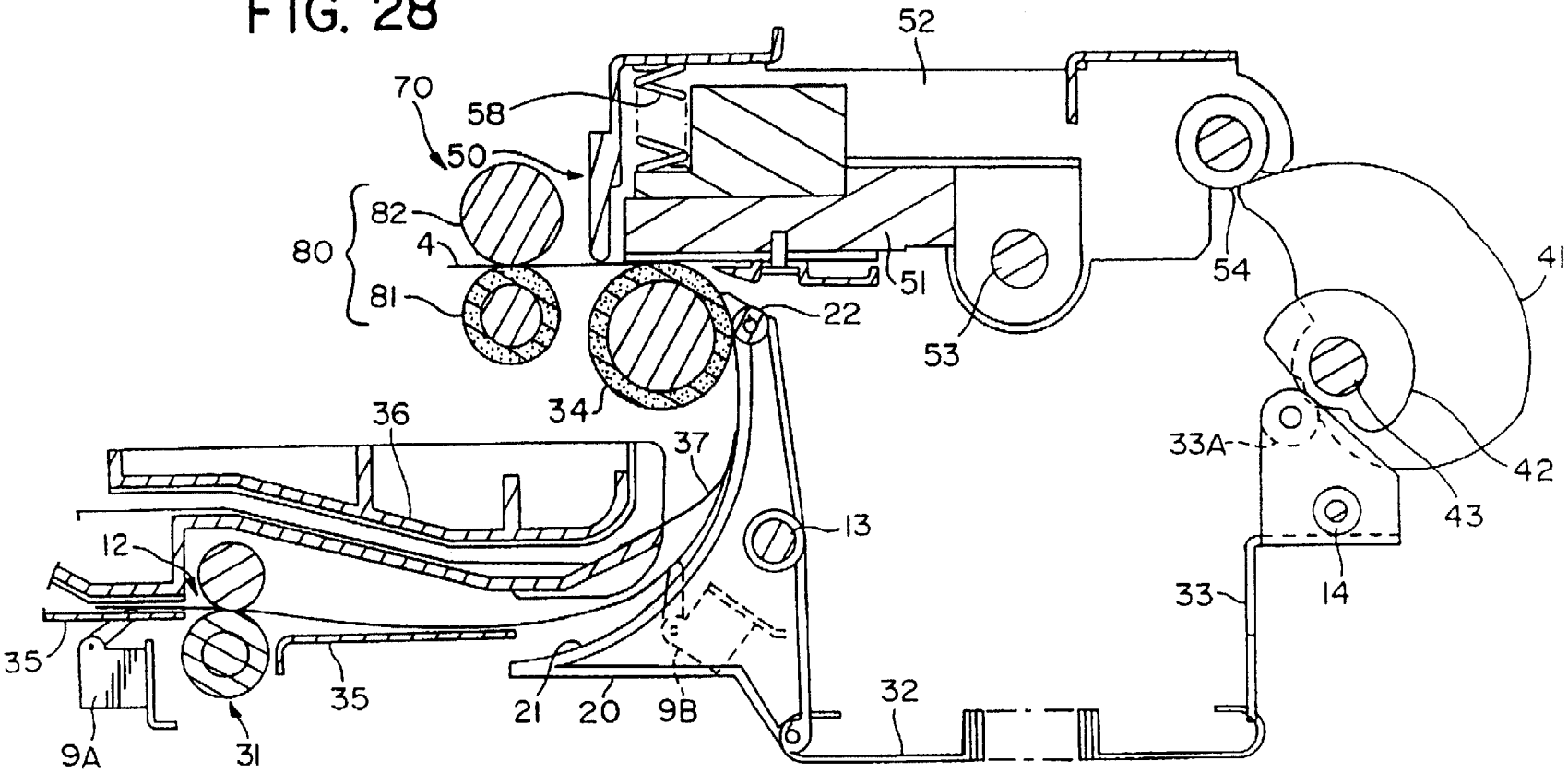
FIG. 28 is a diagram showing the state where the extreme end of the recording paper is supported by the pair of support rollers of the clamper.

Next, the lower roller 81 and the clamper 70 is rotated counterclockwise, in FIG. 27, by a predetermined amount (a predetermined angle) and thus the recording paper 4 is dragged between the upper and lower rollers 82 and 81. As a result, as shown in FIG. 28, the extreme end of the recording paper 4 is held between the pair of support rollers 80, in the state that a position of the recording paper 4 spaced apart from the extreme end thereof by a predetermined distance corresponds to the pressure contact portion of the upper and lower rollers 82 and 81. When the recording paper 4 is dragged, the extreme end thereof is securely in contact with the pressure contact portion of the upper and lower rollers 82 and 81. Therefore, the recording paper 4 is securely dragged at once by the lower roller 81 rotating from this state. The amount of the recording paper 4 which is dragged, can be accurately controlled by controlling the rotational angle of the lower roller 81 since no slippage occurs during dragging. When the recording paper 4 is dragged and held by the pair of support rollers 80 of the clamper 70, the platen roller 34 is not driven but rotated by following the movement of the recording paper 4 by the action of the aforesaid friction clutch 16. With this arrangement, the recording paper 4 between the platen roller 34 and the clamper 70 is stretched by the rotational resistance of the platen roller 34. Note, FIG. 28 shows the state where the thermal transfer head 50 is moved to the image transfer position.

According to the recording paper feed mechanism and recording paper feed control mechanism thereof as described above, when the recording paper 4 is fed by rotating the pair of positioning and feed rollers (the pair of feed rollers 31), in the state where the recording paper 4 is pressed at the pressure contact portion, the attitude of the recording paper can be corrected so that the extreme end thereof is in parallel with the pair of feed rollers. Further, one of the pair of holding rollers (the pair of support rollers 80) is formed of a smooth surface and the recording paper feed path is directed to the roller having the smooth surface (the upper roller 82) located above the pressure contact portion of the pair of holding rollers. Thus, the roller with the smooth surface acts as a guide member for introducing the recording paper to the pair of holding rollers. As a result, the recording paper can be securely introduced between the pair of holding rollers without the need for a complex guide structure. Further, the attitude of the recording paper can be corrected in such a manner that the recording paper is dragged by rotating the pair of holding rollers in the state that the extreme end of the recording paper is pressed against the pressure contact portion of the pair of holding rollers.

With this arrangement, the recording paper can be fed by a simple structure toward the pressure contact portion of the pair of holding rollers, such that the extreme end of the recording paper is always in parallel with the pair of holding rollers. Further, a predetermined position of the recording paper can be established and maintained by the pair of holding rollers.

After the clamper 70 has gripped the extreme end of the recording paper, the thermal transfer head 50 is located at the image transfer position where the thermal head array 51 is pressed against the upper side of the platen roller, by a predetermined press force. At the same time, the pinch rollers 22 are pressed against the platen roller 34 with the weak force.

The recording paper 4 is scanned by the movement of the clamper 70 to form an image. When the image is formed, the platen roller 34 is not driven, but rotated by following the movement of the recording paper, by the action of the aforesaid friction clutch 16. Thus, the platen roller 34 provides the recording paper with a suitable tension without preventing the movement thereof.

On the completion of the first transfer process, the clamper 70 is returned to the paper feed position to execute the next image transfer process (the recording paper 4 is returned to an image formation start position). At this time, however, the thermal transfer head 50 is located at the paper feed position where the thermal head array 51 is located slightly above the platen roller 34, and the pinch rollers are pressed against the platen roller 34 with the large force. Further, the platen roller 34 is driven in rotation in the direction opposite to that when the recording paper is held by the clamper 70 as described above (i.e. the platen roller 34 is driven clockwise in FIG. 28).

When the recording paper is fed in the reverse direction, the platen roller 34 is set to be rotated at a circumferential speed higher than the moving speed of the clamper 70 (i.e., the moving speed of the recording paper) when the platen 34 is in a free state. Actually, the rotation of the platen roller 34, at the higher speed, is prevented by the recording paper 4 supported by the clamper 70. Thus, the platen roller 34 is rotated following to the movement of the recording paper 4 by the action of the friction clutch 16 (at the same circumferential speed as the moving speed of the clamper 70). As a result, the platen roller 34 provides the recording paper with a suitable tension without preventing the movement thereof. More specifically, the recording paper 4 is returned to the image formation start position at the moving speed of the clamper 70 in the state that the recording paper 4 is provided with the suitable tension by the platen roller 34 and prevented from being loosened.

With the aforesaid platen roller drive structure, when the recording paper is returned to the image formation start position during a plurality of image transfer processes, the recording paper is moved at the moving speed of the recording paper holding means with suitable tension applied thereto. As a result, with this simple arrangement, the recording paper can be prevented from being loosened as well as from being dislocated from the clamping position thereof caused by the recording paper holding means.

Figure 29:
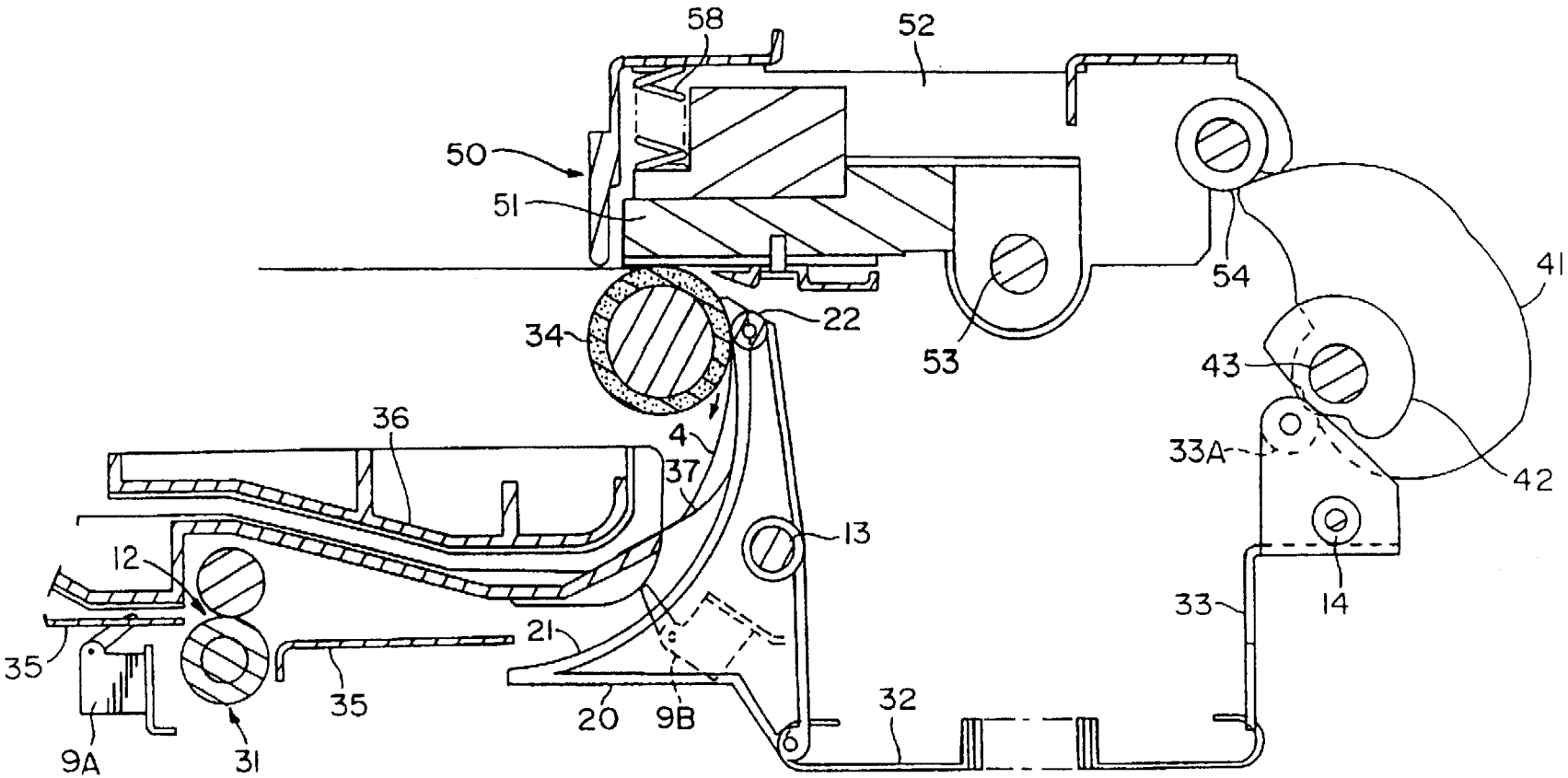
FIG. 29 is a diagram showing the state where a retraction path, to which the rear end of the recording paper is to be retracted, is changed by a recording paper retraction path regulation member, so that the recording paper is supplied onto a recording paper support plate.

Further, when the recording paper 4 is returned to the paper feed position, the rear end of the recording paper 4 is supplied onto the recording paper support plate 36 as shown in FIG. 29, since the retraction path of the recording paper is changed by the recording paper retraction path regulation member 37. Therefore, the recording paper 4 does not return to the paper feed unit 10.

As described above, the recording paper fed from the recording paper feed unit (the paper feed unit 10) along the recording paper feed path (while being supported by recording paper guide plates 35) reaches the recording paper holding means (clamper 70), by elastically deforming the divergence member (recording paper retraction path regulation member 37). The recording paper returned from the recording paper holding member, is supplied to the recording paper retraction unit (onto the recording paper support plates 36) by the divergence member. The recording paper retraction unit is disposed above the recording paper feed path spaced apart therefrom by a predetermined distance and in parallel therewith. Consequently, the recording paper feed path may have a required minimum length. Further, the recording paper feed path and recording paper retraction unit can be arranged as upper and lower stages. With this arrangement, the feed drive system can be simplified, a possibility of a paper jam is prevented and the size of the device can be reduced as a whole.

Next, an arrangement, moving structure and drive control of the clamper 70 will be described.

Figure 30:
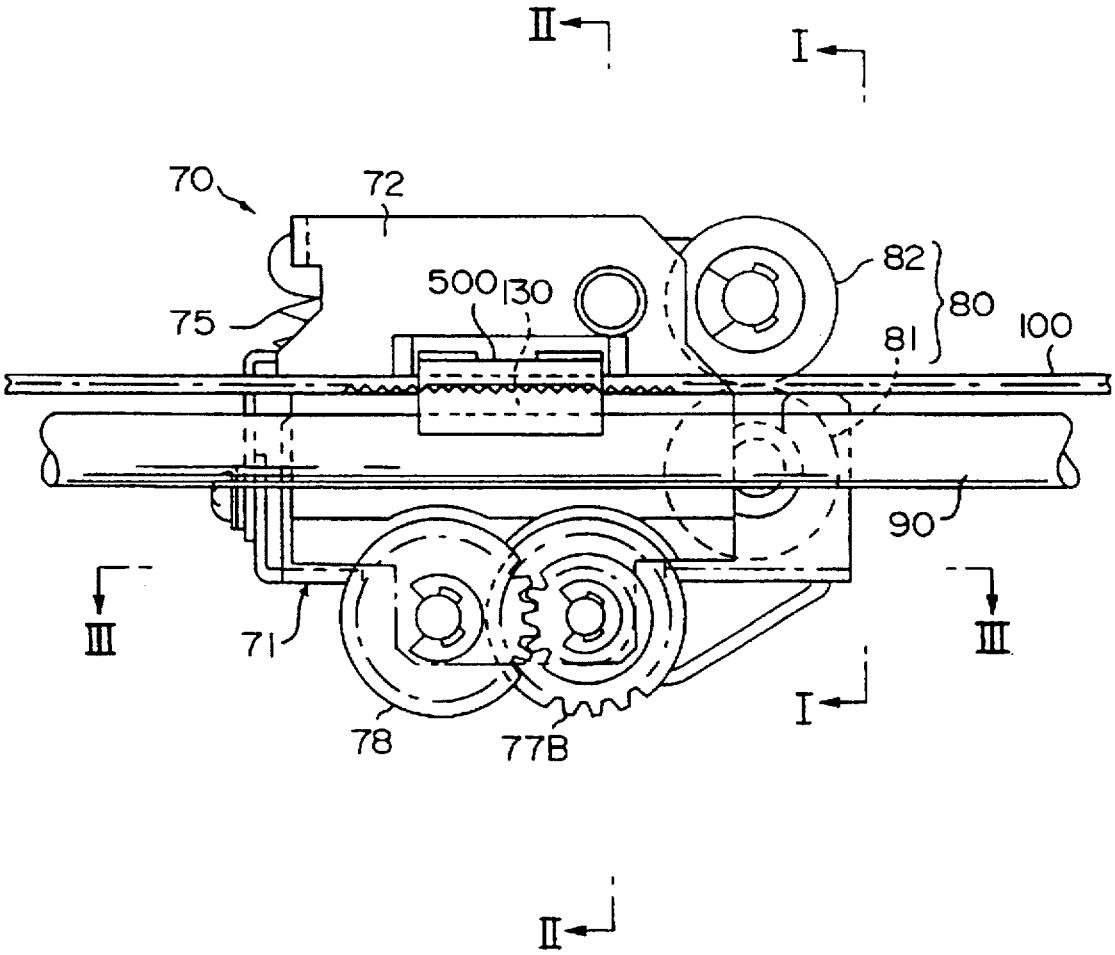
FIG. 30 is a side view of the clamper.
Figure 31:
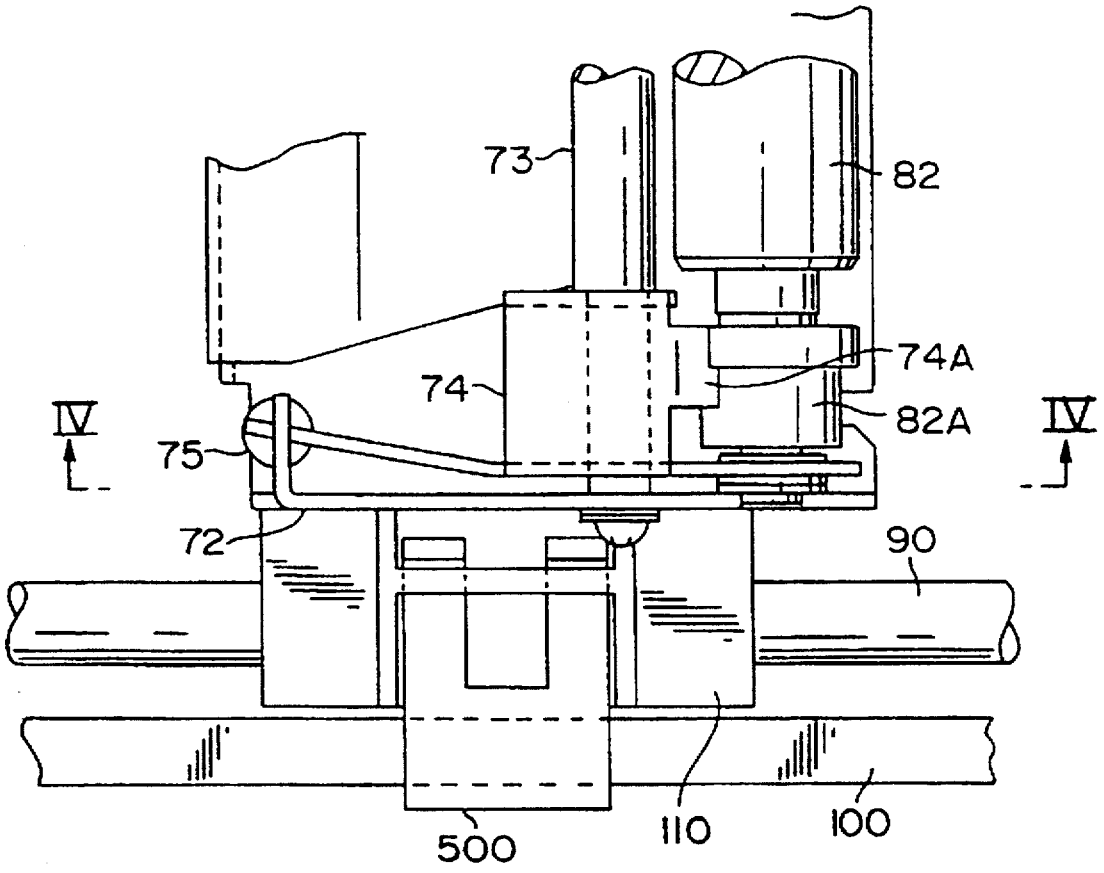
FIG. 31 is a plan view of one end of the clamper.
Figure 32:
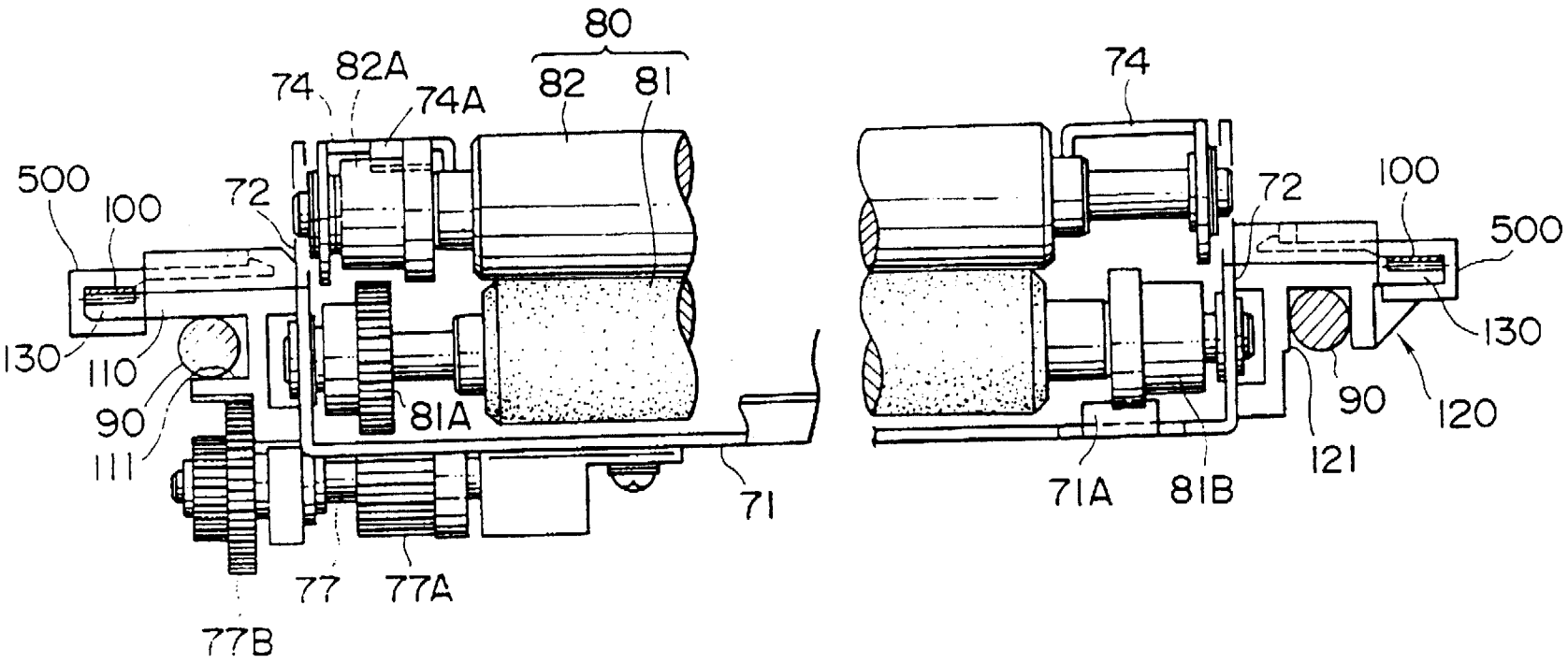
FIG. 32 is a cross sectional view taken along the line B—B of FIG. 30.
Figure 33:
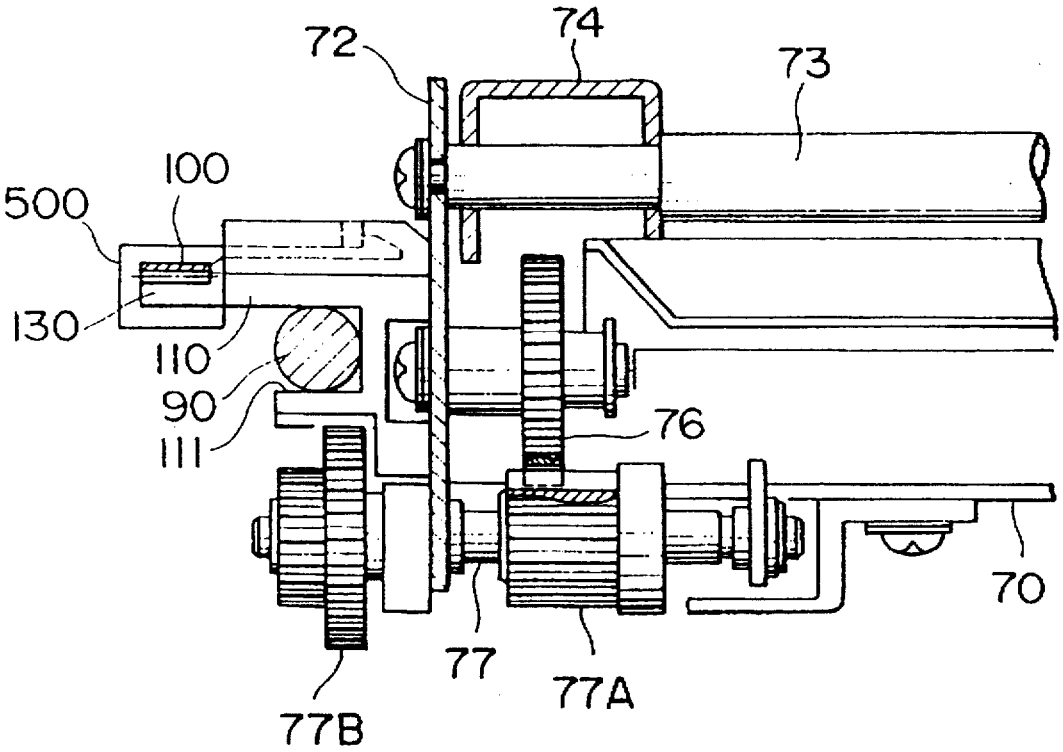
FIG. 33 is a cross sectional view taken along the line C—C of FIG. 30.
Figure 34:
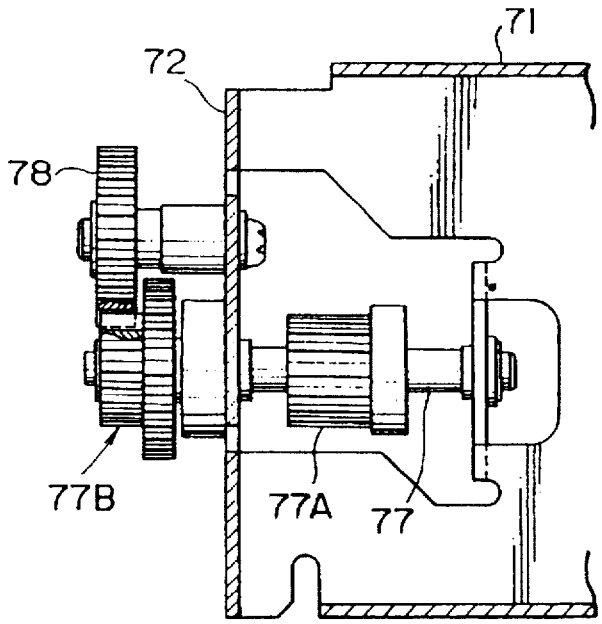
FIG. 34 is a cross sectional view taken along the line D—D of FIG. 30.
Figure 35:
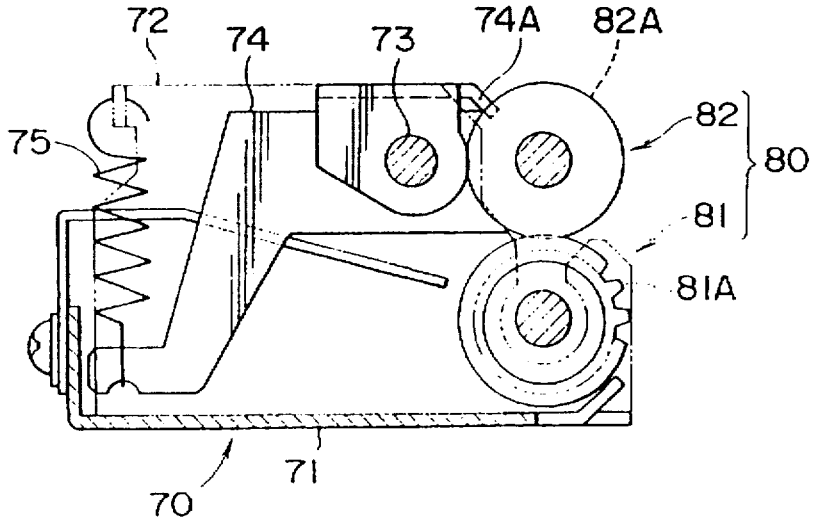
FIG. 35 is a cross sectional view taken along the line E—E of FIG. 31.

As shown in the side view of the clamper 70 in FIG. 30, the plan view of an end thereof in FIG. 31, FIG. 32 taken along the line B—B of FIG. 30, FIG. 33 taken along the line C—C of FIG. 30, FIG. 34 taken along the line D—D of FIG. 30, and FIG. 35 taken along line E—E of FIG. 31, a clamper 70 is provided with the pair of holding rollers 80. The pair of holding rollers 80 includes lower roller 81, rotatably supported by a frame 71 having vertical side plates 72 bent from the opposite ends in a width direction of the frame 71, and upper roller 82, supported by arms 74 swingably supported by the side plates 72 through a shaft 73.

The frame 71 is formed by bending a thin metal plate having an electric conductivity and the arms 74 are also formed by bending a thin metal plate having an electric conductivity.

The lower roller 81 has a rubber layer having a predetermined thickness formed on the surface thereof.

The upper roller 82 is a metal roller having an electric conductivity and the surface thereof is smoothly finished.

The end of each of the arms 74, opposite to the end thereof for supporting the upper roller 82, with respect to the shaft 73, is coupled with the frame 71 through a spring 75. The upper roller 82, supported by the arms 74, is swung and urged by the springs 75, toward the side for causing the upper roller 82, supported by the arms 74, to approach to the lower roller 81. With this arrangement, the upper roller 82 is pressed against the upper side of the lower 81 by a predetermined press force.

A gear 81A is fixed to a shaft end of the lower roller 81 and meshed with an idle gear 76, rotatably supported by the side plate 72, located at a position adjacent to the gear 81A, in the horizontal direction thereof. The idle gear 76 is meshed with an idle gear 77A, fixed to an idle shaft 77, rotatably supported by the chassis 71. A stepped gear 77B having a small diameter gear located to the outside thereof, is fixed to the end of the idle shaft 77, externally projecting from the side plate 72. The small diameter gear of the stepped gear 77B, is meshed with a gear 78, rotatably supported by the side plate 72 in the vicinity of the stepped gear 77B in the horizontal direction thereof. With this arrangement, when any one of the stepped gear 77B or gear 78 exposed from the side plate is rotated, the lower roller 81 is rotated through the idle shaft 77, idle gear 77A, idle gear 76 and gear 81A. More specifically, the stepped gear 77B, or gear 78, serves as an input gear to the clamper 70.

The aforesaid arm 74, shaft 73, frame 71, stepped gear 77B and gear 78 meshed with the small diameter gear of the stepped gear 77B, are composed of an electrically conductive material and thus, can be electrically in contact with each other. Therefore, the upper roller 82 can be in electrical contact with the stepped gear 77B, rotatably supported by the side plate 72, and the gear 78, meshed with a small diameter gear of the stepped gear 77B.

Further, a one-way clutch 81B opposite to the end to which the gear 81A is mounted. A locking claw 71A, formed by being bent from the frame 71, is engaged with the outer periphery of the one-way clutch 81B. Consequently, the lower roller 81 can be rotated clockwise, but cannot be rotated counterclockwise (in FIG. 35) by the action of the one-way clutch 81B.

A one-way clutch 82A is mounted to an end of the upper roller 82 in the same way as one way clutch 81B is mounted to an end of the lower roller 81. A locking claw 74A, formed by being bent from the arm 74, is engaged with the outer periphery of the one-way clutch 82A. Consequently, the upper roller 82 can be rotated counterclockwise, but cannot be rotated clockwise (in FIG. 35) by the action of the one-way clutch 82A.

Each of the one way clutches 81B and 82A, mounted to the shafts of the upper and lower rollers 82 and 81, are similar and accordingly only one will be described in detail.

Figure 48A:
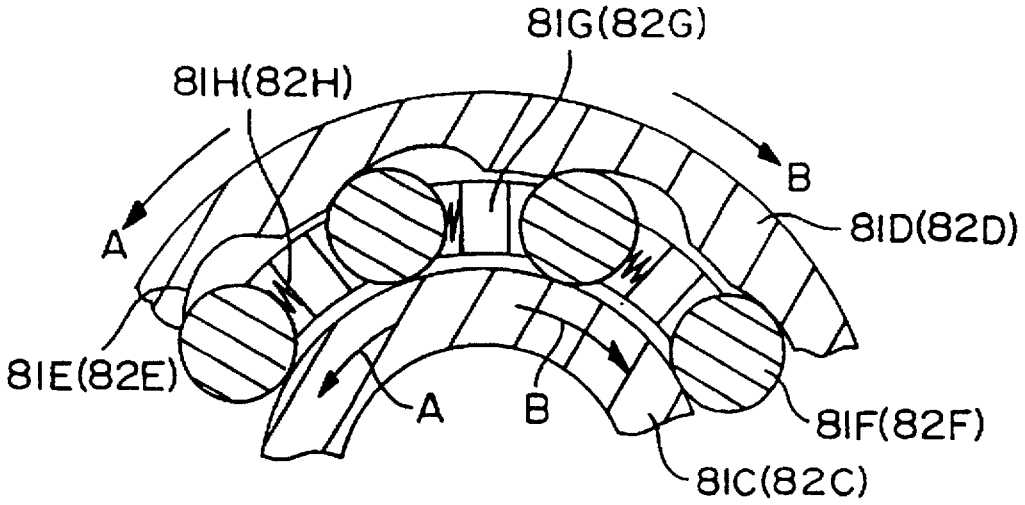
FIGS. 48A and 48B are cross-sectional views of the one-way clutches of the clamper holding rollers.
Figure 48B:
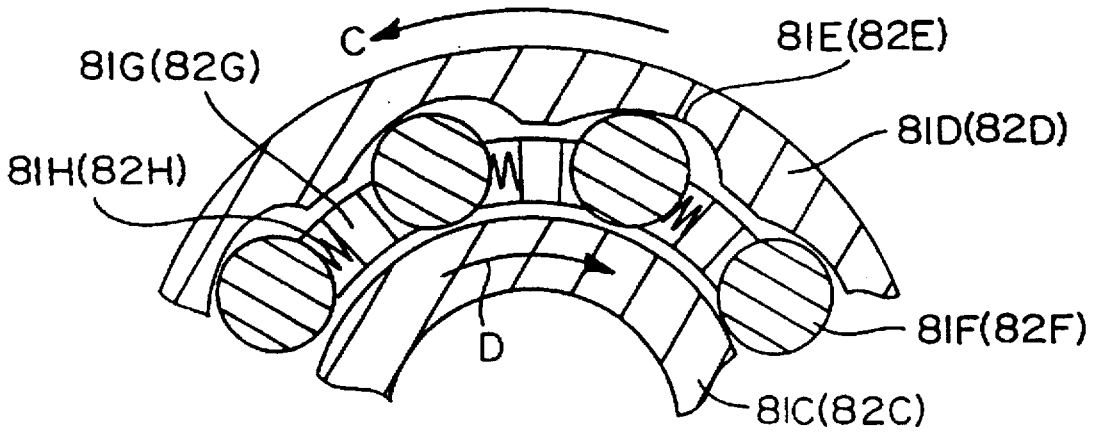

The internal construction of the one-way clutches 81B and 82A are particularly illustrated in detail in FIGS. 48A and 48B. As illustrated therein, an inner ring 81C (82C) is coupled to the upper roller 82 (lower roller 81). Further, an outer ring is provided 81D (82D) and is engaged with the frame 71 (arm 74) via a pawl or locking claw 71A (74A), as shown in FIG. 32. The inner surface of the outer ring is formed with a plurality of circumferentially spaced indentations or recesses 81E (82E) each of which are shaped as shown in FIG. 48A and 48B. Thus, the recesses are shaped to provide a large space at the rightmost portion of the recess and gradually narrow to merge into the inner circumferential surface of the outer ring at the leftmost portion of each recess to provide a narrow space between adjacent recesses. In the spaces between the inner and outer rings, a plurality of rollers 81F (82F) are provided, one roller being positioned within each recess. Each roller is mounted within a roller holder 81G (82G), and a spring 81H (82H) is provided between each roller and roller holder to bias the roller with respect to the holder.

Accordingly, when the outer ring is rotated in a direction B, the rollers are clamped in the smallest or narrowest portion of the recess (i.e. towards the left) between the inner-periphery of the outer ring and the outer-periphery of the inner ring, so that the inner ring is driven in direction B. Similarly, when the inner ring is rotated in direction A, the outer ring is also driven in direction A.

On the other hand, if the outer ring is rotated in direction C as shown in FIG. 48B, as the rollers are positioned in the larger or wider portion of the recess (i.e. toward the right) between the inner-periphery of the outer ring and the outer-periphery of the inner ring, the rollers are driven in direction C, but the inner ring is not driven. Similarly, if the inner ring is rotated in direction D, the outer ring is not driven.

More specifically, the upper and lower rollers 82 and 81 can be rotated in the direction for causing the recording paper to be dragged therebetween from the right side in FIG. 35 (i.e., in the direction for causing the recording paper held therebetween to be fed in the left direction in FIG. 27) and cannot be rotated in the reverse direction.

Holding arms 110 and 120 are fixed to the outer surface of each of the right and left side plates 72. One of the holding arms 110 (on the left side in FIG. 32) has a guide groove 111 opened horizontally in the left direction, while the other holding arm 120 has a guide groove 121 opened downward. The guide shafts 90 are slidingly engaged with both guide grooves 111 and 121 and the clamper 70 is supported by the guide shafts 90 so that it can be moved along the shafts 90.

A locking portion 130 is projected from each of the holding arms 110 and 120 from the side thereof perpendicular to the scanning movement direction of the clamper 70. A movement drive belt 100 functions as an endless timing belt stretched along pulleys (not shown) and has a track parallel with each of the guide shafts 90, and is relatively unmovably fixed to each of the locking portions 130.

Figure 36:
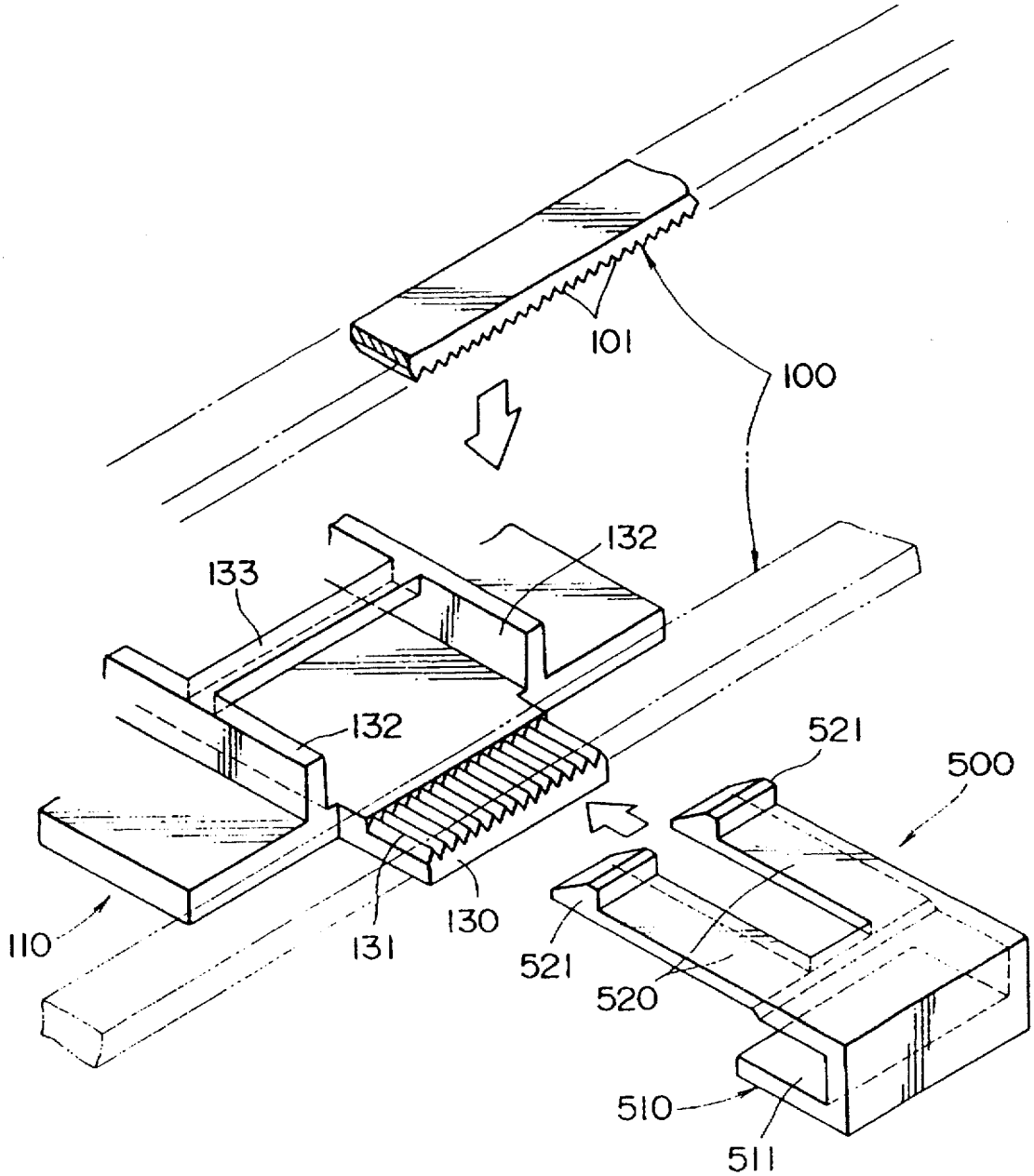
FIG. 36 is an exploded perspective view of one end of the clamper, showing a structure by which the clamper is coupled with a drive belt.

As shown in the perspective view of FIG. 36, one of the locking portions 130 (on the holding arm 110 side) has a rectangular flat surface with a predetermined plate thickness, and is projected to the side direction thereof, so that locking portion 130 has a width that is greater than the width of the movement drive belt 100. The locking portion 130 has rack-shaped teeth 131 formed on the upper surface thereof which are meshed with the teeth 101 formed on the inner periphery of the movement drive belt 100. Ribs 132 are disposed vertically on the upper surface of each of the holding arms 110 and 120 on the side plate 72 side thereof, with respect to the locking portion 130 at intervals slightly larger than the width of the locking portion 130 (the length of the locking portion 130 in the movement direction of the clamper 70). A locking beam 133 is stretched between the ribs 132, 132 in parallel with the moving direction of the clamper 70. A predetermined distance is provided between the lower surface of the locking arm 133 and the upper surface of the holding arms 110 and 120.

As shown in FIG. 36, a clip 500 having the same width as that of the locking portion 130, includes a holding portion 510 with a C-shaped cross section which is defined by slit 511, fork-shaped locking arms 520 extending along the side edges of the holding portion 510. A fold-back claw 521 having an upper surface declining toward the extreme end thereof, projects from the upper surface of the extreme end of each of the locking arms 520. A vertical distance of the slit 511 is set such that the locking portion 130 can be engaged with the slit 511 with a predetermined tolerance in the state that the teeth 131 of the locking portion 130 are meshed with the teeth 101 of the movement drive belt 100. Further, the upper surface of the locking arm 520 is formed such that when the locking portion 130 is inserted into the slit 511 from the outer end side thereof, the upper surface of the locking arm 520 is lower than the lower surface of the locking beam 133 by a predetermined amount. Further, the lower surface of the locking arm 520 is formed such that an interval larger than the height of the fold-back claw 521 is provided between the lower surface of the locking arm 520 and the upper surface of the holding arm 110.

The end surface of the fold-back claw 521 on the holding portion 510 side is formed perpendicularly to the upper surface of the locking arm 520. A position of the end surface of the fold-back claw 521 is set such that when the locking portion 130 is engaged with the innermost portion of the slit 511, from the outer end side thereof, the position is located slightly on the side plate 72 side with respect to the side surface of the locking arm 133 on the side plate 72 (not shown in FIG. 36) side.

With the clip 500 as described above, when the locking portion 130 engaged with the slit 511 from the outer end side thereof, so that the teeth 101 of the movement drive belt 100 are meshed with the teeth of the locking portion 130, the fold-back claws 521 lock to the locking beam 133, and cannot be removed therefrom. More specifically, when the clip 500 is inserted into the locking portion 130 from the outer end side thereof, the fold-back claws 521 interfere with the locking beam 133 and the locking arms 520 are elastically deformed downward. Then, the locking claws 521 advance toward the side plate 72 passing under the locking beam 133, and then the locking arms 520 are returned to an original position by the elastic force thereof. As a result, the fold-back claws 521 are locked to the locking arm 133 so that the end surfaces on the holding portion 510 side of the fold-back claws 521 confront the side surface on the side plate 72 (not shown in FIG. 36) side of the locking beam 133. With this arrangement, the locking portion 130 and movement drive belt 100 are held in the slit 511 of the holding portion 510, so that the locking portion 130 is inseparably meshed with the movement drive belt 100. Consequently, the movement drive belt 100 is relatively unmovably fixed to the clamper 70.

As described above, since the movement drive belt 100 is fixed to the clamper 70 by the engagement of the clips 500 with the clamper 70, the clamper 70 can be very easily coupled with the movement drive belt 100, and thus the workability for assembly and maintenance is greatly improved.

Figure 37:
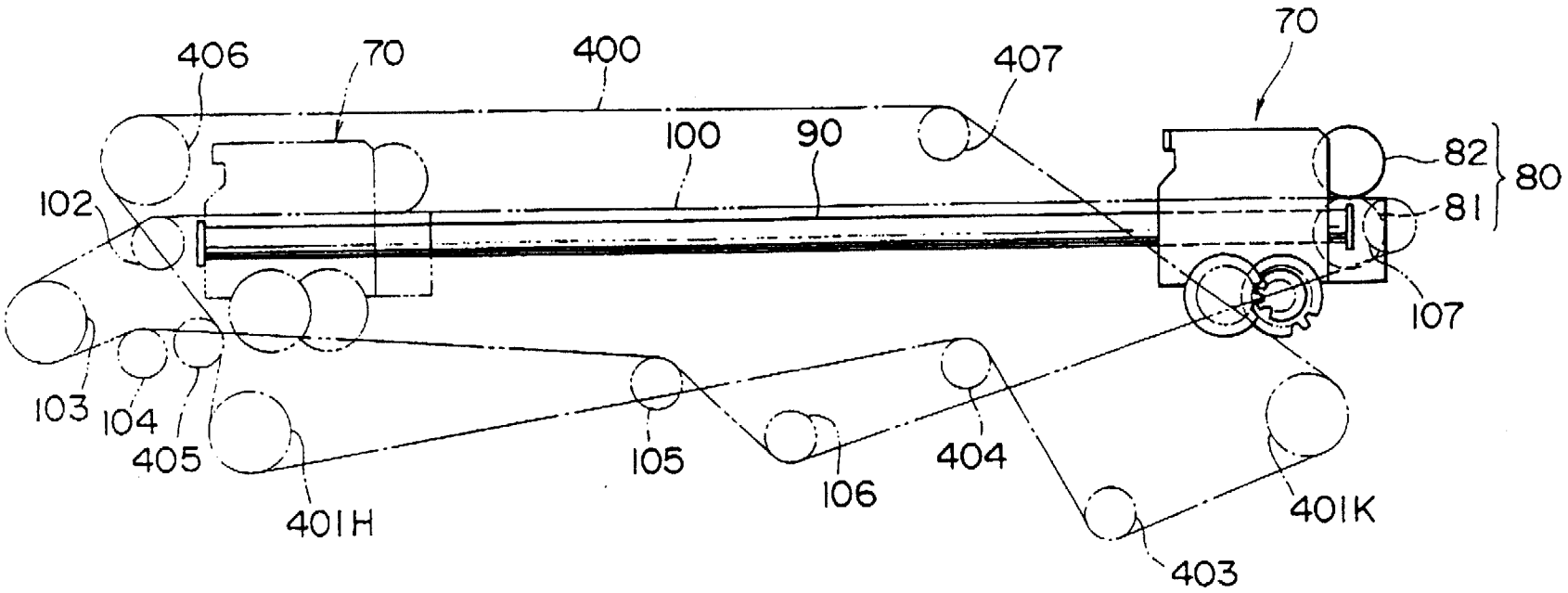
FIG. 37 is a diagram showing a path through which the drive belt is driven.

As described above, the movement drive belt 100 is an endless timing belt stretched along pulleys 102, 103, 104, 105, 106, and 107 so that it has the track parallel with the guide shafts 90 as shown by a two-dot-and-dash line of FIG. 37 showing a drive path.

The pulley 103 is driven by the clamper movement drive motor 70M, and is capable of rotating forward and backward, as shown in the control block diagram of FIG. 5 and FIG. 4 (not shown in FIG. 37). The clamper 70 is moved by a predetermined stroke along the guide shafts 90 by the movement drive belt 100 driven by the rotation of the pulley 103. Therefore, the clamper 70 can be located at the paper feed position, on the right side in FIG. 37, shown by a solid line in the vicinity of the platen roller 34 and thermal transfer head 50; and the paper discharge position, on the left side in FIG. 37, shown by an imaginary line. The clamper movement drive motor 70M is controlled by the control unit 5.

Figure 38:
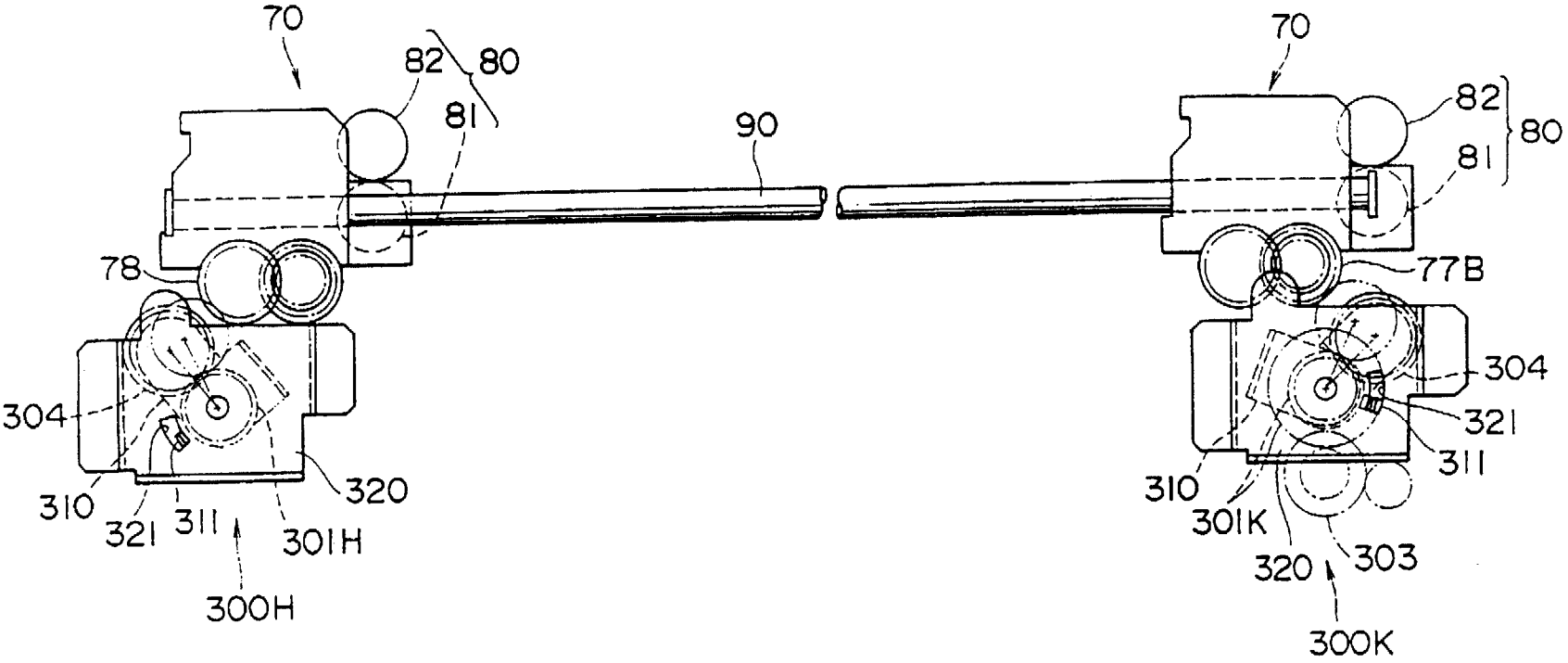
FIG. 38 is a diagram showing the disposition of drive gear boxes for driving the clamper at the paper feed position and a paper discharge position.

As shown in FIG. 38, drive gear boxes 300K and 300H are disposed at the positions of the clamper 70 corresponding to the front and rear ends (paper feed position and paper discharge position) of the stroke of the clamper 70 along the guide shafts 90. The drive gear box 300K is provided with a clamper drive gear 301K and the drive gear box 300H is provided with a clamper drive gear 301H.

As shown in FIG. 37, a pulley 401K is fixed to the shaft of the clamper drive gear 301K and a pulley 401H is fixed to the shaft of the clamper drive gear 301H.

As shown by a dot-dash-line in FIG. 37, the pulleys 401K and 401H are rotated by a rotation drive belt 400 (e.g., an endless timing belt) stretched along these pulleys and pulleys 403, 404, 405, 406, and 407 in synchronism therewith.

Further, a gear 303 mounted to the chassis side plate 1A is meshed with the clamper drive gear 301K of the drive gear box 300K at the paper feed position. The clamper drive gear 301K (i.e., the pulley 401K) is driven in rotation by the rotational force transmitted through the gear 303. Thus, the rotation drive belt 400 is driven by the pulley 401K and the clamper drive gear 301H is rotated synchronously with the clamper drive gear 301K.

The gear 303 is driven by the clamper drive motor 80M, which is capable of rotating forward and backward (shown in the control block diagram of FIG. 5 and FIG. 4) not shown in FIG. 37 and 38). The clamper drive motor 80M is controlled by the controller 5.

Gears 304, which are rotatably mounted to arms 310, supported by the rotation shafts of the clamper drive gears 301K and 301H, are meshed with the clamper drive gears 301K and 301H provided with the drive gear boxes 300K and 300H, respectively. These gears 304, act as so-called planetary gears with respect to the clamper drive gears 301K and 301H.

Figure 39:
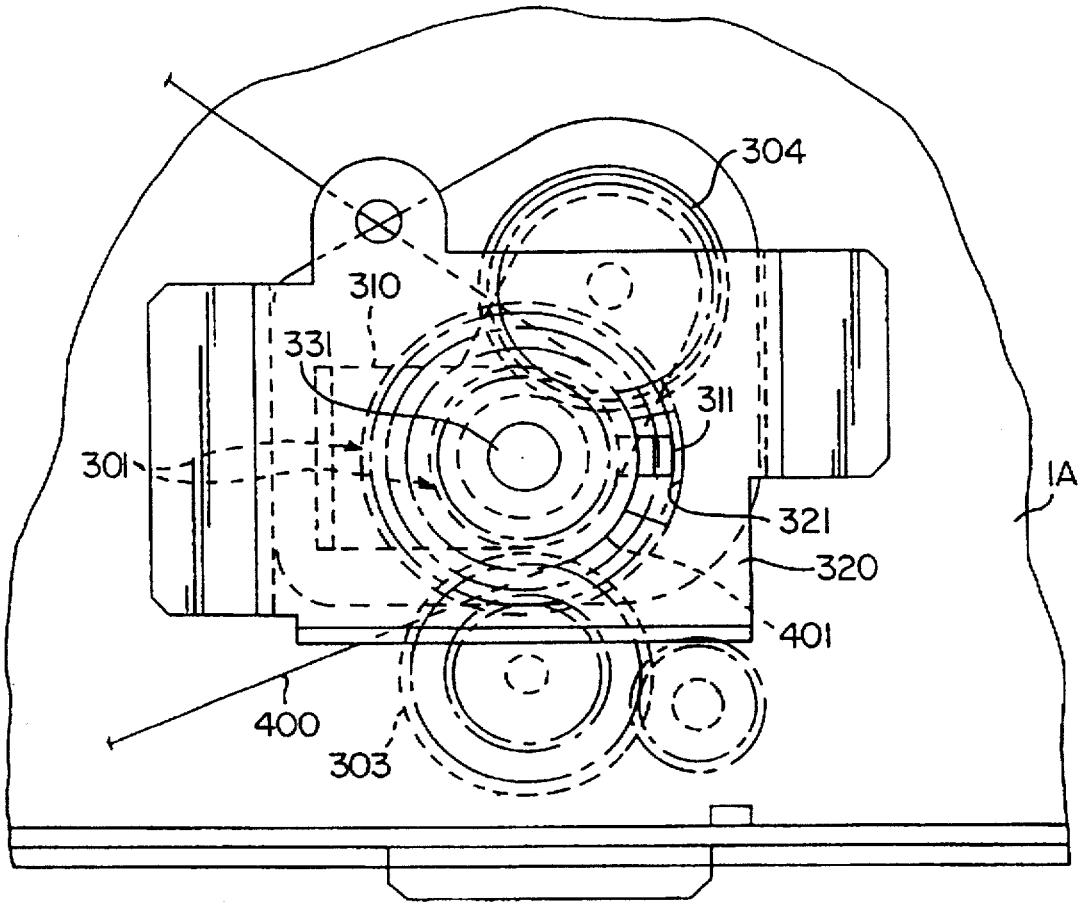
FIG. 39 is a partially enlarged side view of the drive gear box on the paper feed side.
Figure 40:
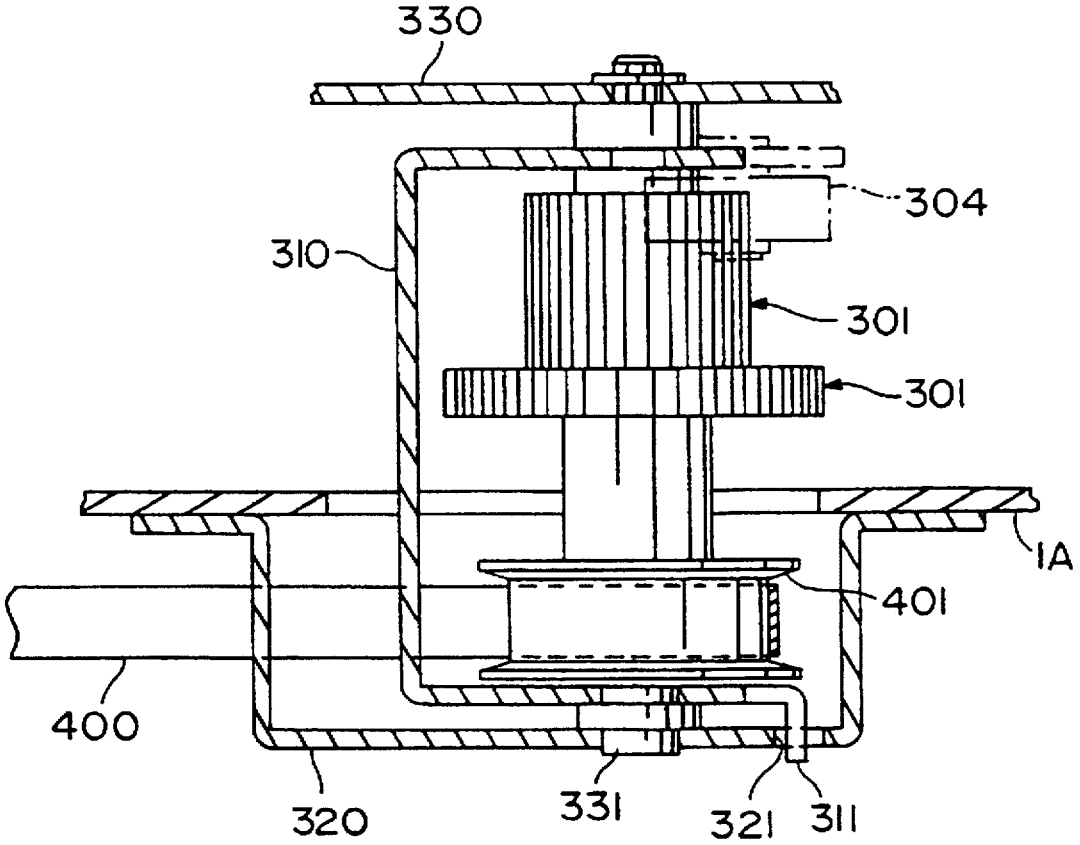
FIG. 40 is a horizontal cross sectional view of FIG. 39.

The drive gear boxes 300K and 300H are substantially symmetrically disposed on the paper feed side and paper discharge side, and thus only drive gear box 300K, on the paper feed side, will be described, with reference to the enlargement of the drive gear box in FIG. 39 and the cross sectional view thereof in FIG. 40.

The clamper drive gear 301K is rotatably supported by a rotation shift 331 supported by a bracket 320 having a hat-shaped flat configuration fixed to the outer surface of the chassis side plate 1A, and a support plate 330 vertically disposed to the base chassis 10.

The pulley 401K is rotatably mounted to the rotation shaft 331 on the bracket 320 side thereof, and thus the pulley 401K is relatively unrotatably coupled with the clamper drive gear 301K.

Further, the arm 310 having substantially a U-shaped cross section is swingably mounted to the rotation shaft 331 such that the pulley 401K is held between a pair of parallel arm portions of the arm 310.

The gear 304 is rotatably supported at the extreme end of the arm portion of the arm 310, located on the device side, and a stopper projection 311 is mounted to the extreme end of the arm portion thereof, located on the opposite side and bent to the outside.

The stopper projection 311 projects to the outside, passing through a swing angle regulation hole 321, defined in the bracket 320, and thus the arm 310 can be swung in the range in which the stopper projection 311 is permitted to move by the swing angle regulation hole 321. More specifically, the swingable range of the arm 310 is regulated by the swing angle regulation hole 321.

The gear 304 is swung in a range, so that when the clamper 70 is located at the paper feed position (on the right side in FIG. 38), the arm 310 is swung to the right side in FIG. 38 and thus the gear 304 is located at a retracting position where it is spaced apart from the stepped gear 77B, of the clamper 70, by a predetermined distance and is not meshed with the stepped gear 77B; and at a position where the arm 810 is swung counterclockwise in FIG. 38 from the retracting position to cause the gear 304 to be meshed with the stepped gear 77B of the clamper 70. Further, when the clamper 70 is located at the paper discharge position (on the left side in FIG. 38), the gear 304 is located at a retracting position and the arm 310 is swung to the left side in FIG. 38; thus the gear 304 is spaced apart from the gear 78 of the clamper 70 by a predetermined distance and is not meshed with the gear 78; and at a position where the arm 310 is swung clockwise in FIG. 38, to cause the gear 304 to be meshed with the gear 78 of the clamper 70.

At least the gear 304, arm 310 and rotation shaft 331 on the paper discharge side are composed of an electrically conductive material, and the gear 304 is grounded to the chassis through the arm 310 and rotation shaft 331. With this arrangement, when the clamper 70 is located at the paper discharge position and the gear 78 in electrical contact with the upper roller 82, is meshed with the gear 304, the upper roller 82 is grounded to the chassis. Thus, any electrostatic potential produced on the recording paper is conducted to the chassis.

Note that the arms 310 on the paper feed side and paper discharge side, are swung and urged to the retracting position side by urging means (not shown). Thus, even if the clamper 70 is located on the paper feed side or paper discharge side, the gear 304, on the paper side or paper discharge side, is not immediately meshed with the stepped gear 77B or the gear 78 of the clamper 70.

When an image is formed, the clamper 70, arranged as described above, operates as follows:

In the wait state shown in FIG. 1, when the recording paper 4, accommodated in the recording paper cassette 2, is introduced into the device 1, and fed by driving the pair of introduction rollers 12 and the pair of feed rollers 31, the clamper 70 is located at the paper feed position.

When the extreme end of the recording paper 4 reaches the pressure contact portion of the upper and lower rollers 82 and 81 of the pair of support rollers 80 of the clamper 70, the clamper drive gear 301K on the paper feed side, is driven in rotation counterclockwise in FIG. 38 by the clamper drive motor 80M. The arm 310 is swung counterclockwise (in FIG. 38) by the rotation of the clamper drive gear 301K, and the gear 304 is meshed with the stepped gear 77B of the clamper 70 to rotate the same. As a result, the lower roller 81 is driven in rotation counterclockwise (in FIG. 38) so that the recording paper 4 is dragged between the pair of holding rollers 80. When a predetermined amount of the recording paper 4 is dragged, the lower roller 81 is stopped, and at this time the extreme end of the recording paper 4 is held between the pair of holding rollers 80 of the clamper 70.

Note, although the clamper drive gear 301H on the paper discharge side is also rotated by the rotation drive belt 400 synchronously therewith at this time, the gear 304, meshed with the clamper drive gear 301H, is not meshed with any other gear and only runs in an idle state. Further, since a swing force, applied to the arm 310 by the above driving operation, has the same counterclockwise direction as that of a swinging and urging action performed by the spring, the arm 310 is not swung.

Thereafter, the thermal transfer head 50 (not shown in FIG. 38) is located at the image transfer position. When the movement drive belt 100 is rotated counterclockwise (in FIG. 37) by driving the clamper movement drive motor 70M (not shown), the recording paper 4 is moved by moving the clamper 70 to the left side in FIG. 37, and thus the image is formed on (transferred onto) the recording paper 4 by the thermal head array 51.

On the completion of the first image transfer process, the clamper 70 (the recording paper 4) is returned to the paper feed position by the rotation of the movement drive belt 100 in the reverse direction (clockwise). Further, the clamper 70 is moved to the left side in FIG. 37, by the counterclockwise rotation (in FIG. 37) of the movement drive belt 100 (the recording paper 4 is moved) and then the next image transfer process is carried out. Thereafter this process is repeated a predetermined number of times.

When the image transfer process has been carried out a predetermined number of times (on the completion of the image transfer of all colors), the clamper 70 is located at the paper discharge position (on the left side in FIG. 38).

Then, the clamper drive gear 301K is driven in the direction opposite to the above direction when the recording paper 4 is fed (clockwise in FIG. 38) by the clamper drive motor 80M. Thus, the movement drive belt 100 is rotated clockwise (in FIG. 37) and the clamper drive gear 301H is driven in rotation clockwise (in FIG. 38). The arm 310 is swung clockwise (in FIG. 38) by the rotation of the clamper drive gear 301H, to cause the gear 304 to be meshed with the gear 78, of the clamper 70, and the lower roller 81, to be rotated counterclockwise (in FIG. 38). As a result, the recording paper 4 held by the pair of holding gears 80, is fed to the paper discharge side (the left side in FIG. 38).

At this time, the upper roller 82 is grounded to the chassis through the gear 78, and the gear 304, on the paper discharge side, and thus even if the recording paper is charged with an electrostatic potential, it is conducted to the chassis and the recording paper is fed without being charged electrostatically.

With the arrangement of the clamper 70 as described above, the recording paper is held, at the extreme end thereof, by the pair of holding rollers composed of the vertically disposed upper and lower rollers 82 and 81 pressed against each other, and scanned by moving the clamper 70. The drive gears (the gears 304), which can be meshed and unmeshed depending upon the swing action of the arm members (the arms 301), are located at the paper feed position and paper discharge position as the scanning stroke end positions of the clamper 70. Consequently, the recording paper can be held and then discharged after the formation of an image by rotating the lower roller 81, of the pair of holding rollers 80. As a result, the arrangement of the imaging device can be simplified, without the need for providing both clamp member and recording paper feed drive members or without transferring the recording paper from the clamp member to the recording paper feed drive member when discharging the recording paper.

Further, the drive gears (the gears 304) at the paper feed position and paper discharge position are meshed with the sun gears (the clamper drive gears 301K and 301H), rotated about the center of swing of the arm members (the arms 310), respectively, and both sun gears are coupled to each other by the coupling member (the rotation drive belt 400) so that they can be rotated synchronously with each other. As a result, both movement and rotation of the drive gears, which are effected by the swing action of the arm members, can be carried out by a single drive system by driving the coupling means by the drive means (the clamper drive motor 80M), and thus the arrangement of the imaging device can be further simplified.

Further, since at least one of the roller members (the upper roller 82) for holding the recording paper is composed of the an electrically conductive material and grounded, an electrostatic potential produced to the recording paper due to friction, is conducted on the ground. Therefore, problems that arise when the recording paper to which an image has been formed is attracted to the paper discharge path by an electrostatic potential and therefore not discharged well, or an electrostatic potential is discharged from a discharged recording paper at the moment that a user holds the paper, can be prevented.

Next, a structure of the ink ribbon cassette 60, ink ribbon winding structure, and control of the ink ribbon effected when an image is formed, will be described below.

Figure 41:
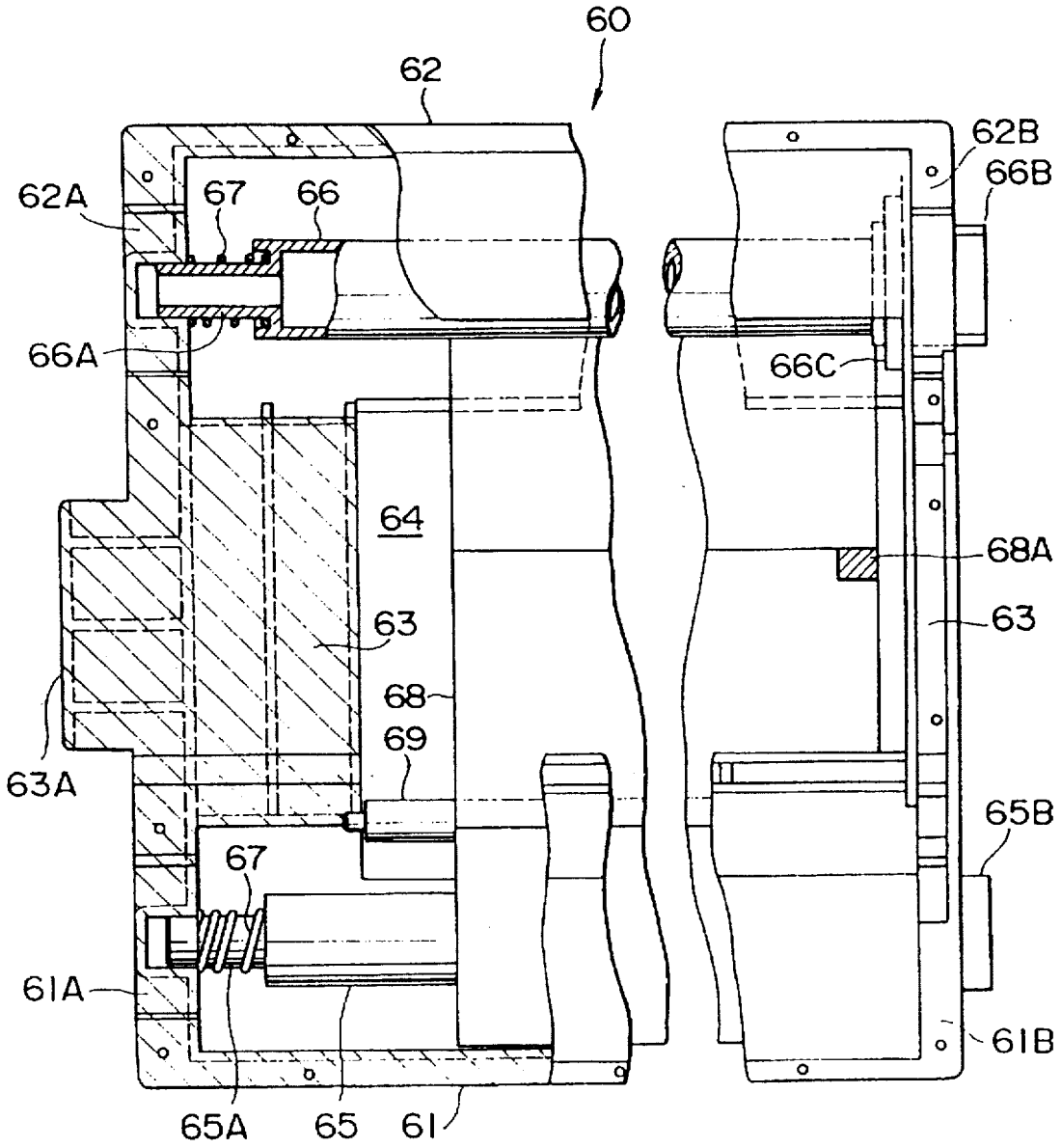
FIG. 41 is a plan view, partially in cross section, of an ink ribbon cassette.
Figure 42:
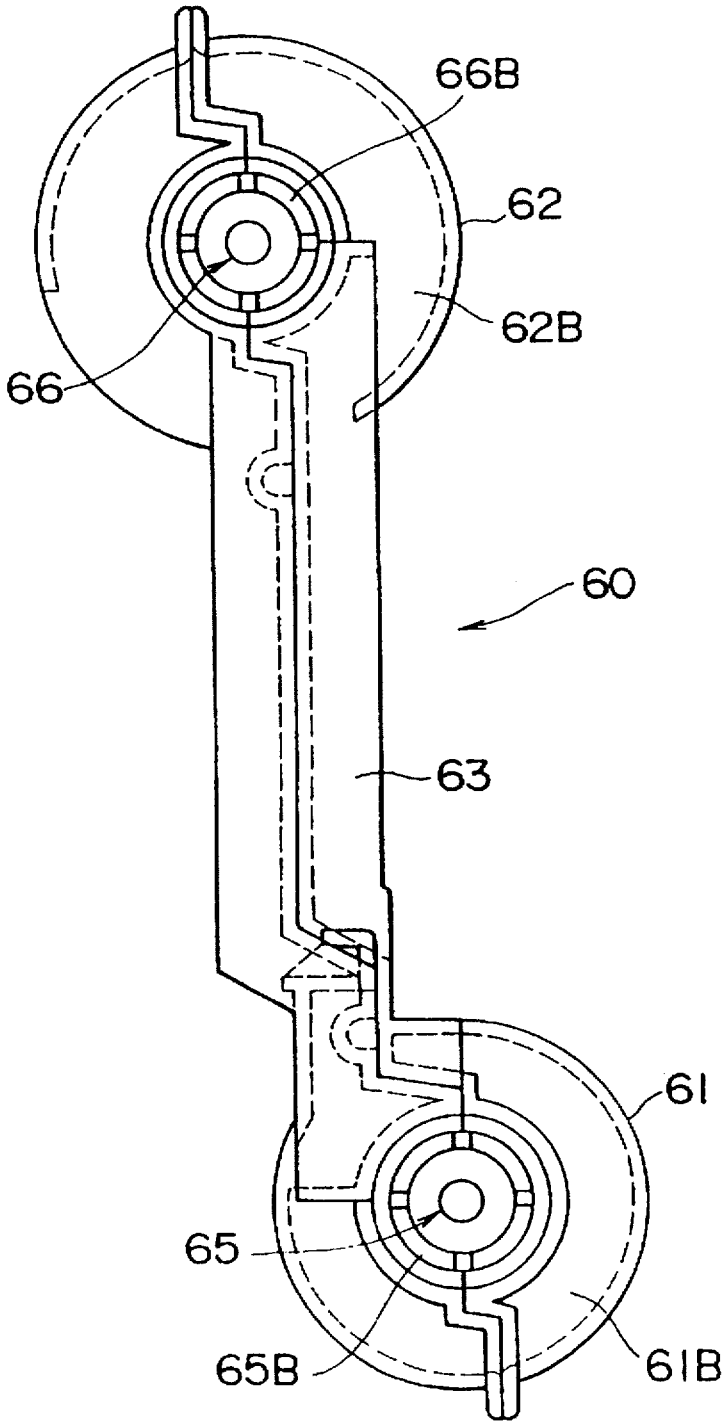
FIG. 42 is a right side view of the ink ribbon cassette of FIG. 41.
Figure 43:
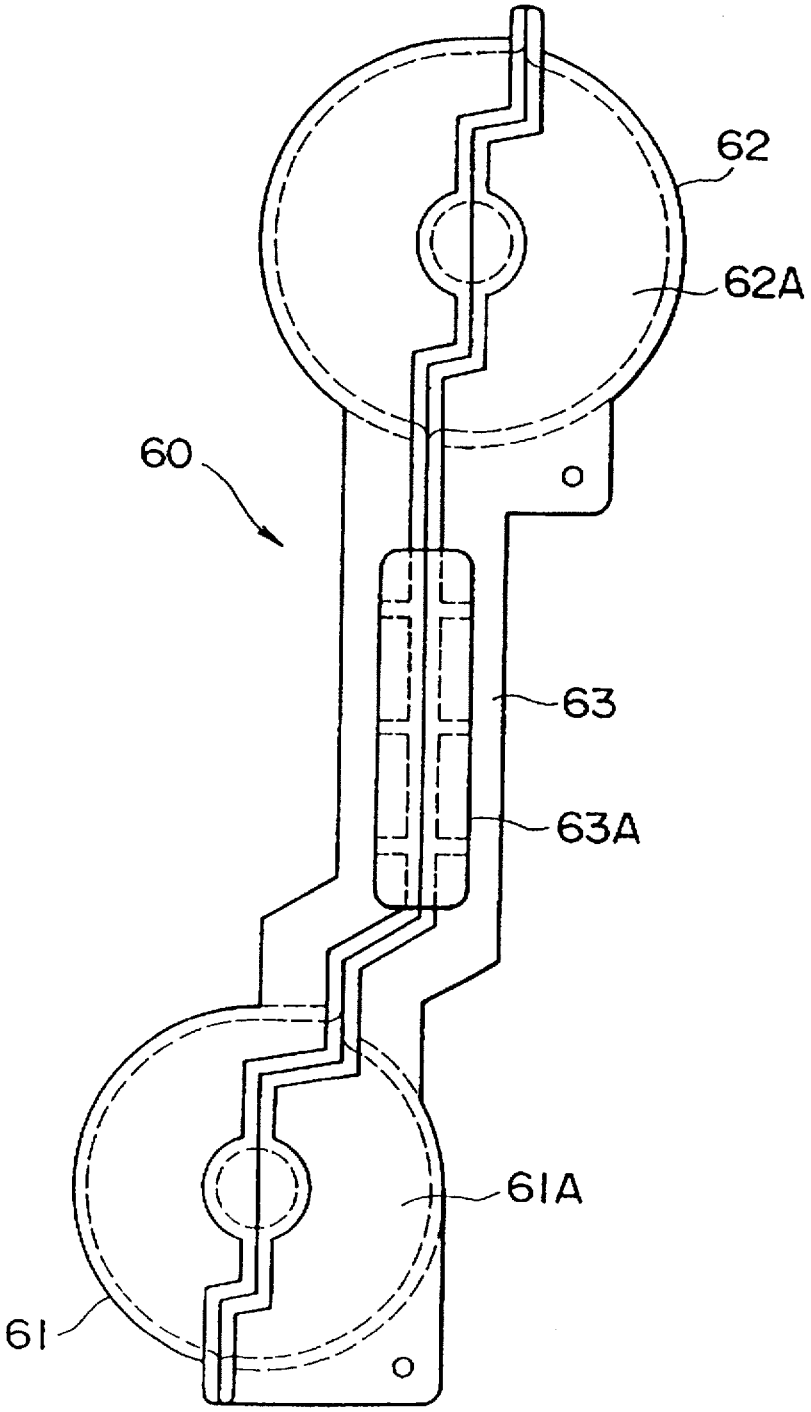
FIG. 43 is a left side view of the ink ribbon cassette of FIG. 41.

As shown in the plan view, partially in cross section, of FIG. 41, right side view of FIG. 42, and left side view of FIG. 43, the ink ribbon cassette 60, having a rectangular configuration comprises two cylindrical reel cases 61 and 62, spaced apart by a predetermined distance; and connection side plates 63 for connecting the opposite ends of the cylindrical reel cases 61 and 62 with an opening 64 formed at the center of the ink ribbon cassette 60, thereby being surrounded by these components. Central opening 64 has a width larger than the width of the thermal transfer head 50 (in the longitudinal direction thereof) so that the thermal transfer head 50 can be inserted into the opening 64, when the ink ribbon cassette 60 is mounted to a predetermined position of the imaging device 1. Further, a holding portion 63A is projected from one of the connection side plates 63, for holding the ink ribbon cassette 60 when it is mounted and dismounted.

Each of the portions of the reel cases 61 and 62, facing to the opening 64, is opened. A supply side ink ribbon reel 65 is rotatably disposed in one of the reel cases 61 and a winding side ink ribbon reel 66 is rotatably disposed in the other reel case 62.

The supply side ink ribbon reel 65 and winding side ink ribbon reel 66 have small diameter portions 65A, 66A at one end thereof, and cylindrical engagement portions 65B, 66B at the other end thereof, respectively. Each of the cylindrical engagement portions 65B, 66B has a plurality of engagement grooves defined at equal intervals on the inner periphery thereof. The ink ribbon reels 65, 66 are mounted to the reel cases 61, 62, in such a manner that the small diameter portions 65A, 66A of the ink ribbon reels 65, 66 are axially, slidingly, movably engaged with the side plates 61A, 62A, closing the side ends of the reel cases 61, 62; and the small diameter portions 65A, 66A are pressed and urged against the other ends thereof by springs 67, interposed between the inner surfaces of the side plates 61A, 62A, and the stepped portions of the small diameter portions 65A, 66A. The movement of the ink ribbon reels 65, 66, caused by the pressing and urging force of the springs 67, is regulated by collar-shaped large diameter portions 66C projecting to the other ends of the ink ribbon reels 65, 66 (not shown in the supply side ink ribbon reel 65) abutted against the inner surfaces of the side plates 61B, 62B on the other ends. In this state, the engagement portions 65B, 66B pass through the side plates 61B, 62B, and project to the outside by a predetermined amount.

The ink ribbon 68, having an extreme end fixed to the winding side ink ribbon reel 66, is wound around the supply side ink ribbon reel 65, and the entire region of the opening 64, of the ink ribbon cassette 60, is closed by the ink ribbon 68.

Further, a guide roller 69 is rotatably disposed on the opening 64 side of the reel case 61, on the supply side ink ribbon reel 65 side, at a position adjacent to the outer periphery of the ink ribbon 68, wound around the supply side ink ribbon reel 65 to the maximum amount thereof. Further, a regulation member 61C (FIG. 46) is integrally formed with the reel case 61 and located in the vicinity of the guide roller 69 on the winding side ink ribbon reel 66 side thereof, to flatly regulate a part of the path of the ink ribbon 68.

Figure 44:
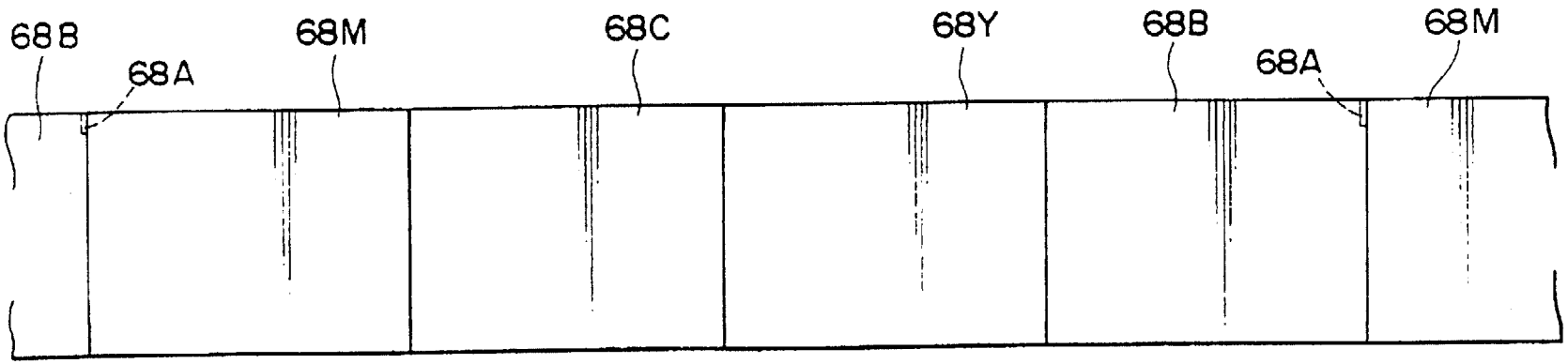
FIG. 44 is a partial plan view of an ink ribbon.

As shown in the partial plan view of FIG. 44, the ink ribbon 68 includes a plurality of sets of ribbons 68 having different colors to be transferred (magenta 68M, cyan 68C, yellow 68Y and black 68B) and connected in the sequence of printing. Each set of ribbons is used for transferring the colors to a single paper (one page). An aluminum foil marking 68A is disposed at the extreme end of the ribbon having the color to be transferred first (e.g. magenta 68M) and located at an end in the width direction of the ribbon.

As shown in the side view of the chassis of the imaging device 1 in FIG. 3, the ink ribbon cassette 60, arranged as described above, is inserted into the imaging device 1 through an opening 1B, defined in the chassis side plate 1A of this side in FIG. 1. The opening 1B has a configuration corresponding to the side surface of the cassette 60. At this time, the ink ribbon cassette 60 is inserted into the opening 1 from the side thereof projecting with the engagement portions 65B, 65B of the supply side and winding side ink ribbon reels 65 and 66. As a result, the supply side ink ribbon reel 65 is located below the thermal transfer head 50, and the winding ink ribbon reel 66 is located substantially symmetrically to the supply side ink ribbon reel 65 with respect to the platen roller 34.

Figure 45:
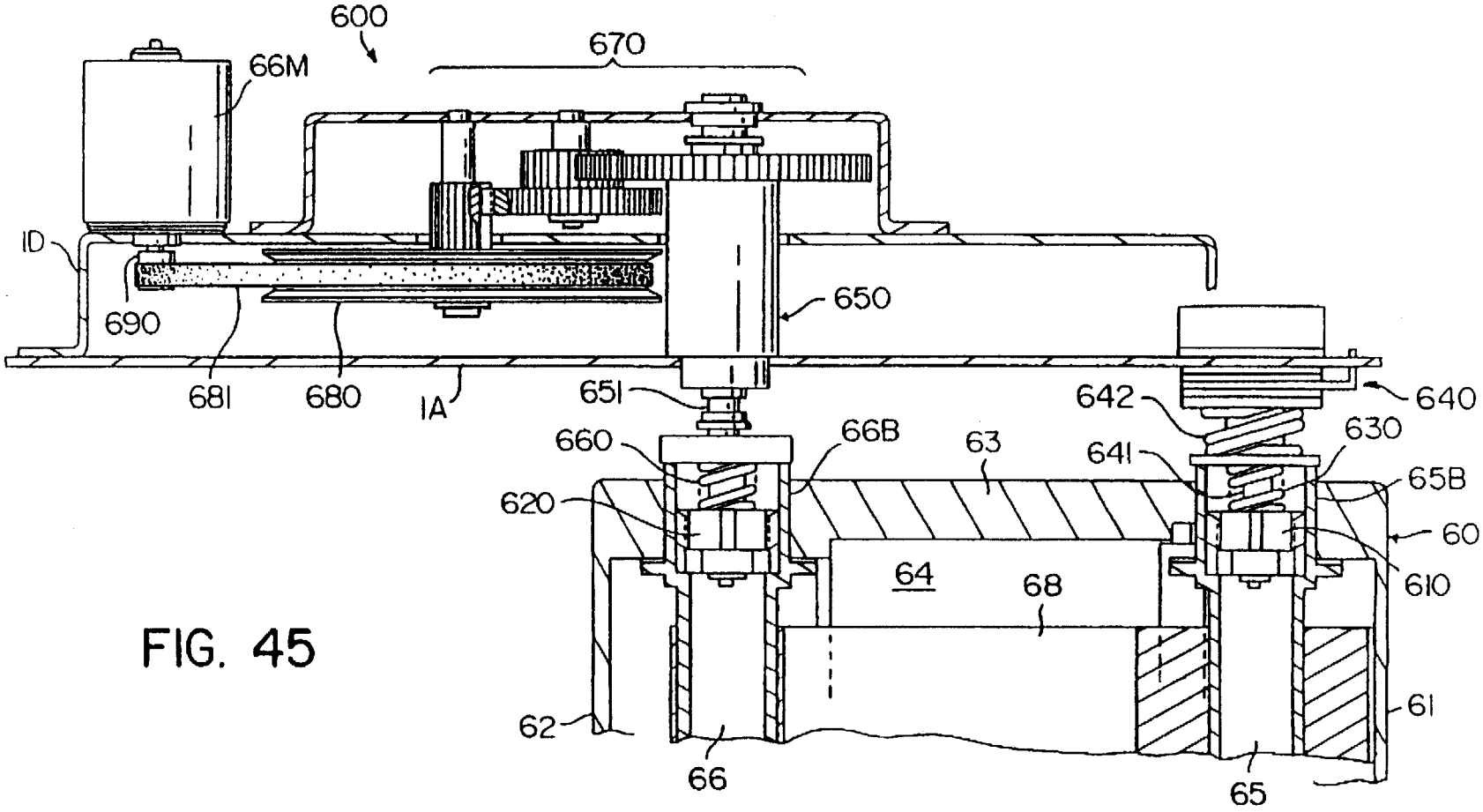
FIG. 45 is a plan view, partially in cross section, of an ink ribbon cassette mounting portion.
Figure 46:
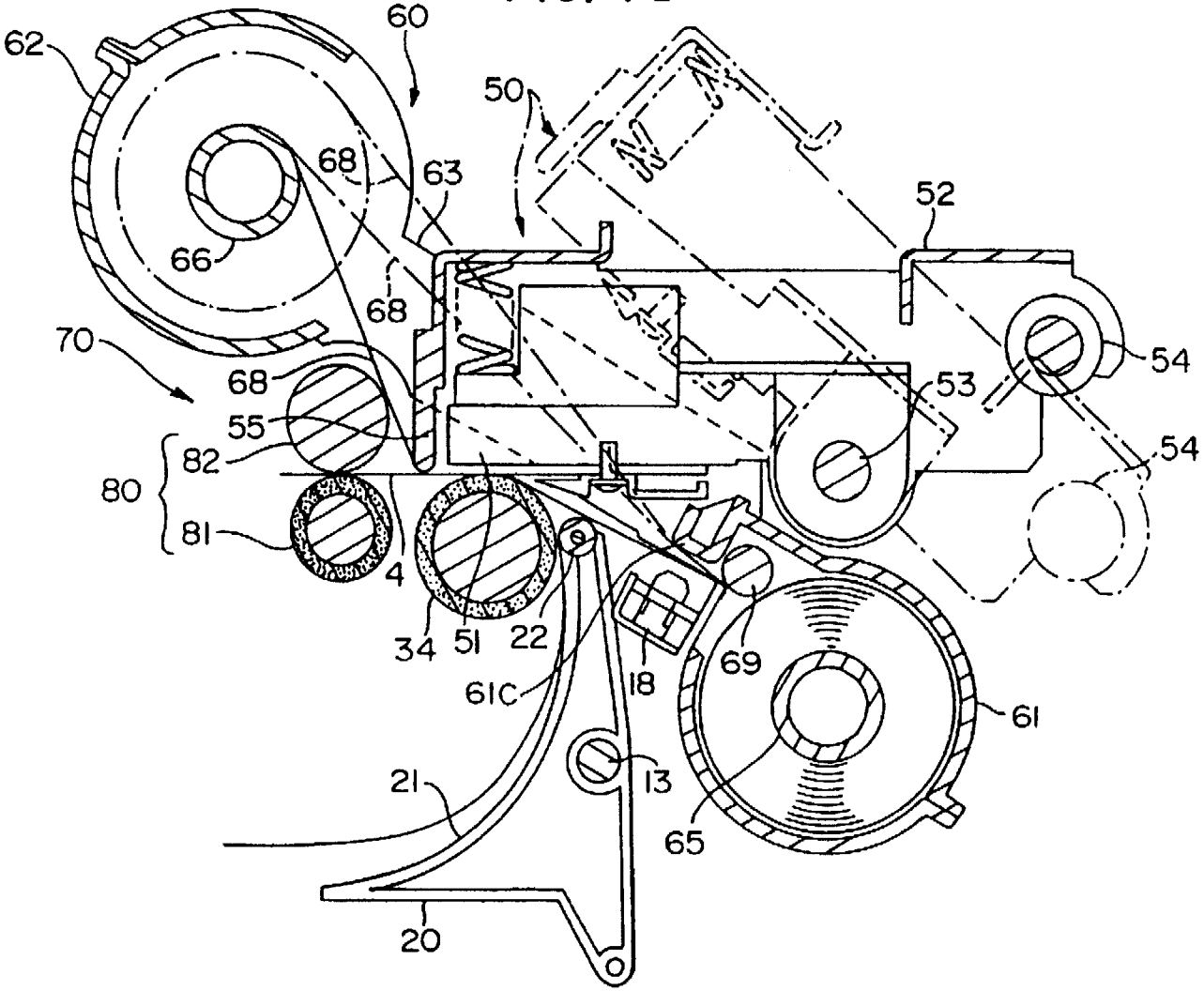
FIG. 46 is a partially enlarged side view showing the positional relationship between the thermal transfer head and the ink ribbon.

Further, as shown in the partial cross sectional view of an ink ribbon supply drive mechanism and the ink ribbon cassette 60 in FIG. 45, the ink ribbon supply drive mechanism 600 is mounted to the chassis side plate 1A, of the imaging device 1, on the side corresponding to the engagement portions 65B and 66B of the ink ribbon reels 65 and 66. Further, as shown in FIG. 46, a reflection type photo sensor 18 is disposed below the regulation member 61C, for the ink ribbon cassette 60, mounted at a predetermined position in confrontation with the side end of the regulation member 61C on the main body side of the imaging device 1. The marking 68A at the extreme end of the ink ribbon 68, having the color to be transferred first, can be sensed by the photo sensor 18.

The ink ribbon supply drive mechanism 600 has engagement sprockets 610 and 620, located at the positions corresponding to the engagement portions 65B and 66B, of the ink ribbon reels 65 and 66, of the ink ribbon cassette 60, mounted to the predetermined position. The engagement sprockets 610 and 620 are inserted into the engagement portions 65B and 66B, and relatively unrotatably engaged therewith, through the vertical ridges formed around the outer periphery of the sprockets in correspondence with the engagement grooves of the engagement portions 65B and 66B. Note that the sprocket 610 can be rotated by driving the sprocket 620.

The engagement sprocket 610, corresponding to the supply side ink ribbon reel 65, is mounted to the shaft 641 of a friction resistance member 640, fixed to the chassis side plate 1A, in such a manner that it cannot be relatively rotated with the shaft 641, and can slidingly move in the axial direction of the shaft 641 by a predetermined amount. Further, the engagement sprocket 610 is pressed and urged against the inner side of the device (i.e., against the ink ribbon cassette 60 side) by a spring 630 interposed between the sprocket 610 and the inner surface of the chassis side plate 1A.

Figure 49:
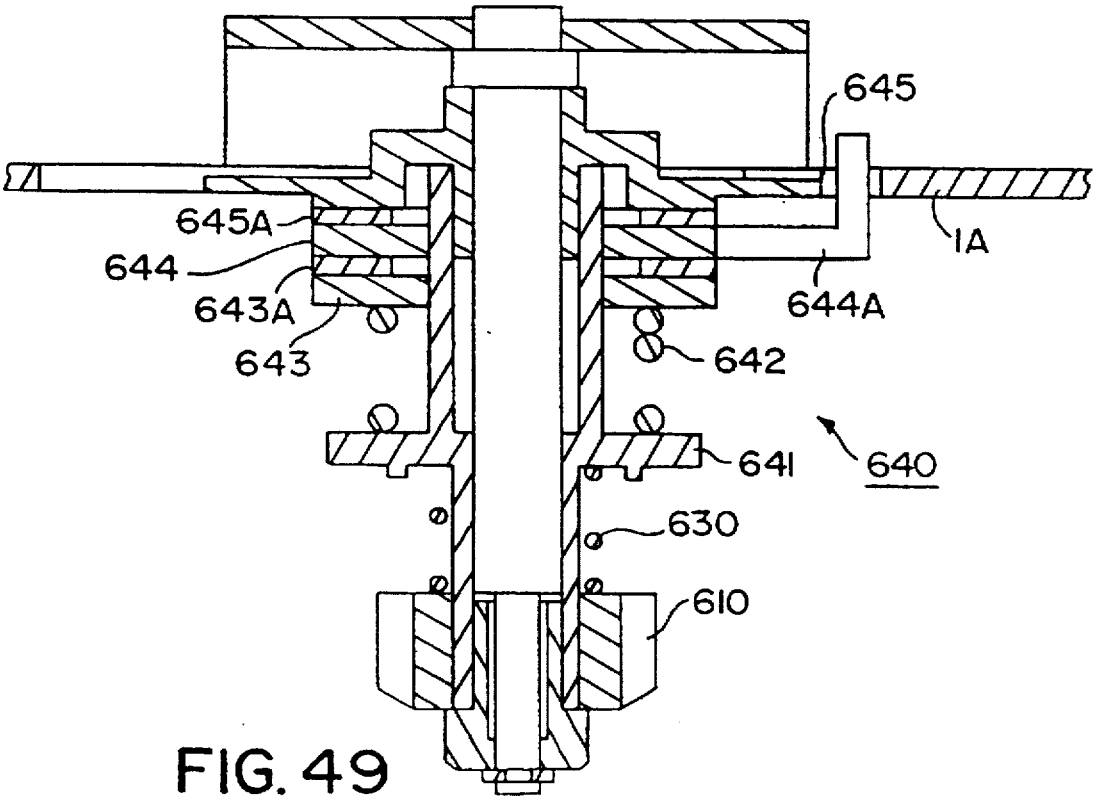
FIG. 49 is a cross-sectional view of the ink ribbon friction resistance member.

The friction resistance member 640 is shown in cross-section in FIG. 49. The frictional resistance member 640 includes a plurality of friction plates or discs 643, 644 and 645. To each of discs 643 and 645, along a planar side surface, frictional members 643A and 645A are adhered, such that the frictional members and friction discs are alternately disposed. The friction disc 644 engages the chassis 1A by means of a hook portion 644A. Thus, the friction disc 644 cannot rotate relative to the chassis, but can rotate relative to the shaft 641. A spring 642 is provided between a flange of the shaft 641 and the friction disc 643, and serves to bias the discs 643, 644, 645 into pressure engagement with each other, with the frictional members 643A, 645A interposed therebetween. Thus, the spring 642 applies a predetermined resistance to the rotation of the shaft (i.e. and of the engagement sprocket 610) due to the frictional resistance of the abutting friction discs and frictional members.

The engagement sprocket 620, corresponding to the winding side ink ribbon reel 66, is mounted to the shaft 651, of a friction clutch 650, fixed to the chassis side plate 1A in such a manner that it cannot be relatively rotated with the shaft 651, and can slidingly move in the axial direction of the shaft 651 by a predetermined amount. Further, the engagement sprocket 620 is pressed and urged against the inner side of the device (i.e., against the ink ribbon cassette 60 side) by a spring 660 interposed between the sprocket 620 and the inner surface of the chassis side plate 1A.

The ink ribbon friction clutch 650 is shown in detail in FIG. 50 and includes an outer ring 650A to which, on the inner peripheral surface, a cylindrical permanent magnet 650B is secured. Further, a cylindrical permanent magnet 651A is secured to the outer peripheral surface of the shaft 651 so that a space is provided between magnets 650B and 651A. The space is filled with magnetic power 650C which provides a predetermined resistance to rotation between the shaft 651 and the outer ring 650A.

The friction clutch 650 operates such that the outer ring thereof 650A is rotated together with the shaft 651, up to a predetermined torque value to transmit a rotational force. When a transmitted torque exceeds the predetermined value, the outer ring and shaft 651 run idly (are relatively rotated), so that no rotational force is transmitted. The outer ring of the friction clutch 650 is coupled through a gear train 670 with a pulley 680 rotatably supported by the chassis side plate 1A.

This pulley 680 is coupled through a belt 681 with a pulley 690 fixed to the spindle of an ink ribbon reel winding drive motor 66M, fixed to the chassis side plate 1A through a metal bracket 1D.

With this arrangement, when the ink ribbon reel winding drive motor 66M is driven, the engagement sprocket 620 is driven in rotation through the belt 681, pulley 680, gear train 670 and friction clutch 650.

Note, when the ink ribbon 68 is not wound around the winding side ink ribbon reel 66 at all, the engagement sprocket 620 is rotated by the ink ribbon reel winding drive motor 66M at a rotational speed so that the ink ribbon 68 can be wound at a speed slightly higher than a scanning/movement speed of a recording paper to be described below.

With the above arrangement, the winding side ink ribbon reel 66 of the ink ribbon cassette 60 mounted to the predetermined position of the imaging device 1 is driven in rotation by the ink ribbon reel winding drive motor 66M through the friction clutch 650. Therefore, the ink ribbon 68 wound around the supply side ink ribbon reel 66 is wound by the winding side ink ribbon reel 66. At this time, a predetermined tension is applied to the friction clutch 650 by the friction resistance member 640. Further, if the movement of the ink ribbon 68 is regulated by any reason, the ink ribbon 68 is stopped by the action of the ink ribbon 68.

As shown by a solid line in FIG. 46, when an image is formed with the thermal transfer head 50 located at the image transfer position, the extreme end of the thermal transfer head 50 on the thermal head array 51 side thereof enters the opening 64 of the ink ribbon cassette 60. Thus, the ink ribbon 68 is pressed against the platen roller 34 side by the ink ribbon press member 55, provided at the extreme end of the thermal transfer head 50, so that the pass of the ink ribbon 68 is regulated. Further, at this time, the ink ribbon 68 is held between the thermal head array 51 and the platen roller 34.

When an image is formed, the following operation is carried out.

First, in the wait state, shown by an imaginary line in FIG. 46, the winding side ink ribbon reel 66 of the ink ribbon cassette 60 is driven in rotation by the drive motor to wind the ink ribbon 68, wound around the supply side ink ribbon reel 65, around the winding side ink ribbon reel 66. The photo sensor 18 senses the marking 68A, at the extreme end of the ribbon having the color to be transferred first, and then the ink ribbon 68 is wound by a predetermined amount. Then, when the thermal transfer head 50 is swung and located at the image transfer position where the thermal head array 51 is pressed against the platen roller 34, the winding of the ink ribbon 68 is stopped, so that the extreme end of the ribbon having the color to be transferred first confronts the portion where the thermal head array 51 is pressed against the platen roller 34.

The extreme end of a recording paper is supported by the clamper 70, and then the thermal transfer head 50 is moved to the image transfer position as shown by the solid line in FIG. 46; the ink ribbon 68 is placed on the recording paper 4 (the recording paper 4 is located on the platen roller 34 side and the ink ribbon 68 is located on the thermal head array 51 side) and the ink ribbon 68 and recording paper 4 are held between the platen roller 34 and the thermal head array 51; the recording paper 4 is moved by the clamper 70; the ink ribbon 68 is wound by driving the ink ribbon drive mechanism 90 simultaneously with the movement of the recording paper 4; and, as a result, the image is formed (transferred) on the recording paper 4 by the thermal head array 51.

Although the ink ribbon 68 is wound at a speed higher than the scanning/movement speed of the recording paper 4 as described above, the ink ribbon 4 cannot be wound at this winding speed because the recording paper 4 being scanned and moved at the speed slower than the winding speed of the ink ribbon 68 acts as a resistance to the ink ribbon 68. Thus, the ink ribbon 68 is wound following to the movement of the recording paper 4 by the action of the friction clutch provided with the drive system between the ink ribbon reel winding drive motor 66M and the winding side ink ribbon reel 66.

The image transfer process is carried out four times for magenta, cyan, yellow and black, as described above, by the following sequence. On the completion of a first image transfer process, the recording paper 4 is returned to the paper feed position; the ink ribbon 68 is wound by a predetermined amount so that a ribbon having a color for forming the next image confronts the position where an image is formed; and the next image transfer process is started. Thereafter, this process is carried out a plurality of times.

According to the ink ribbon cassette arranged as described above, the recording head (the thermal head array 51) can press the ink ribbon 68 against the platen roller 34 through the central opening 64, and thus the ink ribbon, which is as wide as the recording paper on which an image is to be formed, can be moved in the state that it is held between the platen roller and the recording head, together with the recording paper. Further, the ink ribbon can be easily replaced.

Further, according to the aforesaid ink ribbon winding structure, since the winding side ink ribbon reel 66 is arranged to be rotated through the friction clutch 650 which runs idly at a torque larger than a predetermined value, the ink ribbon is wound following to the movement of the recording paper by the action of the friction clutch, the ink ribbon is wound synchronously with the scanning/movement of the recording paper. With this arrangement, problems of excessive slack or tension in ink ribbon can be prevented, without the need to control the ink ribbon winding speed with a pinpoint accuracy.

The present disclosure relates to subject matters contained in Japanese Application Nos. HEI 3-244744 filed on Aug. 30, 1991; HEI 3-308420 filed on Oct. 28, 1991; HEI 3-308421 filed on Oct. 28, 1991; HEI 3-308422 filed on Oct. 28, 1991; HEI 3-308423 filed on Oct. 28, 1991; HEI 3-331239 filed on Nov. 20, 1991; HEI 3-331242 filed on Nov. 20, 1991; HEI 3-351006 filed on Dec. 11, 1991; HEI 3-351007 filed on Dec. 11, 1991; HEI 3-352004 filed on Dec. 13, 1991; HEI 3-353808 filed on Dec. 18, 1991; HEI 3-353809 filed on Dec. 18, 1991; HEI 3-353810 filed on Dec. 18, 1991 and HEI 3-353811 filed on Dec. 18, 1991, which are expressly incorporated herein by reference in their entireties.

What is claimed is:

1. An imaging device for forming an image on a recording paper held by a movable recording paper holding means by moving the recording paper between a platen roller and a recording head disposed in close proximity to the platen roller by the movement of the recording paper holding means;

wherein said recording head is supported by a head support member swung by a cam member mounted to a rotation shaft; said head member capable of being located at an image forming position in close proximity to said platen roller; and at a paper feed position slightly spaced apart from said platen roller by said head support member swung by the rotation of said cam member;

wherein, when said recording paper is held by said recording paper holding means and fed, said recording head is located at said paper feed position and said recording paper is fed between said platen roller and said recording head, said movable recording paper holding means comprising:

a coupling structure for coupling a timing belt with a moving member moved by the timing belt, wherein:

said moving member has teeth formed thereon and said timing belt has teeth adapted to mesh with said teeth of said moving member, and said moving member is inseparably fixed to said timing belt when said teeth of said timing belt are meshed with said teeth of said moving member by a locking member having a holding portion for prohibiting said moving member from separating from said timing belt, so that said teeth of said timing belt are meshed with said teeth of said moving member, and having an engagement portion for engaging said moving member so that said moving member is prohibited from being separated from said timing belt by said holding member.

2. The imaging device according to claim 1, wherein:

said teeth of said moving member are formed perpendicular to the moving direction of said moving member on a plate-shaped projected arm portion on the side surface of said moving member, said holding portion of said locking member comprises a C-shaped cross section and is insertable to the outside of said moving member from a side portion of said moving member, so that said timing belt is meshed with the teeth of said moving member and holds said moving member and said timing belt, in the thickness direction of said timing belt, said engagement portion of said locking member comprising engagement projections having locking surfaces defined at distal ends of the arm portions extending from the open side end of said holding portion, said locking surfaces defined perpendicularly to the direction in which said arm portions are extended and wherein engagement step portions to be engaged with said engagement projections are defined on said movement member.

3. The imaging device according to claim 1, wherein said coupling structure couples said moving member with said timing belt, so that said moving member is moved along a guide member by the rotational movement of said timing belt, said timing belt having a rotational movement track disposed in parallel with said guide member.

4. An imaging device for forming an image on a recording paper held by a movable recording paper holding means by moving the recording paper between a platen roller and a recording head disposed in close proximity to the platen roller by the movement of the recording paper holding means;

wherein said recording head is supported by a head support member swung by a first cam member mounted to a rotation shaft; said head member capable of being located at an image forming position in close proximity to said platen roller; and at a paper feed position slightly spaced apart from said platen roller by said head support member swung by the rotation of said first cam member;

wherein, when said recording paper is held by said recording paper holding means and fed, said recording head is located at said paper feed position and said recording paper is fed between said platen roller and said recording head; and further comprising:

a pinch roller pressure contact structure wherein a pinch roller is pressed against said platen roller and said recording paper is fed to said recording paper holding means by the rotation of the pinch roller while said recording paper is held between the platen roller and the pinch roller, wherein said pinch roller is supported by an arm member swung by a second cam member, a force by which said pinch roller is pressed against said platen roller being changed by swinging said arm member so that said force is reduced except when said recording paper is fed to said recording paper holding means.

5. The imaging device according to claim 4, wherein said second cam member is mounted to a rotation shaft and said arm member is swung by rotation of said rotation shaft.

6. The imaging device according to claim 5, wherein:

said pinch roller is supported at one end of a swingably supported support arm, a cam follower is mounted to an end of said arm member corresponding to said second cam member; and a remaining end of said support arm is coupled with a remaining end of said arm member by a spring; and said support arm is swung and urged to cause said pinch roller to be pressed against said platen roller, and said arm member is swung and urged to cause said cam follower to be pressed against said second cam member, respectively, by the urging force of said spring.

7. The imaging device according to claim 6, wherein said second cam member is formed in two stages, said two stages having a large diameter and small diameter, respectively, to change said force by which said pinch roller is pressed against said platen roller between a weak force and a strong force.

8. The imaging device according to claim 7, wherein a positional change of said recording head is synchronized with a change of the force pressing said pinch roller against said platen roller, when said recording paper is held by said recording paper holding means and fed by said platen roller and said pinch roller, said recording head is spaced apart from said platen roller and said pinch roller is pressed against said platen roller with said strong force, and when said recording paper is not fed by said platen roller and said pinch roller, said pinch roller is pressed against said platen roller with said weak force.

9. An imaging device for forming an image on a recording paper held by a movable recording paper holding means by moving the recording paper between a platen roller and a recording head disposed in close proximity to the platen roller by the movement of the recording paper holding means;

wherein said recording head is supported by a head support member swung by a cam member mounted to a rotation shaft; said head member capable of being located at an image forming position in close proximity to said platen roller; and at a paper feed position slightly spaced apart from said platen roller by said head support member swung by the rotation of said cam member;

wherein, when said recording paper is held by said recording paper holding means and fed, said recording head is located at said paper feed position and said recording paper is fed between said platen roller and said recording head; and further comprising:

a pinch roller pressed against said platen roller wherein said recording paper is drawn between said platen roller and said pinch roller by the rotation of said platen roller to feed the recording paper to a position where said recording paper is held by said recording paper holding means;

a friction clutch running in an idle state when a torque having a value greater than a predetermined value is applied to said friction clutch, and disposed in a transmission system between a drive for driving said platen roller and said platen roller, wherein, when said recording paper is scanned and moved by said recording paper holding means, said platen roller is rotated synchronously with the movement of said recording paper by the action of said friction clutch, and applies a resistance to the movement of said recording paper.

10. The imaging device according to claim 9, wherein said recording head is capable of being located at said image forming position in close proximity to said platen roller, said paper feed position slightly spaced apart from said platen roller, and a retracting position greatly spaced apart from said platen roller, by said head support member swung by the rotation of said cam.

11. The imaging device according to claim 9, wherein:

said recording paper holding means moves reciprocatively to return said recording paper to an image formation start position, and when said recording paper holding means returns to said image formation start position, said platen roller rotates at a speed higher than a moving speed of said recording paper holding means, said platen roller rotating synchronously with the movement of said recording paper by the action of said friction clutch and applying a resistance to the movement of said recording paper.

12. The platen roller rotation structure according to claim 9, wherein said imaging device is an imaging device for forming a color image by repeating a scanning process a plurality of times.

13. An imaging device for forming an image on a recording paper held by a movable recording paper holding means by moving the recording paper between a platen roller and a recording head disposed in close proximity to the platen roller by the movement of the recording paper holding means;

wherein said recording head is supported by a head support member swung by a cam member mounted to a rotation shaft; said head member capable of being located at an image forming position in close proximity to said platen roller; and at a paper feed position slightly spaced apart from said platen roller by said head support member swung by the rotation of said cam member;

wherein, when said recording paper is held by said recording paper holding means and fed, said recording head is located at said paper feed position and said recording paper is fed between said platen roller and said recording head, and wherein the recording paper and an ink ribbon placed on the recording paper are moved between said platen roller and said recording head in close proximity to said platen roller and an image is formed by transferring colors of the ink ribbon onto the recording paper by said recording head, said imaging device further comprising:

a supply reel about which said ink ribbon is wound, said supply reel being disposed upstream, with respect to the feeding of said recording paper, of said recording head; and a winding reel disposed downstream, with respect to the feeding of said recording paper, of said recording head, wherein said winding reel is coupled with a drive means through a friction clutch which runs in an idle state when a torque having a value greater than a predetermined value is applied to said friction clutch, said drive means rotating for winding said ink ribbon in the feeding direction of said recording paper; and wherein said winding reel, when unimpeded, winds said ink ribbon at a speed higher than a feeding speed of said recording paper, and when said recording paper is fed for forming an image, said ink ribbon follows said ink ribbon by the action of said friction clutch.

14. The ink ribbon winding structure according to claim 13, wherein said supply reel is rotated through a resistance member for applying a predetermined resistance to the rotation thereof.

15. An imaging device for forming an image on a recording paper held by a movable recording paper holding means by moving the recording paper between a platen roller and a recording head disposed in close proximity to the platen roller by the movement of the recording paper holding means;

wherein said recording head is supported by a head support member swung by a cam member mounted to a rotation shaft; said head member capable of being located at an image forming position in close proximity to said platen roller; and at a paper feed position slightly spaced apart from said platen roller by said head support member swung by the rotation of said cam member;

wherein, when said recording paper is held by said recording paper holding means and fed, said recording head is located at said paper feed position and said recording paper is fed between said platen roller and said recording head, wherein the recording paper and an ink ribbon placed on the recording paper are moved between said platen roller and said recording head in close proximity to said platen roller and an image is formed by transferring colors of the ink ribbon onto the recording paper by said recording head, said imaging device further comprising:

an ink ribbon cassette for supplying an ink ribbon for said imaging device, said ink ribbon cassette comprising:

a supply reel case rotatably accommodating a supply reel having said ink ribbon wound therearound; and a winding reel case rotatably accommodating a winding reel to which the extreme end of said ink ribbon is fixed, said supply reel case being parallel to said winding reel case, a side pate member coupling an end of said supply reel case to an end of said winding reel case, and an opening being defined substantially at the center of a plane between said supply reel case and said winding reel case, and said ink ribbon being wound by rotation of said winding reel from said supply reel to said winding reel through said opening.

16. An imaging device for forming an image on a recording paper held by a movable recording paper holding means by moving the recording paper between a platen roller and a recording head disposed in close proximity to the platen roller by the movement of the recording paper holding means;

wherein said recording head is supported by a head support member swung by a cam member mounted to a rotation shaft; said bead member capable of being located at an image forming position in close proximity to said platen roller; and at a paper feed position slightly spaced apart from said platen roller by said head support member swung by the rotation of said cam member;

wherein, when said recording paper is held by said recording paper holding means and fed, said recording head is located at said paper feed position and said recording paper is fed between said platen roller and said recording head, and further comprising:

a pressure contact structure for causing recording papers, accommodated in a recording paper cassette, to come into pressure contact with a feed roller in a cassette insertion unit in said imaging device, the recording paper cassette being inserted into said cassette insertion unit and the recording papers being fed by the rotation of the feed roller, wherein said recording paper cassette comprises:

an operation hole formed therein in a front end bottom portion;

a cam projection formed on a front side portion of said recording paper cassette;

a recording paper accommodation unit for holding said recording papers; and a holding plate, located in the recording paper accommodation unit, said holding plate having a front end and a rear end and being supported at the rear end to be swung at the front end; and wherein said cassette insertion unit comprises:

a holding plate operation arm insertable into said operation hole of said recording paper cassette, and swingably supported to press said holding plate from a lower side of said holding plate;

an operation lever swung by said cam projection of said recording paper cassette; and a spring connecting said operation lever and said holding plate operation arm, wherein when said recording paper cassette is inserted into said cassette insertion unit, said operation lever is swung by said cam projection of said recording paper cassette, said holding plate operation arm is swung via said spring into said operation hole, and said holding plate is swung by said holding plate operation arm so that said recording papers, held by said holding plate, are caused to come into pressure contact with said feed roller.

17. The imaging device according to claim 16, wherein a front end of said cam projection is formed as a cam surface gradually declining toward the front end of said recording paper cassette, and the rear end of said cam projection is formed as a horizontal stable portion slightly lower than a highest portion of said cam surface.

18. The imaging device according to claim 17, wherein a cam follower is rotatably mounted to said operation lever.

19. The imaging device according to claim 16, wherein a roller is rotatably mounted to a distal end of said holding plate operation arm.

20. An imaging device for forming an image on a recording paper held by a movable recording paper holding means by moving the recording paper between a platen roller and a recording head disposed in close proximity to the platen roller by the movement of the recording paper holding means;

wherein said recording head is supported by a head support member swung by a cam member mounted to a rotation shaft; said head member capable of being located at an image forming position in close proximity to said platen roller, and at a paper feed position slightly spaced apart from said platen roller by said head support member swung by the rotation of said cam member;

wherein, when said recording paper is held by said recording paper holding means and fed, said recording head is located at said paper feed position and said recording paper is fed between said platen roller and said recording head, said movable recording paper holding member comprising:

a pair of rollers disposed vertically and pressed against each other with at least one of the rollers being driven to rotate, at least one of said pair of rollers having a smoothly finished surface and said imaging device further comprising:

means for guiding said recording paper so that the leading end is directed between a pressure contact portion of said pair of rollers and a center of rotation of said roller having the smoothly finished surface, said image transfer head forming a portion of said means for guiding.

* * * * *